US006423275B1

(12) United States Patent
D'Souza

(10) Patent No.: US 6,423,275 B1
(45) Date of Patent: Jul. 23, 2002

(54) REGENERATIVE DEVICES AND METHODS

(76) Inventor: Melanius D'Souza, 1718 Avenida Entrada, San Dimas, CA (US) 91773-4314

( * ) Notice: Subject to any disclaimer, the term of this patent is extended or adjusted under 35 U.S.C. 154(b) by 0 days.

(21) Appl. No.: 09/829,123

(22) Filed: Apr. 9, 2001

Related U.S. Application Data

(63) Continuation of application No. 09/258,751, filed on Feb. 26, 1999, now abandoned.
(60) Provisional application No. 60/076,340, filed on Feb. 27, 1998.

(51) Int. Cl.[7] ..... B01J 19/00; F28F 5/00
(52) U.S. Cl. ..... 422/129; 422/175; 422/206; 422/223; 165/4; 165/909; 165/DIG. 9; 165/DIG. 37; 165/DIG. 40; 165/DIG. 92
(58) Field of Search ..... 165/4, 909, DIG. 9, 165/DIG. 37, DIG. 40, DIG. 92; 422/129, 175, 206, 223

(56) References Cited

U.S. PATENT DOCUMENTS 4,558,731 A * 12/1985 Pentikäinen et al. ..... 165/4
4,576,201 A * 3/1986 Guggenheim ..... 137/624.18
5,453,259 A * 9/1995 D'Souza ..... 423/245.1
5,651,668 A * 7/1997 Schmid ..... 431/170
6,129,139 A * 10/2000 De Clerc ..... 165/9.3

* cited by examiner

*Primary Examiner*—Steven P. Griffin
*Assistant Examiner*—Timothy C. Vanoy
(74) *Attorney, Agent, or Firm*—Melanius D'Souza

(57) ABSTRACT

The present invention is directed to an apparatus for directing process fluids through regenerative systems using a Multi-Port Valve Assembly. Any number of process fluids can be directed through any number of regenerative devices in a regenerative system by use of the Multi-Port Valve Assembly of the present invention. Further, more than one Multi-Port Valve Assembly can be used in a regenerative system to provide for parallel-flow or counter-flow of the process fluids within the regenerative system. The regenerative systems can be used in environmental applications as Regenerative Thermal Oxidizers, Regenerative Catalytic Oxidizers, VOC Concentrators, and Reversible Chemical Reactors. The regenerative systems can also be used in energy conservation applications as Regenerative Heat-Exchangers.

18 Claims, 43 Drawing Sheets

REGENERATIVE DEVICES AND METHODS

This is a continuation of application Ser. No. 09/258,751 dated Feb. 26, 1999, now abandoned, which claims priority from Provisional application No. 60/076,340 filed Feb. 27, 1998.

FIELD OF THE INVENTION

The present invention is directed to methods and devices for processing fluids in energy conservation and environmental pollution control applications using regenerative techniques.

DESCRIPTION OF THE PRIOR ART

Regenerative systems have long been used in energy conservation and environmental equipment. One of the best known examples of the use of a regenerative system in energy conservation is the use of regenerators in open-hearth steel furnaces. In such regenerators, two stationary beds of heat transfer and storage material are used. Dampers are provided at the inlet and outlet of each bed to alternately allow hot furnace exhaust gas and cold ambient air to flow through each bed. The heat in the hot exhaust air is therefore transferred to the colder heat-transfer material during the first part of the cycle. The ambient air then cools the hot heat-transfer material during the second part of the cycle. Thus the ambient air recovers heat which would otherwise be wasted from the hot furnace exhaust gas. Other examples are regenerators in blast-furnace stoves for the production of pig-iron and regenerator systems for by-product coke ovens which follow a similar operating principle. Another type of a regenerative heat-exchanger is the Ljungstrom wheel which is widely used in commercial HVAC and power plant applications. The standard design of the Ljungstrom wheel has a moving disc of heat transfer and storage material which is alternately moved between hot and cold air streams to transfer the heat from the hot air to the cold air Detailed description of these regenerative heat-exchanger systems is given in literature such as Perry's Chemical Engineering Handbook, Fifth edition.

Another form of the regenerative heat-exchanger is described in the Steam Handbook by Babcock and Wilcox. It is similar to the Ljungstrom wheel but has a stationary wheel with revolving inlet and outlet plenums for the entry and exit of the hot gases and cold gases into the heat-exchanger core. Thus in this design, the heat transfer media remains stationary while the hot and cold air streams are moved through various sections of the heat-transfer media to transfer heat from the hot gases to the cold gases.

The regenerative heat-exchanger concept has been widely adopted for conserving energy in processes which clean polluted gas streams by oxidation of the pollutants in a furnace. Such equipment is commonly known as Regenerative Thermal Oxidizers. Currently two types of Regenerative Thermal Oxidizers are commercially available. The first type uses the principle of the regenerators as described above for steel furnace regenerators and is herein referred to as a dampered conventional Regenerative Thermal Oxidizer. Thus such Regenerative Thermal Oxidizers use at least two beds which contain regenerative heat-transfer materials. The hot oxidized cleaned air and the relatively colder polluted air is alternately passed through each bed to transfer the heat from the hot clean oxidized gas to the cold process gas. The second type of Regenerative Thermal Oxidizer uses the stationary bed principle of the Ljungstrom wheel as described in the Steam Handbook and is herein referred to as a rotary valve Regenerative Thermal Oxidizer. In this system, a plurality of beds containing heat-transfer materials are arranged in a radial manner. A rotating valve mechanism selectively allows the cold polluted air and the hot oxidized air to alternately pass through each bed to transfer heat from the hot air to the cold air.

Examples of conventional dampered Regenerative Thermal Oxidizers are described in U.S. Pat. Nos. 5,098,286 and 5,026,277 to York. Examples of the rotary valve Regenerative Thermal Oxidizers are described in U.S. Pat. No. 5,460,789 to Wilhelm, U.S. Pat. No. 5,016,547 to Thomason, and U.S. Pat. No. 4,280,416 to Edgerton.

Regenerative methods which use adsorption mechanisms and/or chemical reactions to effect the cleaning of polluted air streams have also been used in environmental control processes. A common example of such a regenerative method is the adsorption of Volatile Organic Compounds (VOCs) by granulated activated carbon (GAC) or specialized zeolites or specially modified resins. Such systems are generally used for concentrating very-low concentration VOC-containing process air-streams prior to their final recovery or disposal. Systems using granulated activated carbon generally operate using the bed principle while systems using zeolites generally use the Ljungstrom wheel principle. An example of a granulated activated carbon adsorption system is the multiple bed adsorption system sold by Calgon Corporation and other vendors. An example of the zeolite wheel adsorption system is the Ecopure(TM) system sold by Durr Environmental.

Regenerative techniques are also used with reversible chemical reactions. An example of a regenerative process which utilizes a reversible chemical reaction for cleaning polluted air is described in an article titled "A Sorbent Regenerator Simulation Model in Copper Oxide Flue Gas Cleanup Processes" published in Environmental Progress, volume 17, no.2. This article describes a method of using copper oxide for the simultaneous removal of sulfur oxides and nitrogen oxides from flue gas. In the initial step, the copper oxide reacts with sulfur dioxide and oxygen in the flue gas to form copper sulfate. The copper sulfate and the copper oxide then act as catalysts for the reduction of oxides of nitrogen by ammonia. The copper oxide is then regenerated by reduction with methane.

Each of the regenerative process configurations described above have inherent design, constructional and operational problems. For example, conventional dampered Regenerative Thermal Oxidizers require fast-acting dampers to minimize the direct bypassing of the polluted air to the atmosphere during the time-interval in which the regenerators' control-damper blades are moving from an open to a closed position or vice-versa during the switching of the regenerator from the hot clean air to the cold polluted air or vice-versa. Fast acting dampers generally have severe maintenance problems especially on large units because the damper blade has to be moved rapidly. The inertia of the moving damper blade is difficult to control generally causing the damper blade to slam on the damper seals causing them to deteriorate rapidly. Thus frequent replacement of damper blades and seals is often required on such units. The inertia of the damper blades and the need for large quantities of motive fluids such as hydraulic fluid or compressed air to operate the dampers also requires that the dampers be opened and closed at long intervals. Thus short cycle times of less than a minute are difficult to achieve in such units which makes it difficult to reduce the quantity of the heat-transfer materials used in such heat-exchanger beds.

The problems of conventional dampered Regenerative Thermal Oxidizers are well described in the abovereferenced prior patents for rotary valve Regenerative Thermal Oxidizers. While rotary valve Regenerative Thermal Oxidizers utilizing the Ljungstrom wheel principle have been used to try to overcome these problems, they suffer from cross-leakage and capacity limitations. The gaps between the moving and stationary parts of the heat-exchanger are difficult to seal because the beds generally have to be wedge-shaped to fit radially in a circular array within a cylindrical shell. Therefore, complicated radial, longitudinal, and peripheral sealing mechanisms, which require accurately machined parts, are needed to keep cross leakage of the polluted air from the oxidized air. Such sealing is difficult to achieve especially for the radial, longitudinal, and peripheral moving parts that exist within such units. Thus increased leakage of polluted air into the cleaned air occurs which reduces the destruction and removal efficiency of rotary valve Regenerative Thermal Oxidizers compared to conventional dampered Regenerative Thermal Oxidizers. Therefore rotary valve Regenerative Thermal Oxidizers generally have a lower Destruction and Removal Efficiency (DRE) than conventional dampered Regenerative Thermal Oxidizers. The large mass and inertia of the rotating valve mechanism in rotary valve Regenerative Thermal Oxidizers generally requires slow movement which makes it difficult to reduce the cycle time to less than one minute. Therefore, the use of rotary valves on Regenerative Thermal Oxidizers has generally not reduced the size of the heat-exchanger beds. Thus the cost-savings of such a unit are marginal compared to conventional dampered Regenerative Thermal Oxidizers. The use of a rotating mechanism in rotary valve Regenerative Thermal Oxidizers also requires that the regenerative beds be generally arranged in a circular array over the rotating valve mechanism. Thus the capacity of the rotary valve Regenerative Thermal Oxidizer is generally restricted by the maximum diameter of a cylindrical shell that can be economically fabricated and shipped. There is therefore a need for a Regenerative Thermal Oxidizer which combines the advantages of dampered Regenerative Thermal Oxidizers with the advantages of rotary valve Regenerative Thermal Oxidizers. Such a Regenerative Thermal Oxidizer would have a large number of mechanically switched regenerative beds as in the rotary valve units. However, such a Regenerative Thermal Oxidizer would be built in a rectangular configuration for economical fabrication and installation. Further, such a Regenerative Thermal Oxidizer would have a larger flow-capacity than currently achievable by rotary valve Regenerative Thermal Oxidizers. Finally, such a Regenerative Thermal Oxidizer would have seals that provide a very high VOC destruction and removal efficiency. Yet further, such a Regenerative Thermal Oxidizer would be capable of shorter cycle times than is possible with presently available regenerative bed switching mechanisms resulting in smaller and more economical regenerative heat-exchanger beds.

The problems described above with respect to dampered bed Regenerative Thermal Oxidizers and rotary valve Regenerative Thermal Oxidizers are also manifested in other regenerative devices such as granulated activated carbon and zeolite adsorbers which are generally known as VOC concentrators. For example, a carbon adsorber operates with a cycle time of at least an hour. It therefore requires a large volume of expensive granulated activated carbon to adsorb the VOCs. The large amount of carbon requires large quantities of steam or hot air for desorption of the adsorbed VOCs. A large amount of energy is wasted in operating such devices since only 10 percent of the energy is used for heating the bed during desorption; the remaining 90 percent of the energy in the desorbing steam is reportedly lost as vapor or is used for heating the bed and the vessel. Thus, the use of smaller cycle times and shorter beds is desirable in carbon adsorption units. Rotary carbon units attempt to reduce the cycle time in VOC Concentrators by using smaller quantities of adsorption material which is configured as a rotating bed. The mechanism used is generally similar to those found in stationary Ljungstrom wheel regenerative heat-exchangers wherein a disc shaped wheel is rotated between fixed radially oriented plenums. In some other configuration, the adsorption material is contained in baskets which are configured to form a hollow cylinder which rotates between longitudinally oriented plenums. However, these units also suffer from sealing problems similar to those described above for the rotary-valve Regenerative Thermal Oxidizers. The mass of the moving adsorption bed also makes it difficult to reduce the cycle time of the rotary adsorber which typically operates at about 1 to 3 revolution per hour. There is therefore a need for a regenerative adsorber which combines the advantages of dampered regenerative adsorbers with the advantages of rotary valve regenerative adsorbers. Such an adsorber would have a large number of mechanically switched regenerative adsorption beds as in the rotary valve absorbers Such an adsorber would be built in a rectangular configuration enabling economical fabrication and large flow-capacities. Further, such an adsorber would have seals that provide a very high VOC transfer efficiency. Yet further, such an adsorber would be capable of shorter cycle times than is possible with current switching mechanisms, resulting in smaller and more economical regenerative adsorption beds.

Therefore, it will be apparent from the above discussion that a need exists for a means of controlling the flow of air through individual regenerative beds used in Regenerative Heat-Exchangers, Regenerative Thermal Oxidizers, Regenerative Catalytic Oxidizers, Regenerative VOC Concentrators, and Reversible Chemical Reactors without the disadvantages inherent with the rotary valve arrangement while retaining the advantages of relatively high destruction, transfer or conversion efficiencies, easy installation, and relatively large flow capacities of conventional dampered bed regenerative systems.

SUMMARY OF THE INVENTION

The present invention provides these advantages through the use of a novel Multi-Port Valve Assembly which can be used with various regenerative system such as heat-exchangers, VOC Concentrators, chemical reactors, thermal oxidizers, and catalytic oxidizers.

It is well known to use multi-port valves to selectively control the flow of fluids through selected ports. An example of a multi-port valve for diverting gas flow through various ports is described in U.S. Pat. No. 4,576,201 to Guggenheim. This valve uses a stainless-steel endless belt with apertures at pre-determined positions to selectively switch on or switch off the flow of fluids through various ports. However, the use of such valves with regenerative systems is not known.

A specially designed Multi-Port Valve Assembly is used herein with regenerative systems. The Multi-Port Valve Assembly according to the principles of the invention can be used with various embodiments of regenerative systems. For example, the Multi-Port Valve Assembly can be used with single-bed as well as multiple-bed regenerative systems. More than one Multi-Port Valve Assembly can also be used in a regenerative system to accomplish the specific requirements of the system.

A first embodiment of the regenerative system comprises a regenerative device and a Multi-Port Valve Assembly. In this system, the Multi-Port Valve Assembly has a rigid flow control means which controls the flow of the process fluid through a single regenerative device. The flow control means has fluid passage zones which are movingly overlapped with the fluid inlet port of the regenerative device to open or close the fluid inlet ports. Thus the flow of the process fluid through the single regenerative device is selectively switched on or off to accomplish the regenerative process. In another single regenerative device embodiment of the regenerative system, the flow control means is a flexible belt, the ends of which are dropped in to take up wells. In yet another single regenerative device embodiment of the regenerative system, the flow control means is a flexible belt, the ends of which are spooled on spool drums at either end. In a further embodiment, the flow control member is a flexible endless belt which travels in an endless loop to open and close the fluid inlet port to the regenerative device.

In another embodiment of the regenerative system, the Multi-Port Valve Assembly has a flow control means which is configured as an endless belt and which controls the flow of two process fluids through a single regenerative device. In another embodiment of the regenerative system, the Multi-Port Valve Assembly has a flow control means which is configured as an endless belt and which controls the flow of two process fluids through two regenerative devices. In yet another embodiment of the regenerative system, the Multi-Port Valve Assembly has a flow control means which is configured as an endless belt and which controls the flow of three process fluids through six regenerative devices. This embodiment is described as an example of the general principles of the invention embodied in a regenerative system which can be used with any number of process fluids and any number of regenerative devices.

In a further embodiment of the regenerative system, two Multi-Port Valve assemblies are used, one on each end of the regenerative devices, to control the flow of the process fluids through the regenerative devices. The Multi-Port Valve Assemblies can be configured so that the process fluids can flow either in a parallel-flow mode or a counter-flow mode within the regenerative devices. This regenerative system is particularly useful as a regenerative heat-exchanger or a VOC Concentrator. A further embodiment of the above system uses energy transfer devices within the regenerative material in the regenerative devices for use of the regenerative system as a Regenerative Thermal Oxidizer or a Reversible Chemical Reactor.

Yet another modification of the above embodiment further incorporates catalysts within the regenerative materials for use of the system as a Regenerative Catalytic Oxidizer. Yet another embodiment of the above described regenerative system uses a common flow control member to service both Multi-Port Valve Assemblies. A further embodiment of the above regenerative system uses a common drive mechanism to move the two flow control members of the two Multi-Port Valve Assemblies.

A different embodiment of the regenerative system incorporates a common combustion chamber at the second end of the regenerative devices for use of the system as a Regenerative Thermal Oxidizer. A variation of this embodiment further incorporates catalysts within the regenerative materials for use of the system as a Regenerative Catalytic Oxidizer.

The flow control means used in the above described embodiments can be made of metallic or non-metallic materials. Further the flow control means can be configured as a single layered belt or a composite belt made of multiple layer of different materials. The fluid passage zones on the flow control means can be configured as orifices or slots or other suitable shapes. The fluid passage zones can be arranged so the specific requirements of the regenerative system can be satisfied.

The use of the Multi-Port Valve Assembly described herein with regenerative systems eliminates the control dampers and associated hardware and instrumentation that is required with conventional dampered regenerative systems which use control dampers for reversing the flow of the process fluid through the regenerative beds of such systems. It also reduces the process disturbances caused by pressure surges that occur with conventional dampered regenerative systems. Furthermore, the use of the Multi-Port Valve Assembly provides for a larger flow-capacity compared to currently available rotary-valve regenerative systems because the regenerative beds can be designed with a rectangular cross-section. Therefore, the size of the regenerative beds in such systems is not restricted by the fabrication and shipping limitations of cylindrical shaped vessels. The use of the Multi-Port Valve Assembly reduces the complexity of the regenerative system by eliminating the complicated control system and the hydraulic or compressed-air systems required to move the control dampers. Thus a regenerative system which uses a Multi-Port Valve Assembly can be easily maintained by the average maintenance technician. The use of the Multi-Port Valve Assembly makes the regenerative system easier to fabricate without the need for very high-tolerance machined parts or complicated seals to reduce the cross-leakage that is sometimes inherent in such systems.

Still further advantages of the invention will be apparent from the following drawings and description.

Figure 17A:
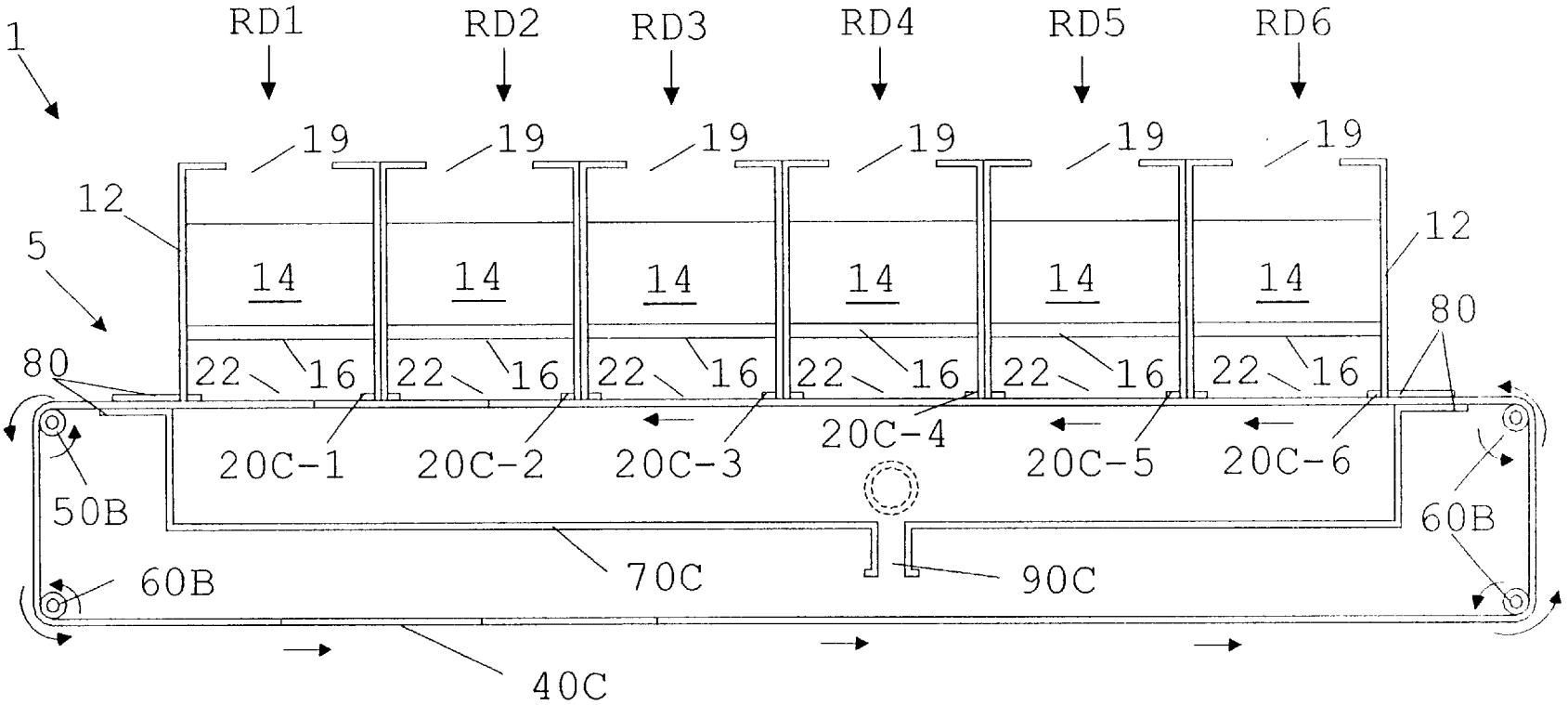
FIG. 17A is a sectional elevational representation showing a simplified embodiment of the regenerative system according to the present invention in which the Multi-Port Valve Assembly uses two endless flexible belts on the first end of the regenerative devices as flow control means and which is adapted to the flow of three process fluids into six regenerative devices.
Figure 18A:
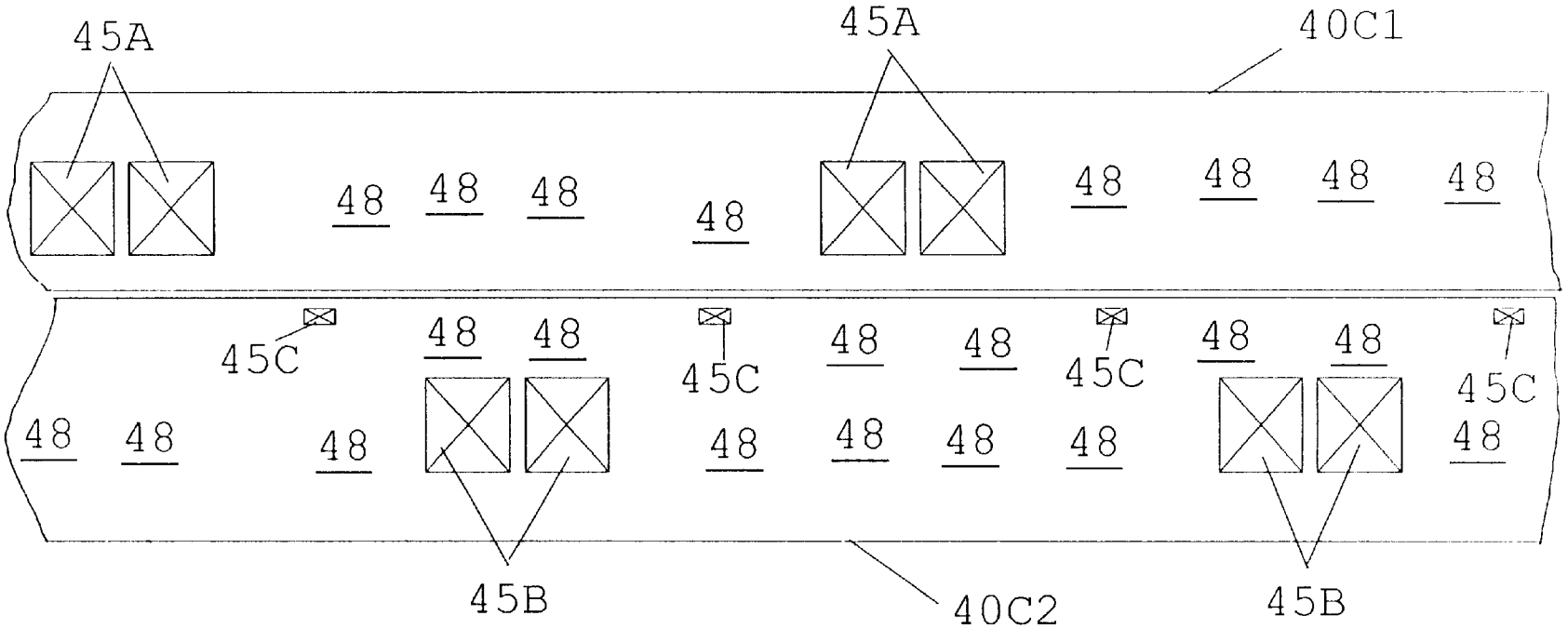
FIG. 18A is a plan representation of the flow control means used in the Multi-Port Valve Assembly used in the regenerative system of FIG. 17A.
Figure 18B:
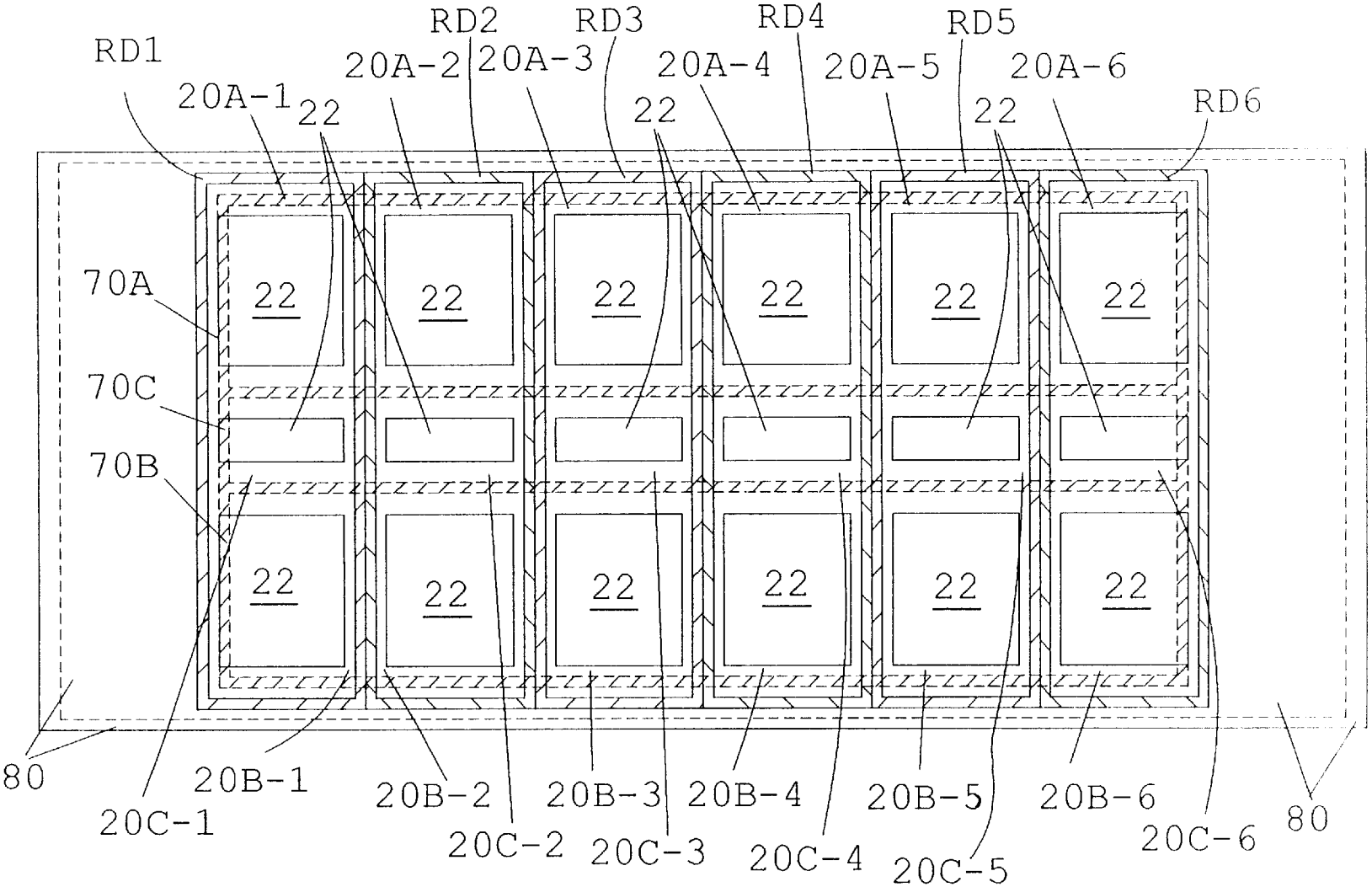
FIG. 18B is a plan representation of the fluid plenums and the flow communication means used in the Multi-Port Valve Assembly used in the regenerative system of FIG. 18A.

FIG: 18E is yet another assembled "freeze-frame" plan representation of a portion of the flow control means of FIG. 18A operating in cooperation with the fluid plenums and the flow communication means of FIG. 18B during the operation of the regenerative system of FIG. 17A and shown without the drive system.

Figure 18C:
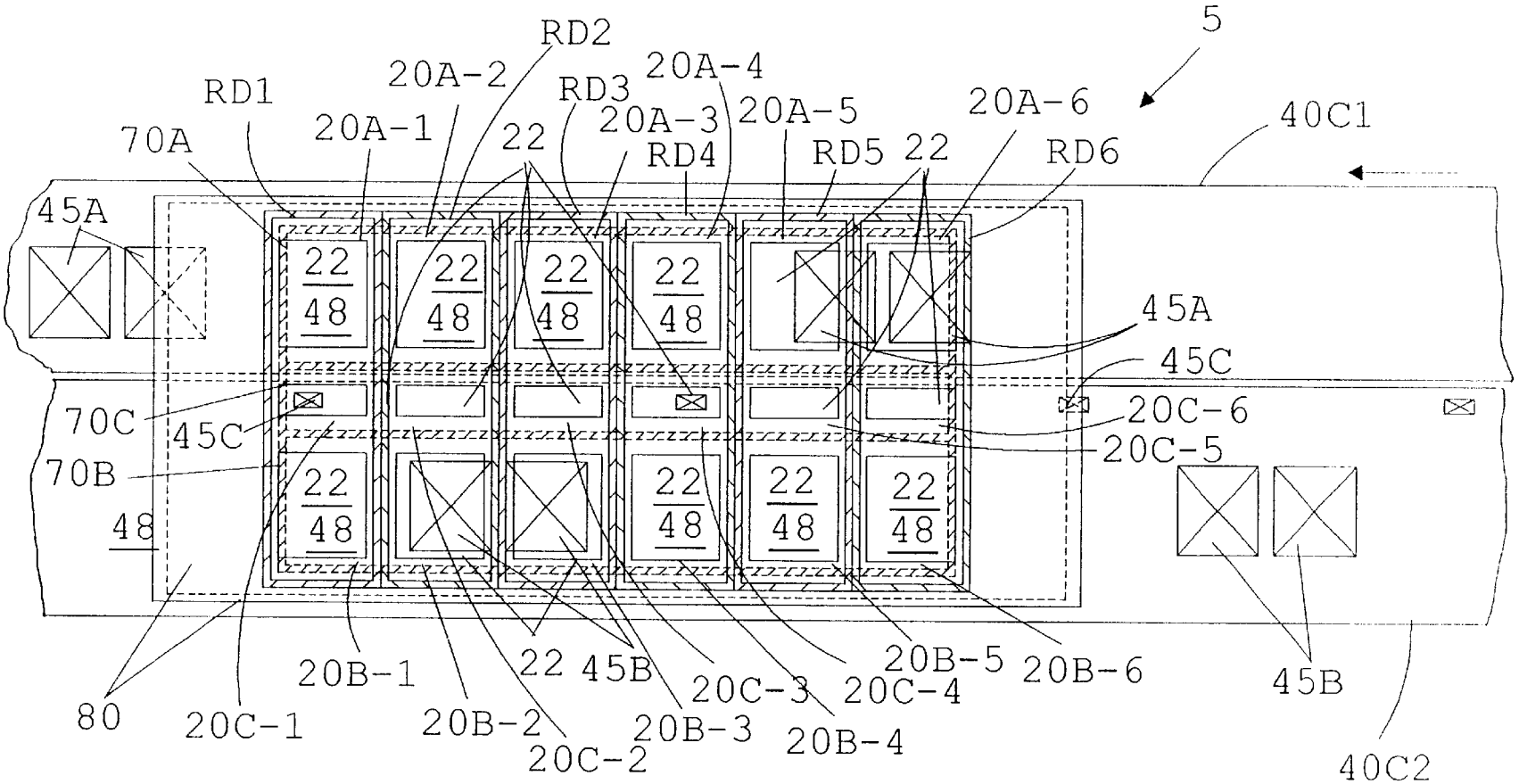
FIG. 18C is an assembled "freeze-frame" plan representation of a portion of the flow control means shown in FIG. 18A operating in cooperation with the fluid plenums and the flow communication means of FIG. 18B during the operation of the regenerative system of FIG. 17A and shown without the drive system.
Figure 18D:
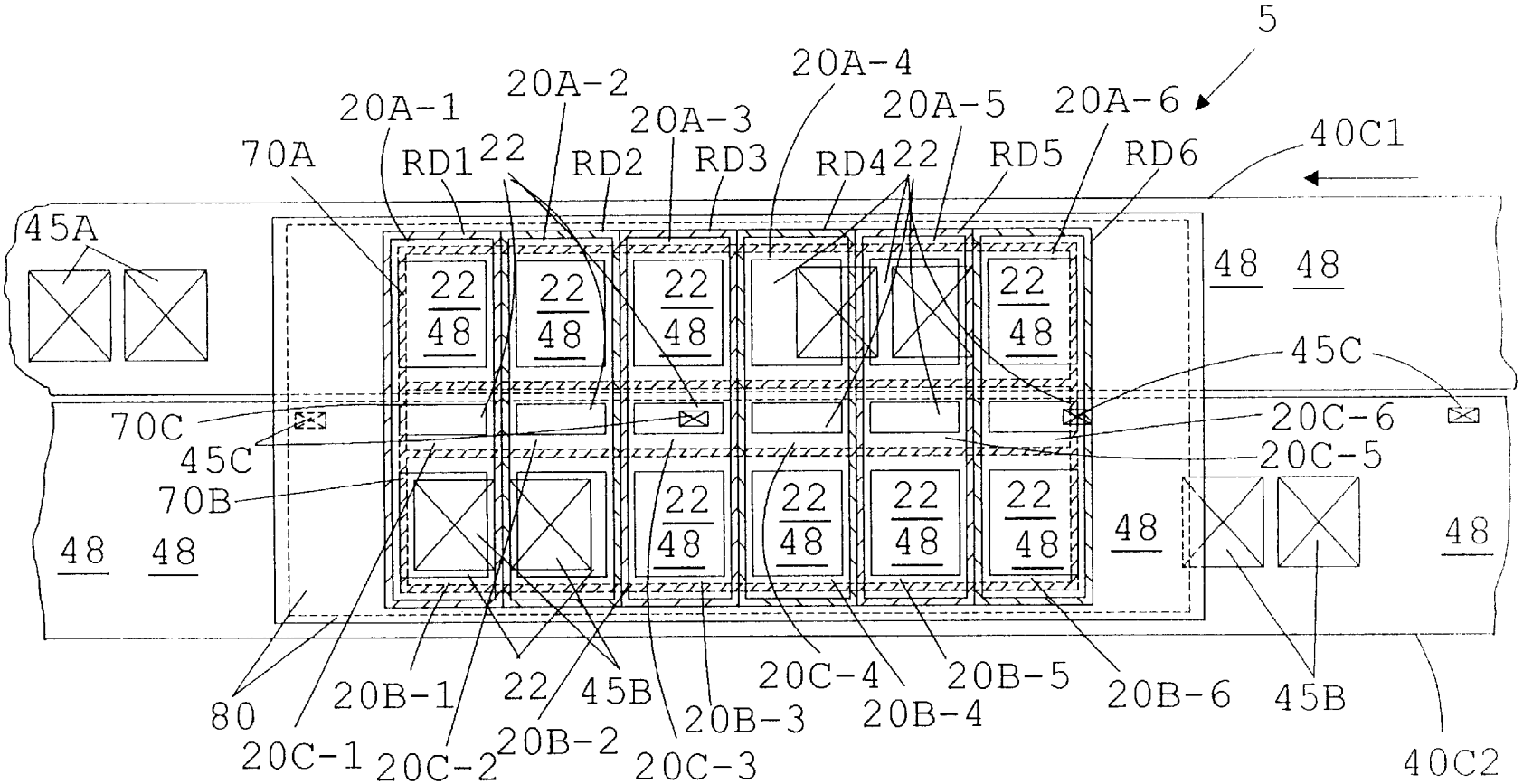
FIG. 18D is another assembled "freeze-frame" plan representation of a portion of the flow control means of FIG. 18A operating in cooperation with the fluid plenums and the flow communication means of FIG. 18B during the operation of the regenerative system of FIG. 17A and shown without the drive system.
Figure 18E:
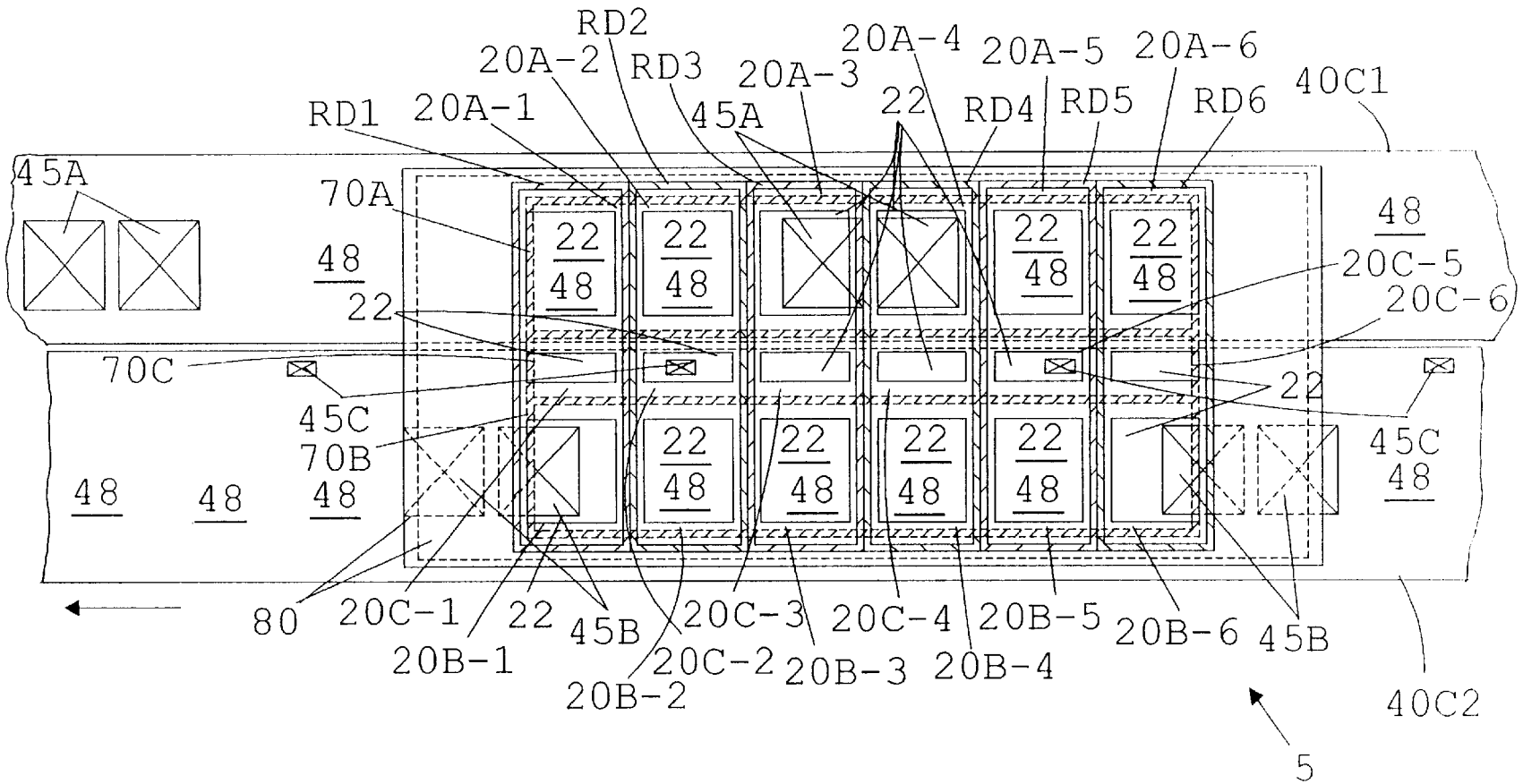
Figure 18F:
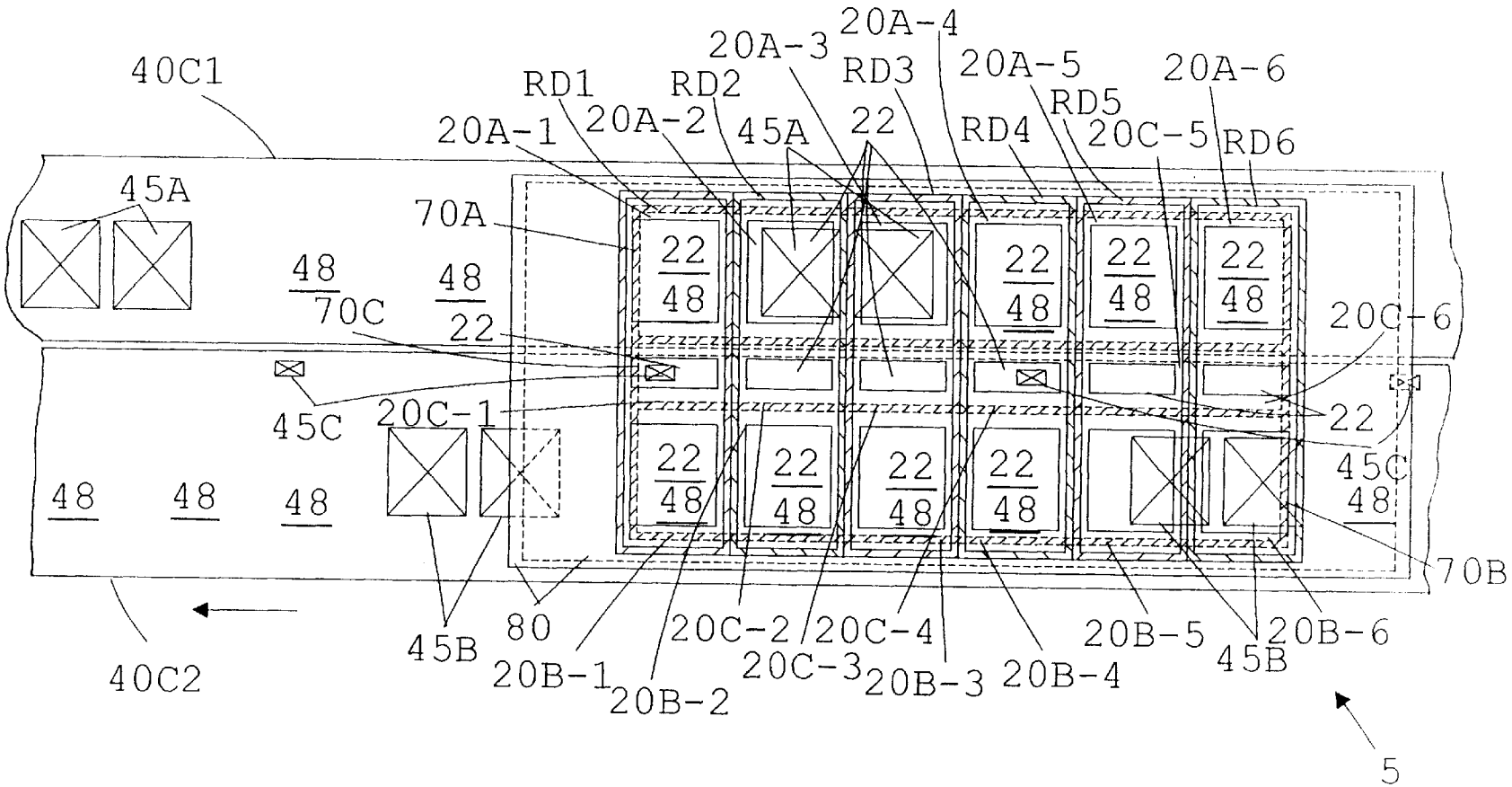

FIG. 18F is yet another assembled "freeze-frame" plan representation of a portion of the flow control means of FIG. 18A operating in cooperation with the fluid plenums and the flow communication means of FIG. 18B during the operation of the regenerative system of FIG. 17A and shown without the drive system.

Figure 19A:
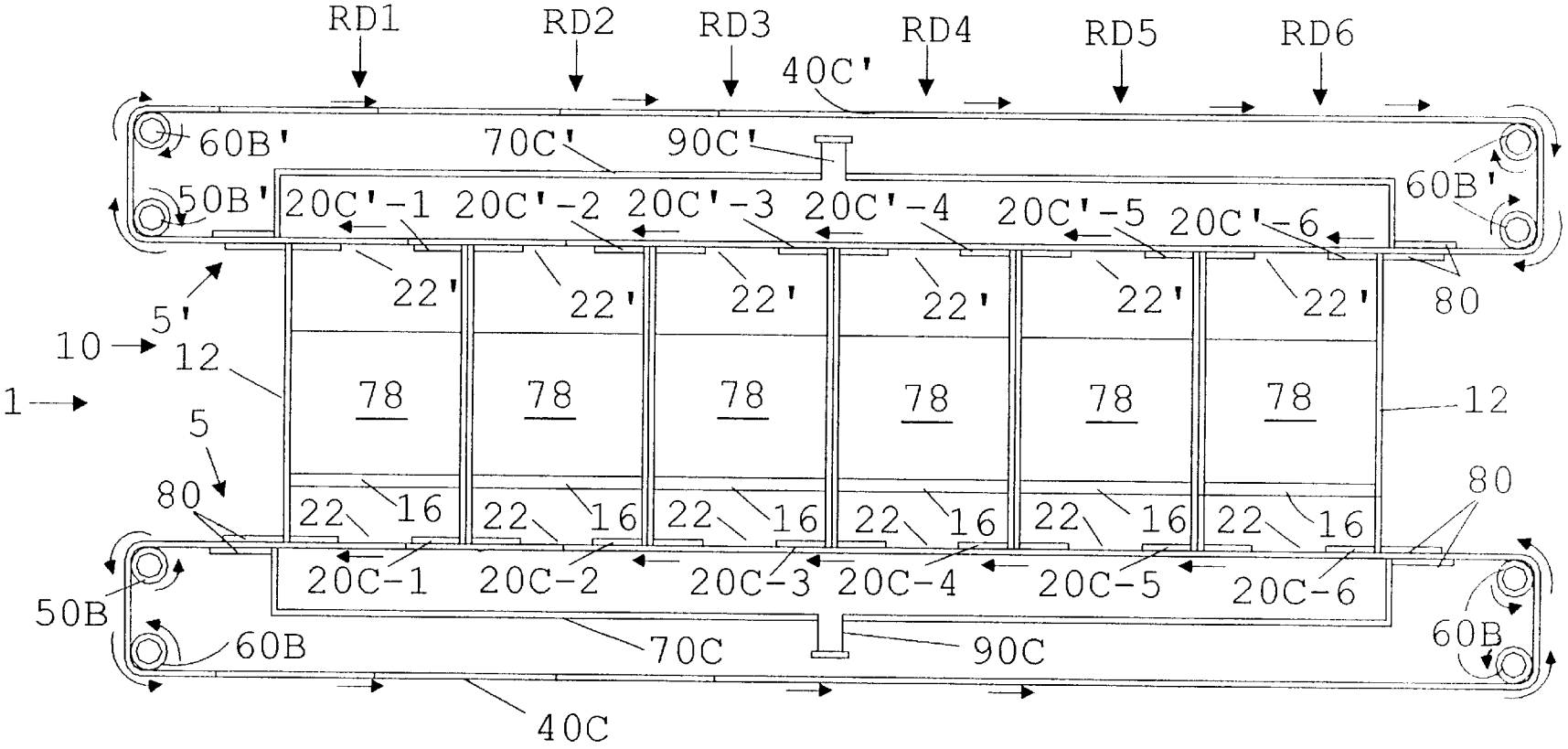

FIG. 19A is a sectional elevational representation showing a simplified embodiment of the regenerative system according to the present invention which uses two Multi-Port Valve Assemblies, one each on the first and second ends of the regenerative devices and which is adapted to the flow of two process fluids into six regenerative devices, and which is further adapted for use as a regenerative heat-exchanger.

Figure 19B:
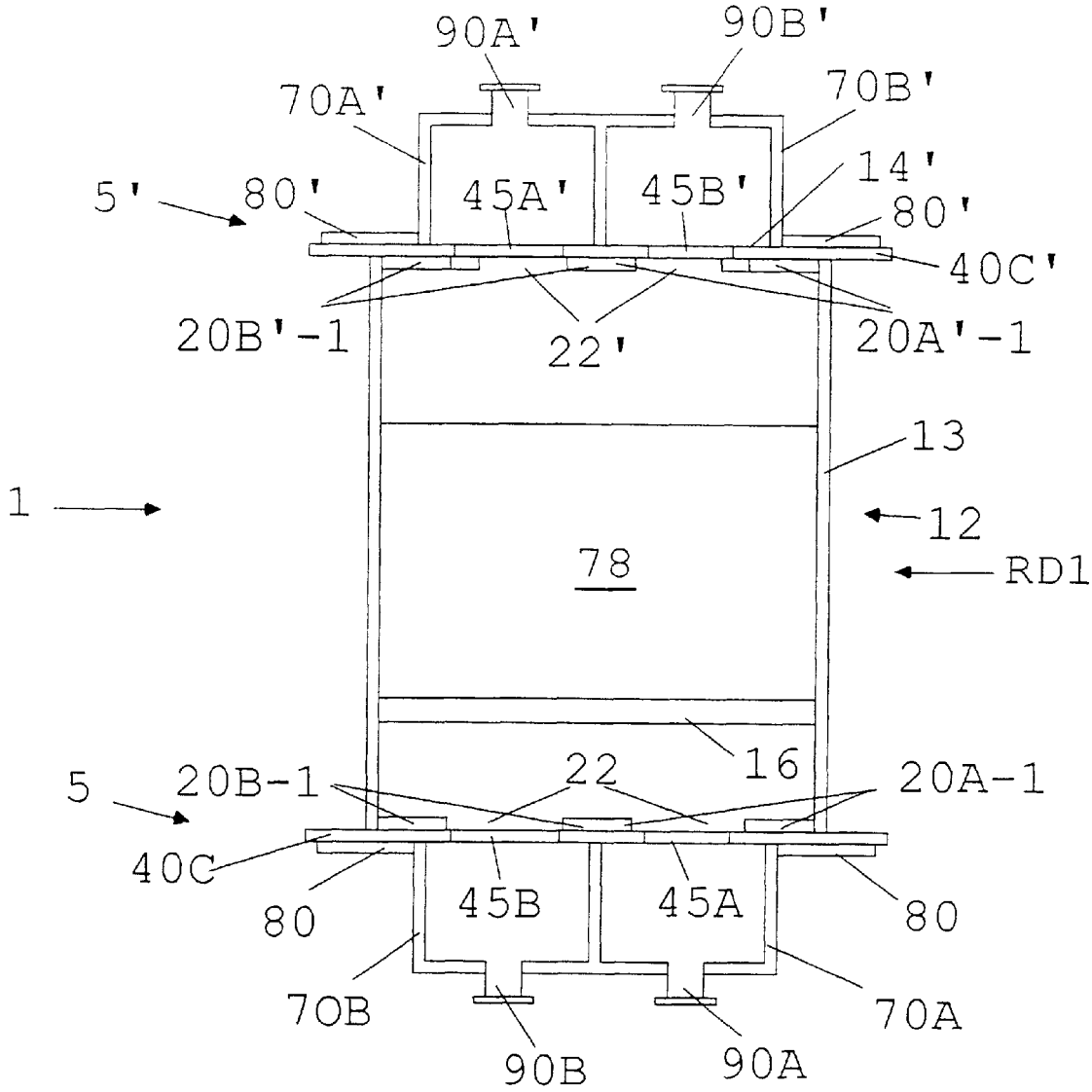

FIG. 19B is a sectional side-elevational representation of the regenerative system of FIG. 19A.

Figure 20:
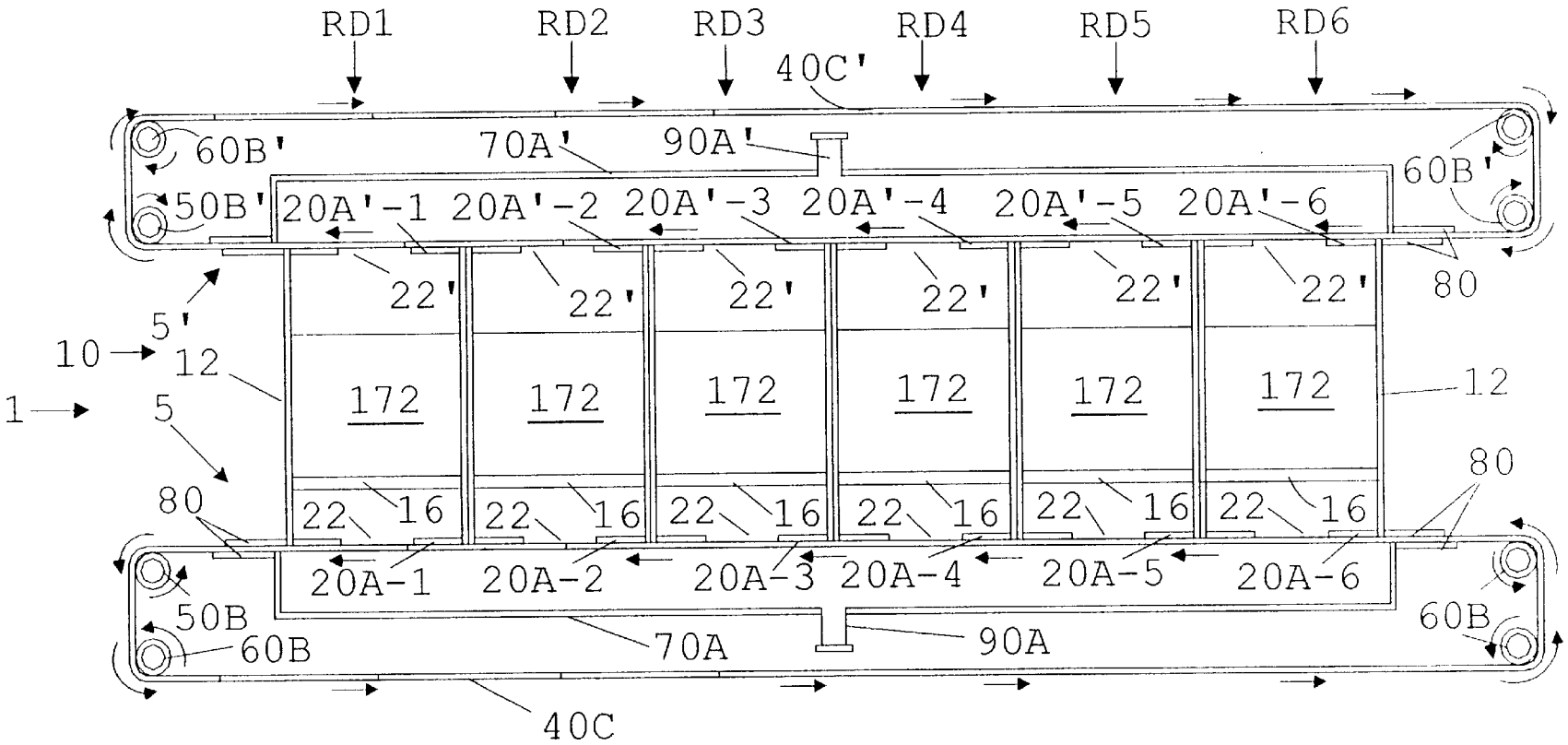

FIG. 20 is a sectional elevational representation showing a simplified embodiment of the regenerative system, according to the present invention, which uses two Multi-Port Valve Assemblies, one each on the first and second ends of the regenerative devices and which is adapted to the flow of two process fluids into six regenerative devices, and which is further adapted for use as a regenerative VOC Concentrator.

Figure 21:
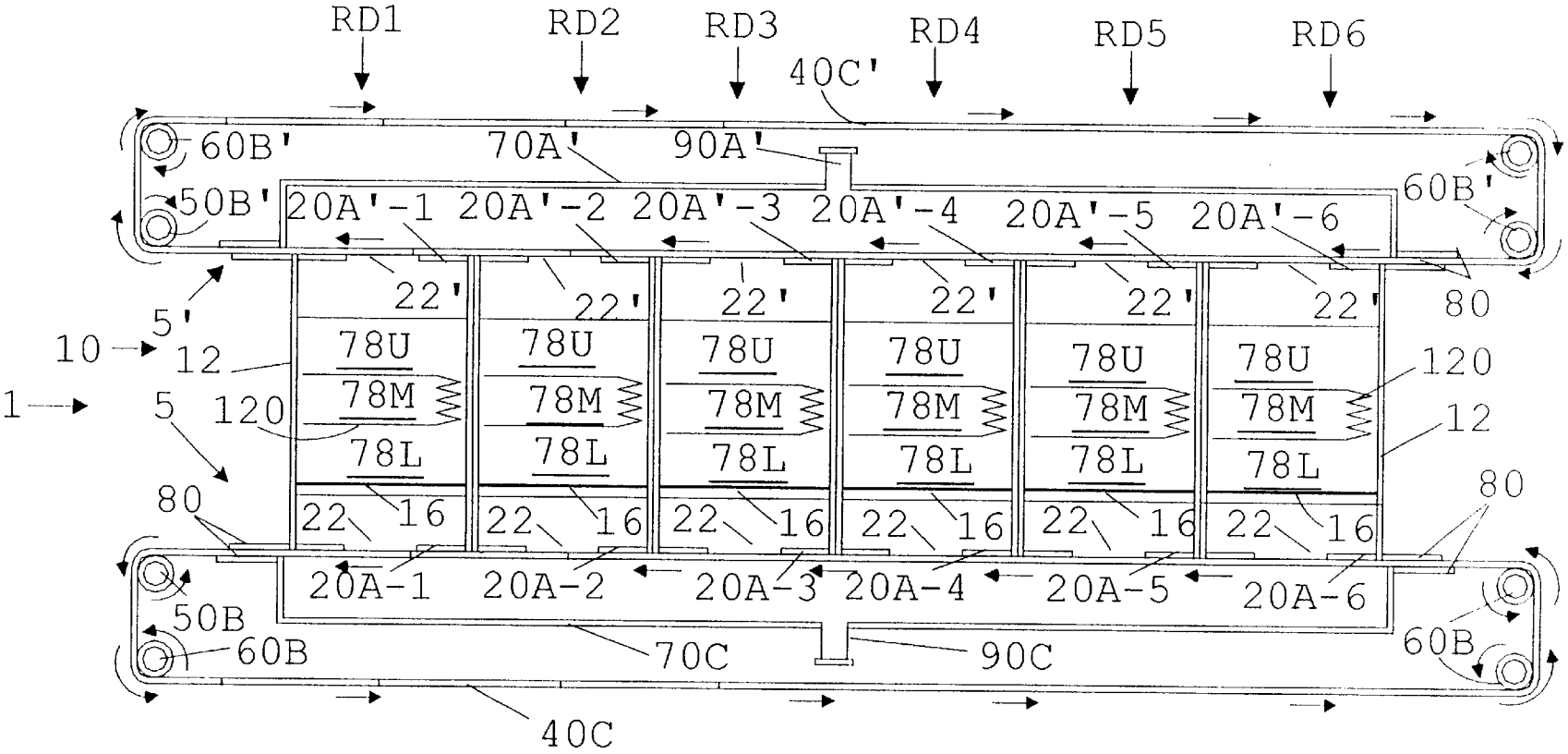

FIG. 21 is a sectional elevational representation showing a simplified embodiment of the regenerative system according to the present invention which uses two Multi-Port Valve Assemblies, one each on the first and second ends of the regenerative devices and which is adapted to the flow of two process fluids into six regenerative devices, and which is further adapted for use as a Regenerative Thermal Oxidizer.

Figure 22:
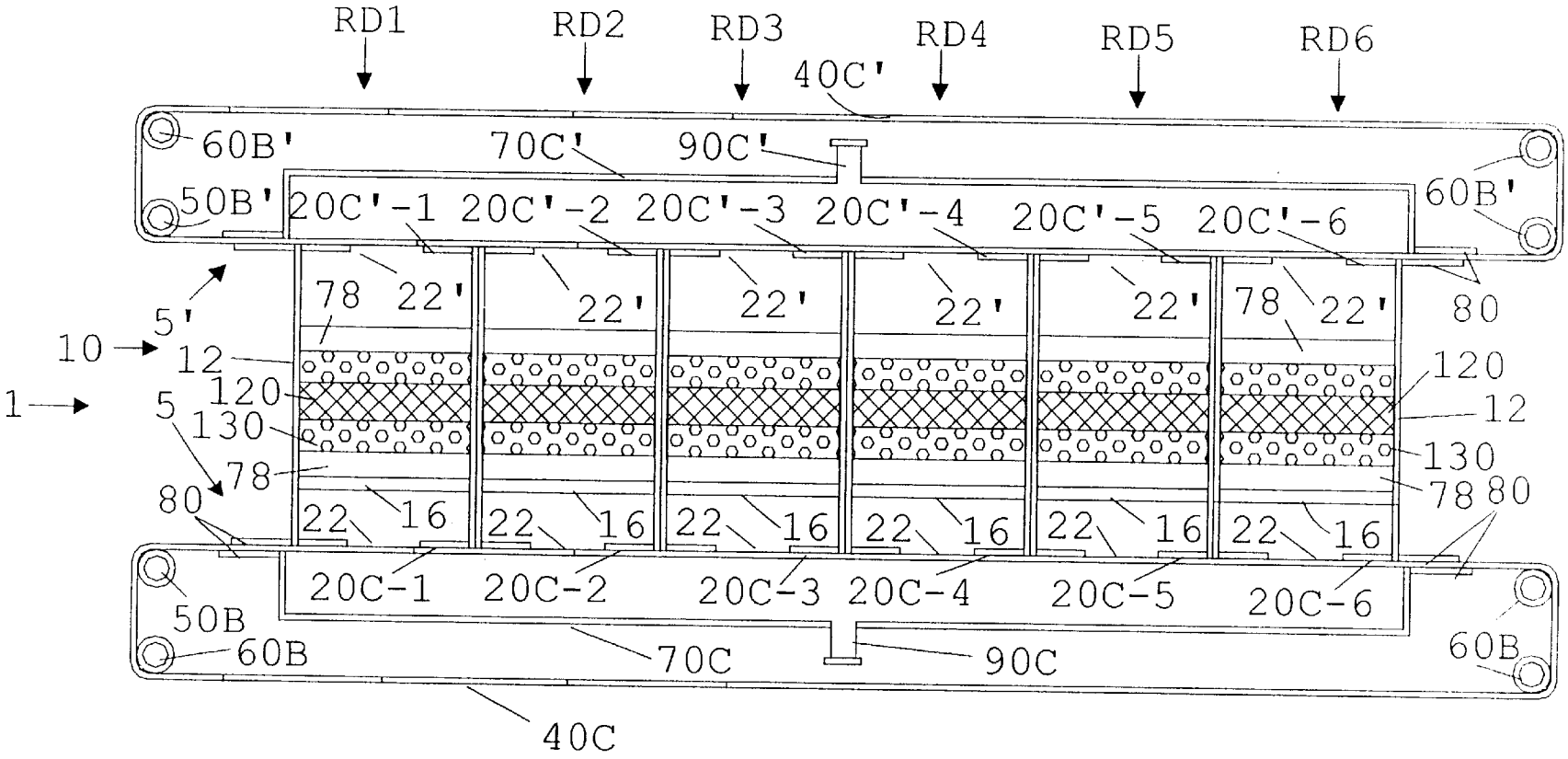

FIG. 22 is a sectional elevational representation showing a simplified embodiment of the regenerative system according to the present invention which uses two Multi-Port Valve Assemblies, one each on the first and second ends of the regenerative devices and which is adapted to the flow of two process fluids into six regenerative devices, and which is further adapted for use as a Regenerative Catalytic Oxidizer.

Figure 23:
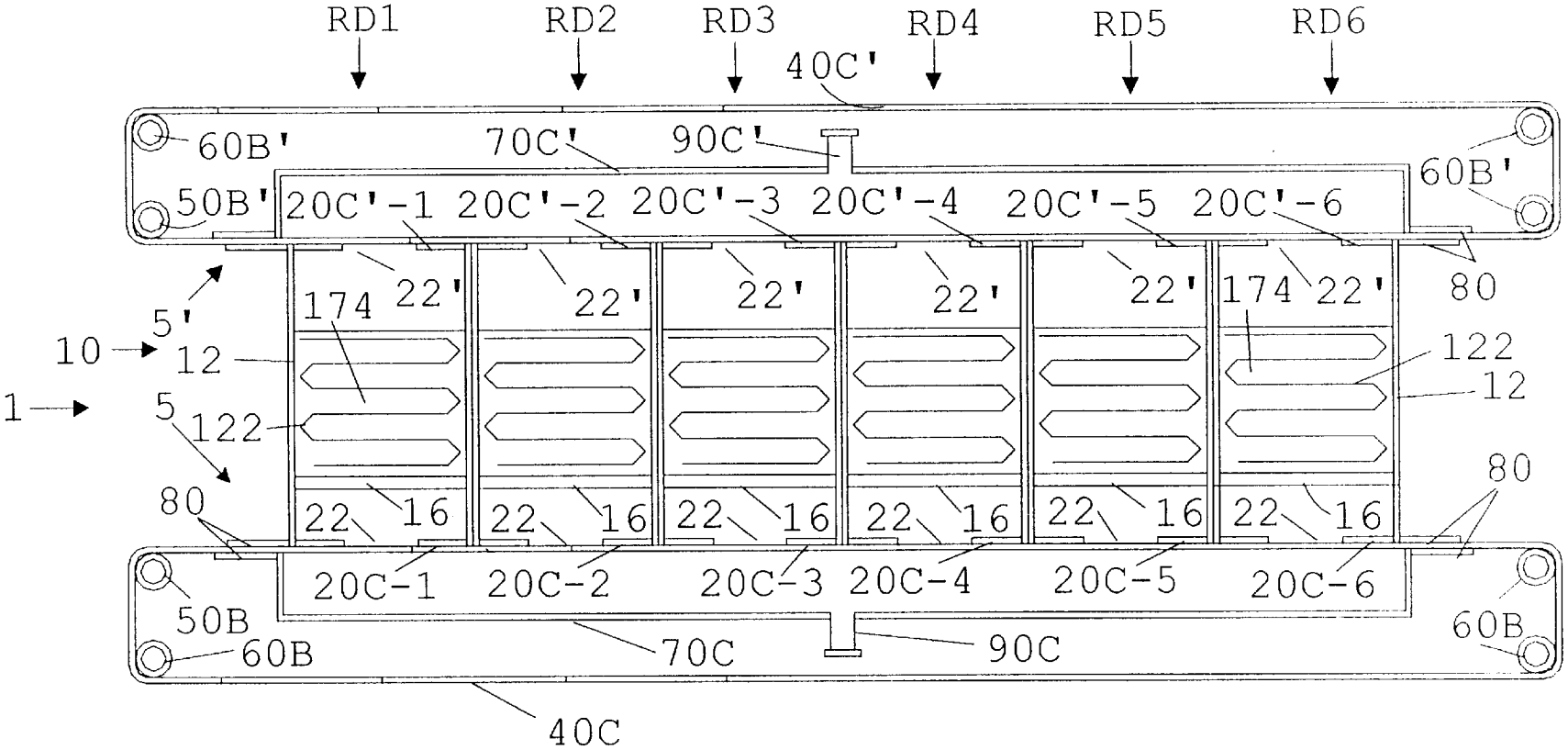

FIG. 23 is a sectional elevational representation showing a simplified embodiment of the regenerative system according to the present invention which uses two Multi-Port Valve Assemblies, one each on the first and second ends of the regenerative devices and which is adapted to the flow of two process fluids into six regenerative devices, and which is further adapted for use as a Regenerative Chemical Reactor.

Figure 24A:
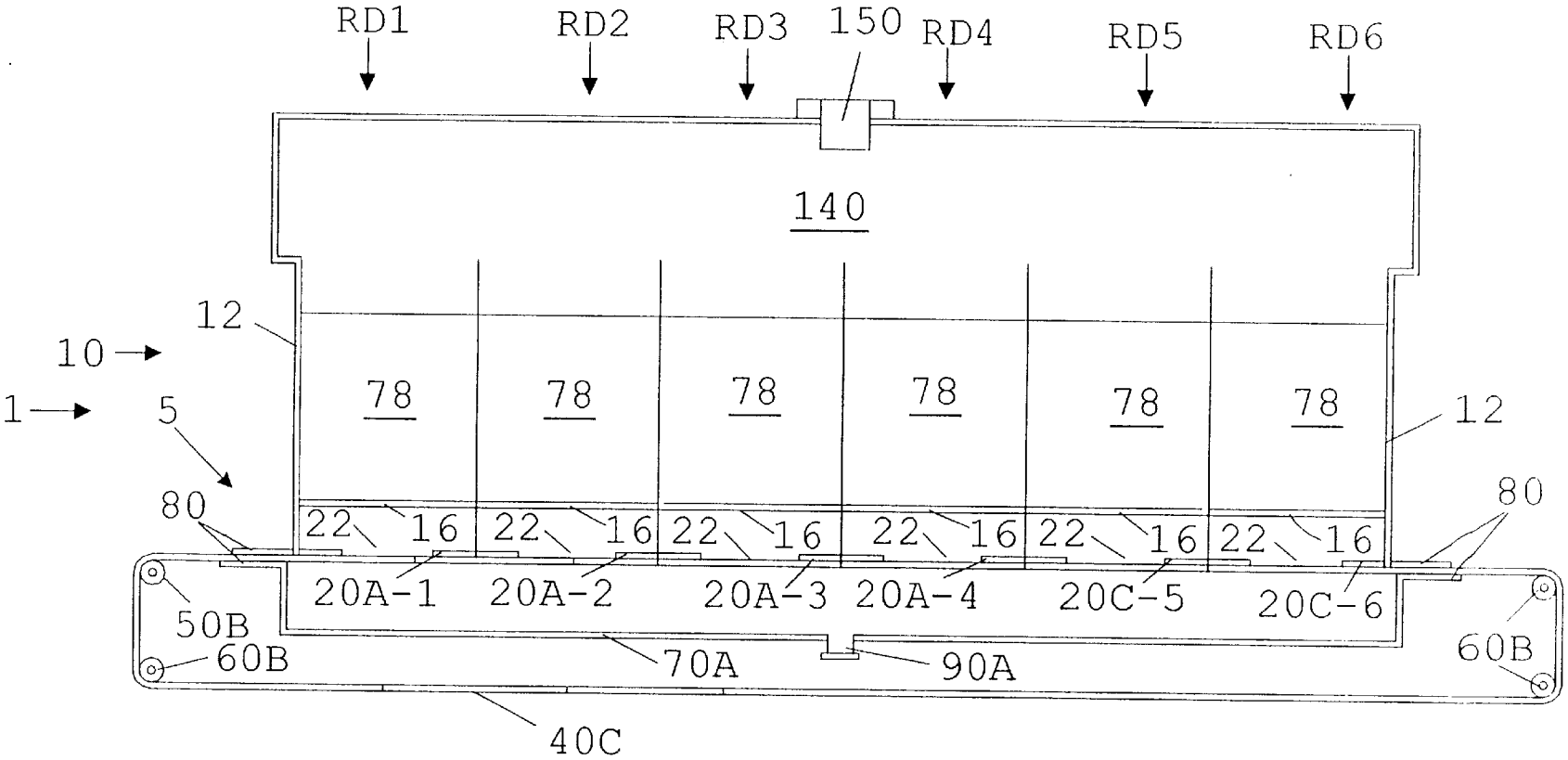

FIG. 24A is a sectional elevational representation showing a simplified embodiment of the regenerative system according to the present invention which uses one Multi-Port Valve Assembly on the first end of the regenerative devices and which is adapted to the flow of three process fluids into six regenerative devices, and which has a common combustion chamber in fluid communication with the second ends of the regenerative device for use as a Regenerative Thermal Oxidizer.

Figure 24B:
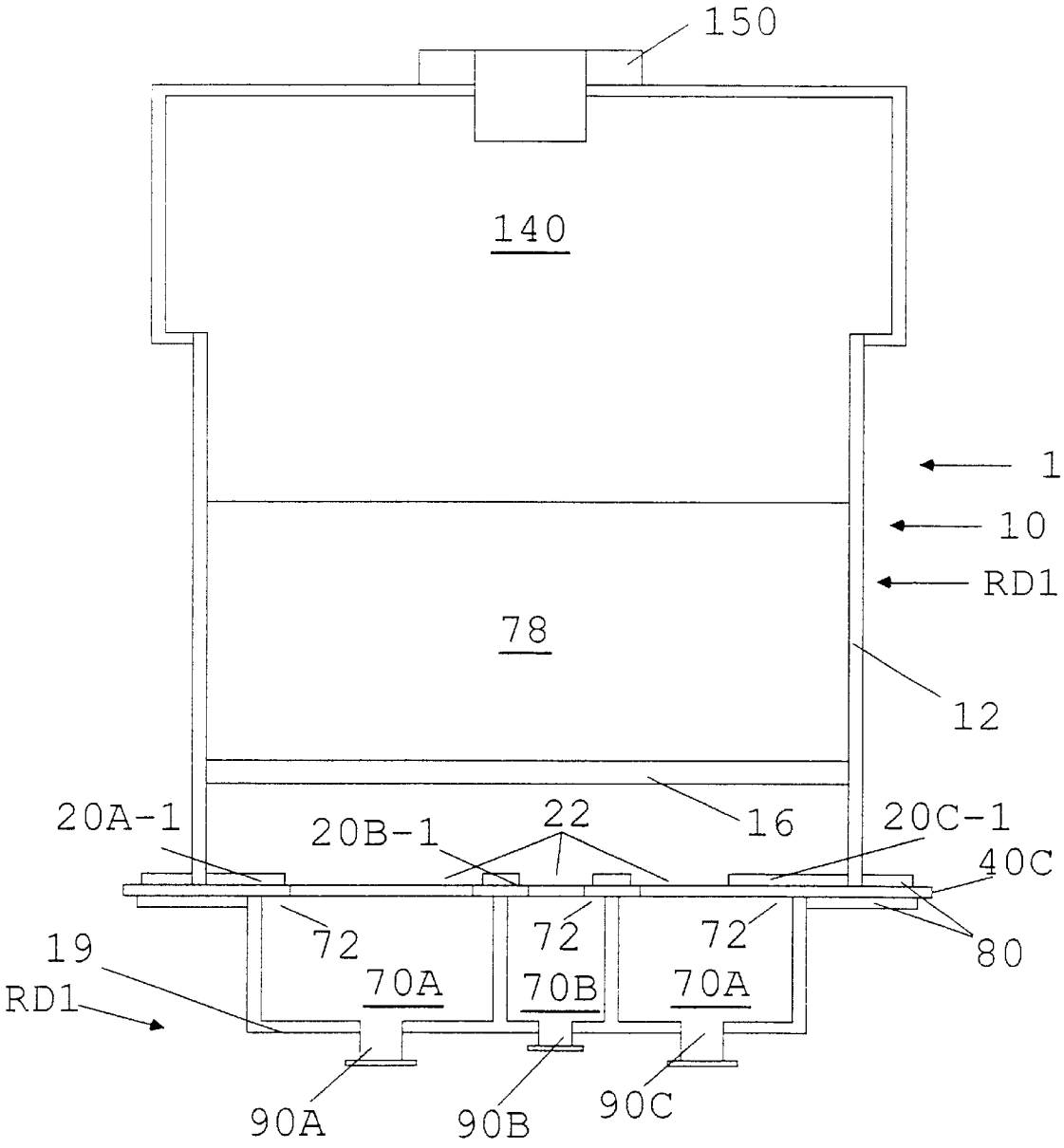

FIG. 24B is a sectional side-elevational representation of the regenerative system of FIG. 24A.

Figure 25:
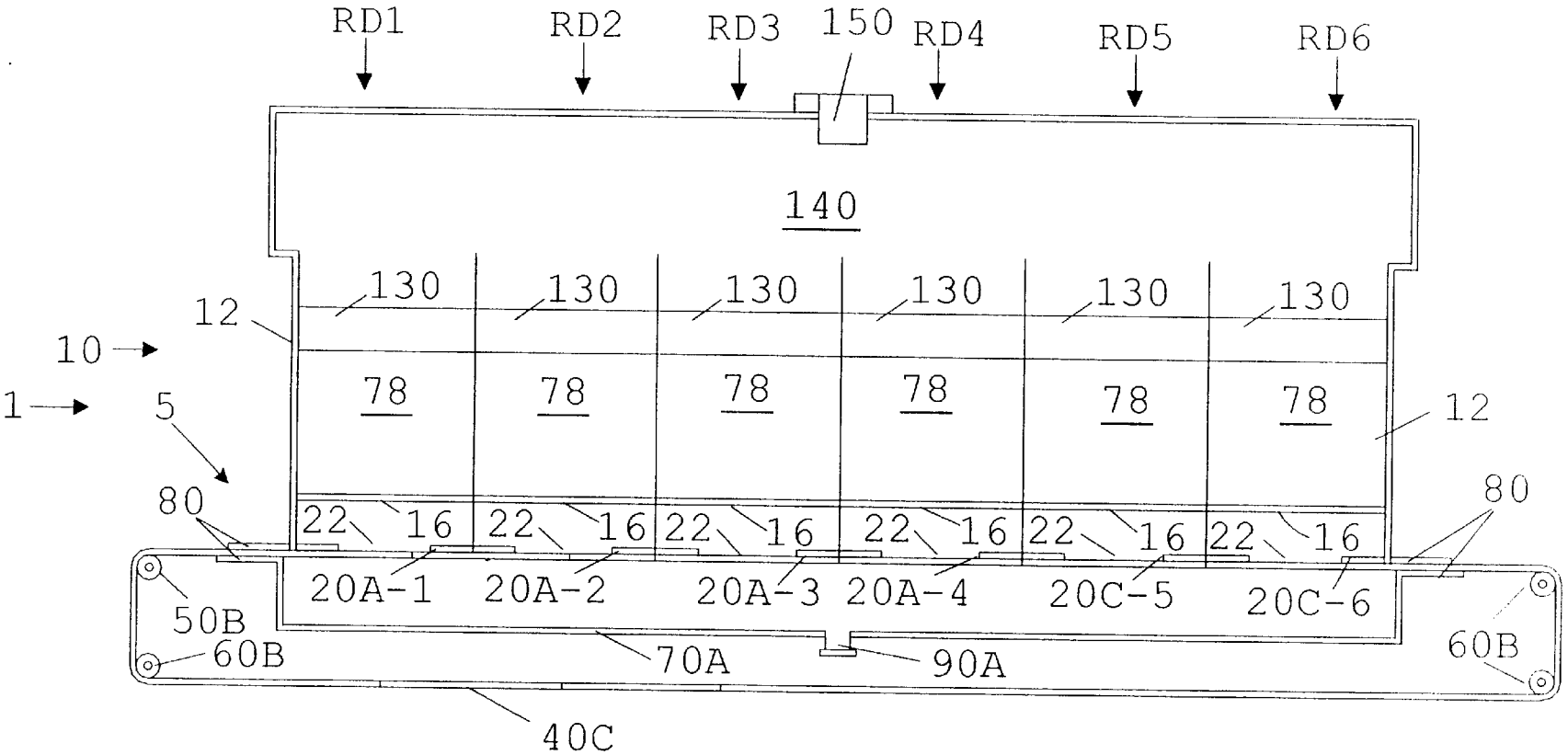

FIG. 25 is a sectional elevational representation showing a simplified embodiment of the regenerative system according to the present invention which uses one Multi-Port Valve Assembly on the first end of the regenerative devices and which is adapted to the flow of three process fluids into six regenerative devices, and which has a common combustion chamber in fluid communication with the second ends of the regenerative device and which further incorporates a catalyst for use as a Regenerative Catalytic Oxidizer.

Figure 26A:
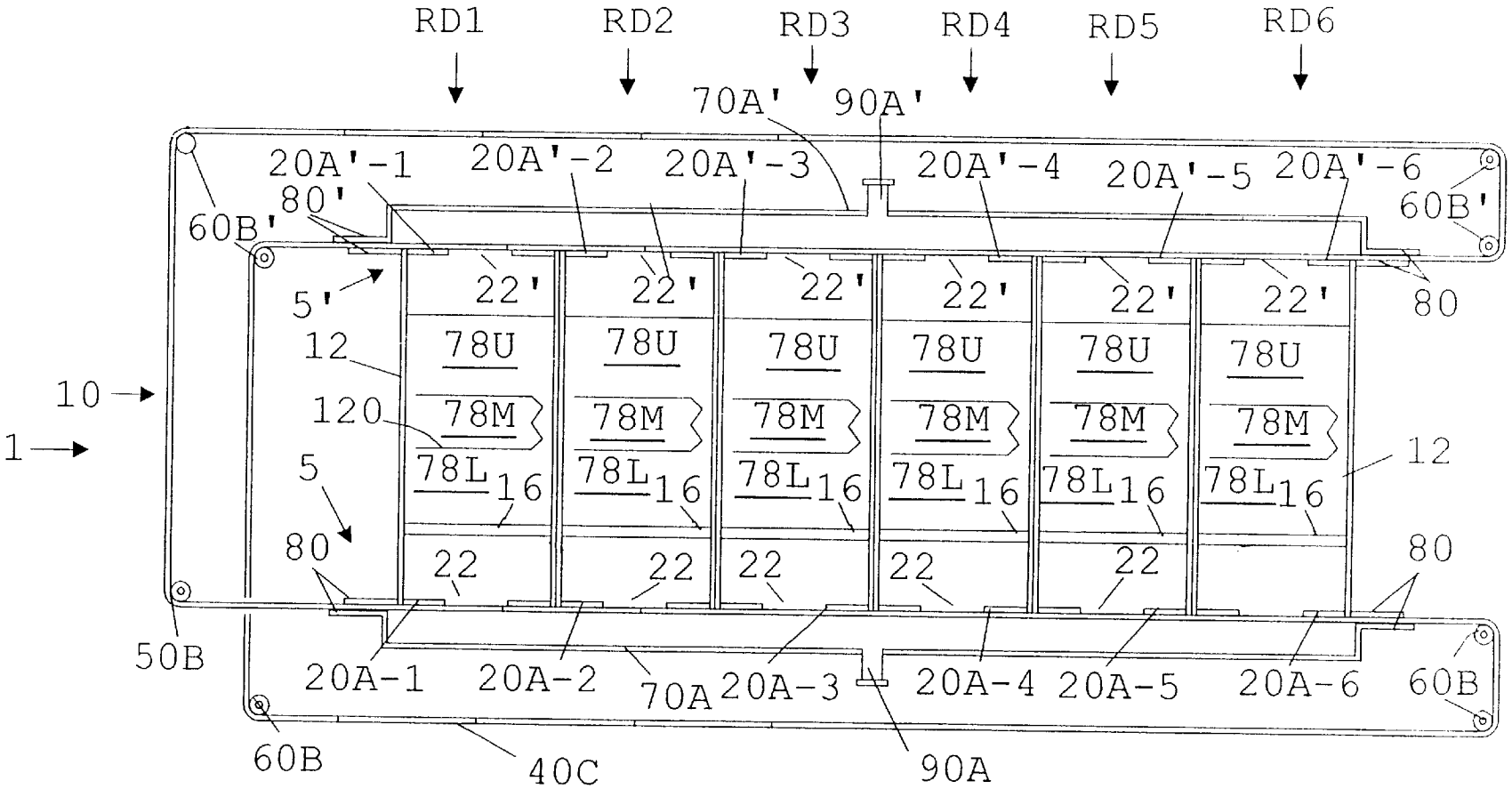

FIG. 26A is a sectional elevational representation showing a simplified embodiment of the regenerative system according to the present invention which uses two Multi-Port Valve Assemblies with one common endless flexible belt on the first and second ends of the regenerative devices and which is adapted to the flow of three process fluids into six regenerative devices, and which is adapted for use as a Regenerative Thermal Oxidizer.

Figure 26B:
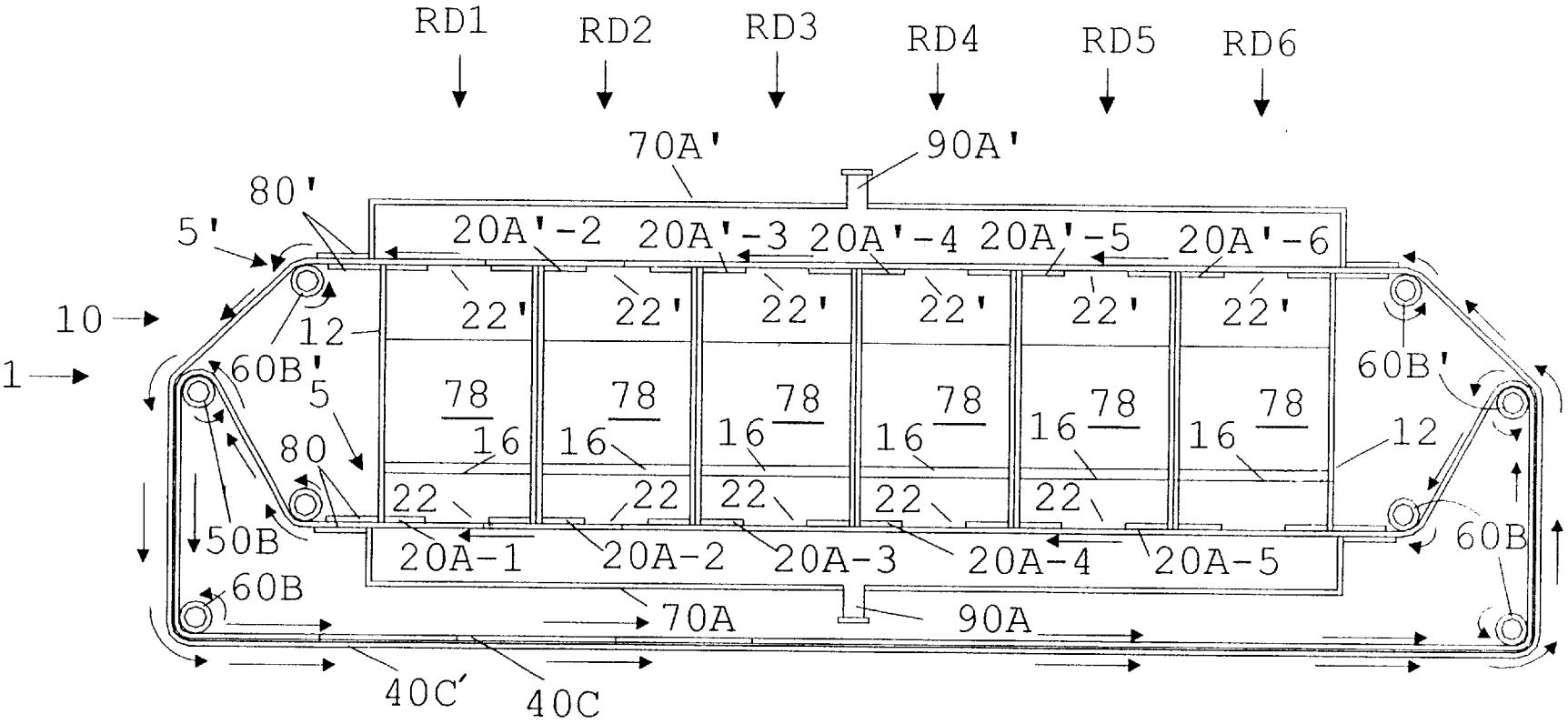

FIG. 26B is a sectional elevational representation showing a simplified embodiment of the regenerative system according to the present invention which uses two Multi-Port Valve Assemblies with a common drive mechanism for the two endless flexible belts and which is adapted to the flow of three process fluids into six regenerative devices, and which is adapted for use as a Regenerative Heat Exchanger.

Figure 27:
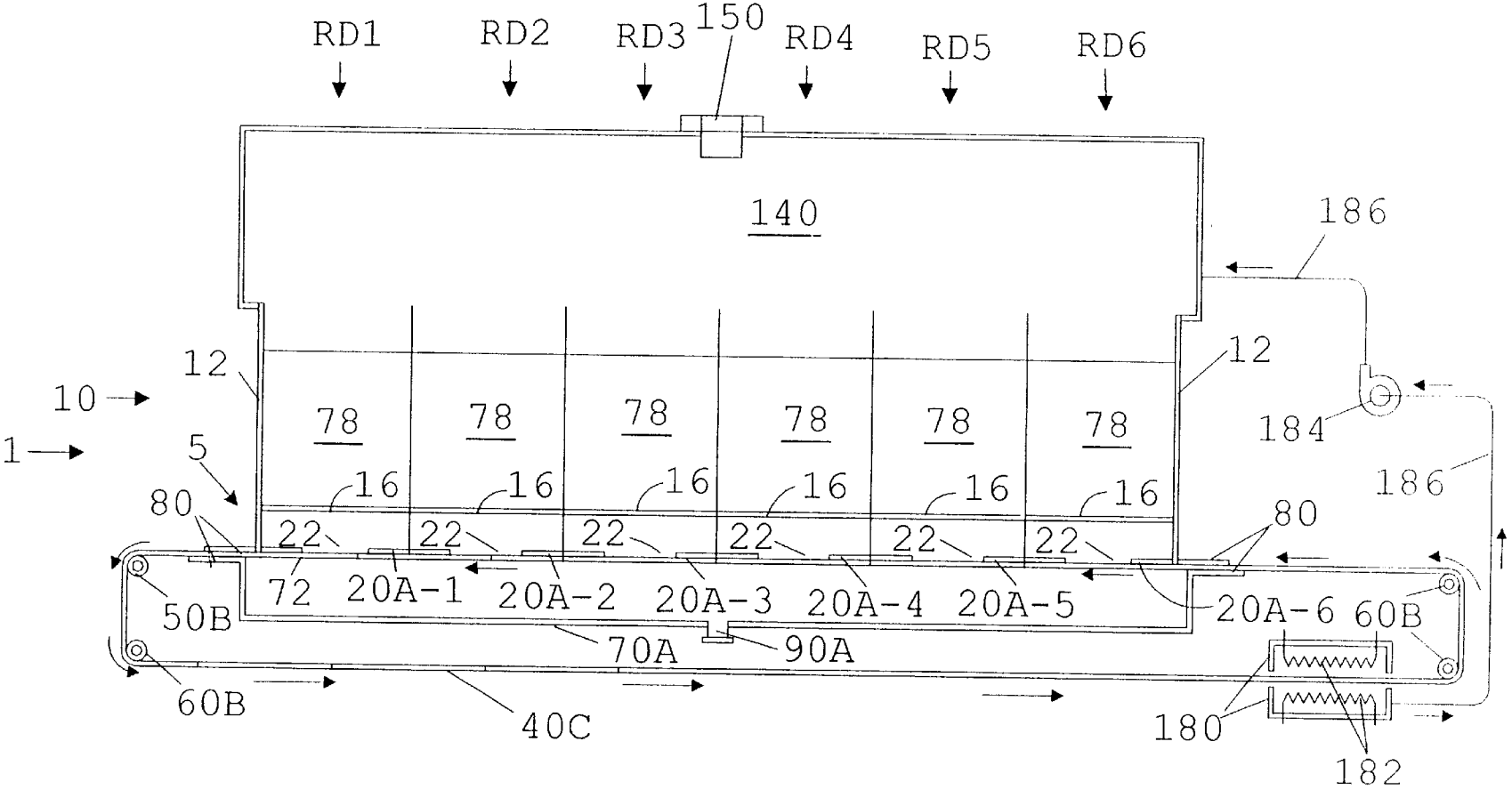

FIG. 27 is a sectional elevational representation showing a simplified embodiment of the regenerative system of FIG. 24A further incorporating a clean-out chamber which utilizes thermal bake-off for continuous on-line cleaning of the flow-control means used in the Multi-Port Valve Assembly.

Figure 28A:
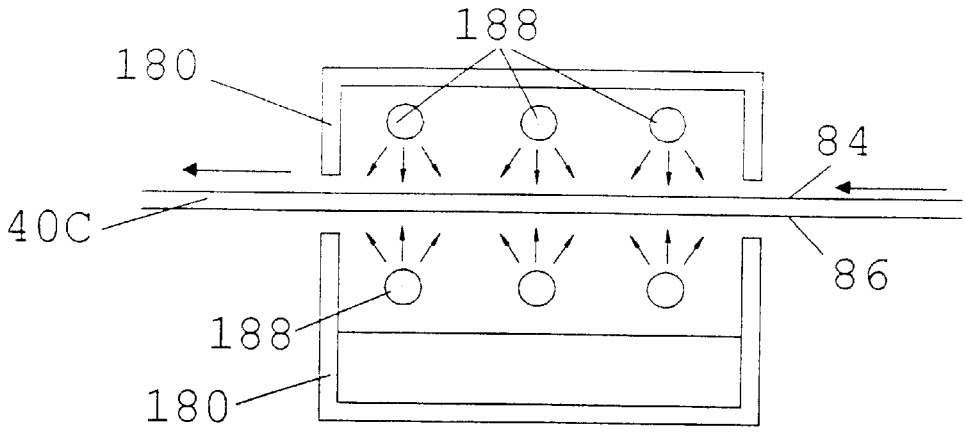

FIG. 28A is a sectional elevational representation of another embodiment of the clean out chamber of FIG. 27 which utilizes pressurized cleaning fluids or solids for continuous on-line cleaning of the flow-control means used in the Multi-Port Valve Assembly.

Figure 28B:
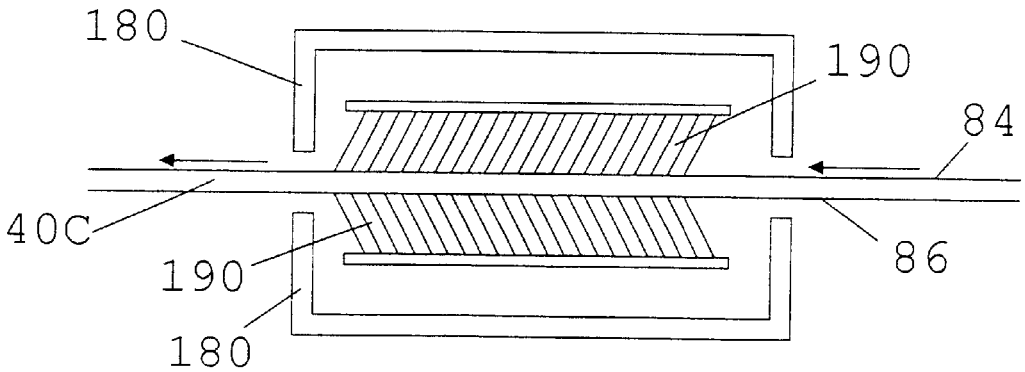

FIG. 28B is a sectional elevational representation of another embodiment of the clean out chamber of FIG. 27 which utilizes stationary cleaning brushes for continuous on-line cleaning of the flow-control means used in the Multi-Port Valve Assembly.

Figure 28C:
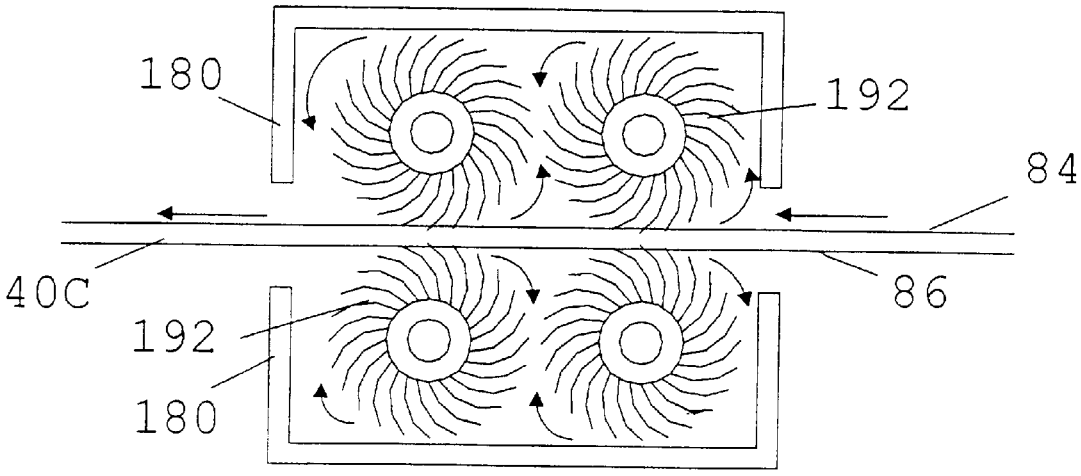

FIG. 28C is a sectional elevational representation of another embodiment of the clean out chamber of FIG. 27 which utilizes rotating cleaning brushes for continuous on-line cleaning of the flow-control means used in the Multi-Port Valve Assembly.

REFERENCES IN DRAWINGS

1 - regenerative system according to the present invention
5 - first Multi-Port-Valve Assembly
5' - second Multi-Port Valve Assembly on a RD3 - regenerative device 3
RD1 - regenerative device "i"
12 - regenerative material container
14 - regenerative material in 12
16 - regenerative material support means
13 - vertical walls of 12
15 - bottom end of 12
17 - top end of 12
18 - flow passage port in 15
19 - flow passage port in 17
20 - set of fluid communication means
20A - fluid communication means for fluid A at first end of regenerative device
20B - fluid communication means for fluid B at first end of regenerative device
20C - fluid communication means for fluid C at first end of regenerative device
20A' - fluid communication means for fluid A at second end of regenerative device
20B' - fluid communication means for fluid B at second end of regenerative device
20C' - fluid communication means for fluid C at second end of regenerative device
21 - embodiment of 20 configured as a flat plate
22 - fluid flow passage on 20
23 - embodiment of 20 configured as a spool piece
25 - first end of fluid communication means members in set of fluid communication
40C- embodiment of 40 configured as a flexible, endless-belt in first Multi-Port Valve Assembly of regenerative system 1
40C' - embodiment of 40 configured as a flexible, endless-belt in second Multi-Port Valve Assembly of regenerative system 1
40C" - embodiment of 40 configured as a flexible, endless-belt which services both the first and the second Multi-Port Valve Assemblies of regenerative system 1
45 - set of fluid passage zones on 40
45A - sub-set of fluid passage zones 45 which pass fluid A
45B - sub-set of fluid passage zones 45 which pass fluid B
45C - sub-set of fluid passage zones 45 which pass fluid C
45A' - sub-set of fluid passage zones 45' on flow control means 40C' which pass fluid A
45B' - sub-set of fluid passage zones 45' which pass fluid B
45C' -sub-set of fluid passage zones 45' which pass fluid C
46C - circular fluid passage orifices in 45
46S - slotted fluid passage orifices in 45
48 - solid web portion adjacent to 45 on 40
48R - solid web portion at first extremity of 40A and 40B
48L- solid web portion at second extremity of 40A and 40B
62 - sprocket holes on 40
70 - set of process - fluid supply/removal plenums in Multi-Port Valve Assembly 5
70' - set of process-fluid supply/removal plenums in Multi-Port Valve Assembly 51
70A - process-fluid supply/removal plenum for fluid A in 70
70B - process-fluid supply/removal plenum for fluid B in 70
70C - process-fluid supply/removal plenum for fluid C in 70
70A' - process-fluid supply/removal plenum for fluid A in 70'
regenerative system
10 - set of regenerative devices
RD1 - regenerative device 1
RD2 - regenerative device 2
means 20
26 - gap between stationary parts and flow control means 40 in Multi-Port Valve Assembly 5
26' - gap between stationary parts and flow control means 40 in Multi-Port Valve Assembly 5'
27 - second end of 20
28 - flat surface of 20 adjacent to top surface 84 of flow control means 40
29 - internal flange on 23
30 - external flange on fluid communication means
32 - inverted channel type labyrinth seal member on 20
35 - fluid expansion zone in 32
36 - contact seal element in 32
37 - spring mechanism to bias contact seal element 36 against moving surface of flow control means
38 - fluid connector on channel 32 for sealing air/fugitive fluid vacuum connection on seal
39 - pressurized zone within labyrinth channel 32
40 - movable flow-control member
40A - embodiment of 40 configured as a rigid, flat plate
40B - embodiment of 40 configured as a flexible, open-ended belt
50 - drive system for flow control means 40 in Multi-port Valve Assembly 5
50' - drive system for flow control means 40' in Multi-port Valve Assembly 5'
50A - reciprocating active drive mechanism for flow control means 40 in Multi-port Valve Assembly 5
50B - uni-directional active drive mechanism for flow control means 40 in Multi-port Valve Assembly 5
50B' - uni-directional active drive mechanism for flow control means 40' in Multi-port Valve Assembly 5'
50B" - common uni-directional active drive mechanism for flow control means 40 and 40' in Multi-port Valve Assemblies 5 and 5'
51 - seals
51L - longitudinal seals
51T - traverse seals
54 - wiper blade element in seal 51
56 - holding mechanism for 54
58 - spacer between wiper blades 54
60 - idle drive mechanism for flow control means 40
60A - idle drive mechanism for flow control means 40A
60B - idle drive mechanism for flow control means 40C
60B' - idle drive mechanism for flow control means 40C'
82 - fluid opening 72 containing surface of 70 adjacent to bottom surface of 40
84 - top surface of 40
86 - bottom surface of 40
88 - fluid opening 22 containing surface of fluid communication means 20
90 - fluid supply/removal conduit on 70
90A - fluid supply/removal conduit for fluid A on fluid plenum 70A
90B - fluid supply/removal conduit for fluid B on fluid plenum 70B
90C - fluid supply/removal conduit for fluid C on fluid plenum 70C -continued 70B' - process-fluid supply/removal plenum for fluid B in 70'
70C' - process-fluid supply/removal plenum for fluid C in 70'
72 - fluid supply/removal openings on 70
74 - top closure plate on 70
76 - vertical wall in 70
78 - regenerative heat-sink material bed
78U - upper section of regenerative heat-sink material bed
78M - middle section of regenerative heat-sink material bed
78L - lower section of regenerative heat-sink material bed
80 - optional fluid leak control lips on fluid supply/removal plenum and fluid communication means
150 - energy transfer device in common combustion chamber
160 - drive motor for 50
172 - regenerative adsorption material
174 - chemically reversible material
180 - clean-out chamber
182 - heating device in 180
184 - clean-out chamber emission capture and recycle fan
186 - recycle duct loop
188 - cleaning medium
190 - stationary cleaning brushes
192 - rotating cleaning brushes
400S - stainless steel layer in composite flow
90A' - fluid supply/removal conduit for fluid A on fluid plenum 70A'
90B' - fluid supply/removal conduit for fluid B on fluid plenum 70B'
90C' - fluid supply/removal conduit for fluid C on fluid plenum 70C'
92 - closed end of duct shaped fluid plenum
100 - winding spool drums for flow control means 40B
110 - take-up wells for flow control means 40B
120 - heating element in regenerative device
122 - temperature regulating device in regenerative device
130 - catalyst in regenerative device
140 - common combustion chamber in oxidizer
control means 40
400F - filter media material layer in composite flow control means 40
400T - Teflon layer in composite flow control means 40
WP - width of fluid passage area in flow control means 40
WL - length of fluid passage area in flow control means 40
WS - width solid portion of flow control means 40

DETAILED DESCRIPTION

The regenerative system according to the present invention consists of a regenerative section and a Multi-Port Valve Assembly section. The regenerative section consists of a set of regenerative devices. The Multi-Port Valve Assembly consists of a set of fluid plenums for the supply or removal of the process fluids from the regenerative system, a set of fluid communication means for passing individual process fluids to and from each of the regenerative devices, a flow control means for directing individual process fluids to and from the regenerative devices, and a drive means for moving the flow control means between the set of fluid plenums and the set of fluid communication means. Further description of the regenerative system is given below with reference to the above-listed drawings which describe various components and embodiments of the regenerative system. For simplicity, parts which have similar functions in the various embodiments of the regenerative system and its major components are identically numbered in these drawings.

Figure 1:
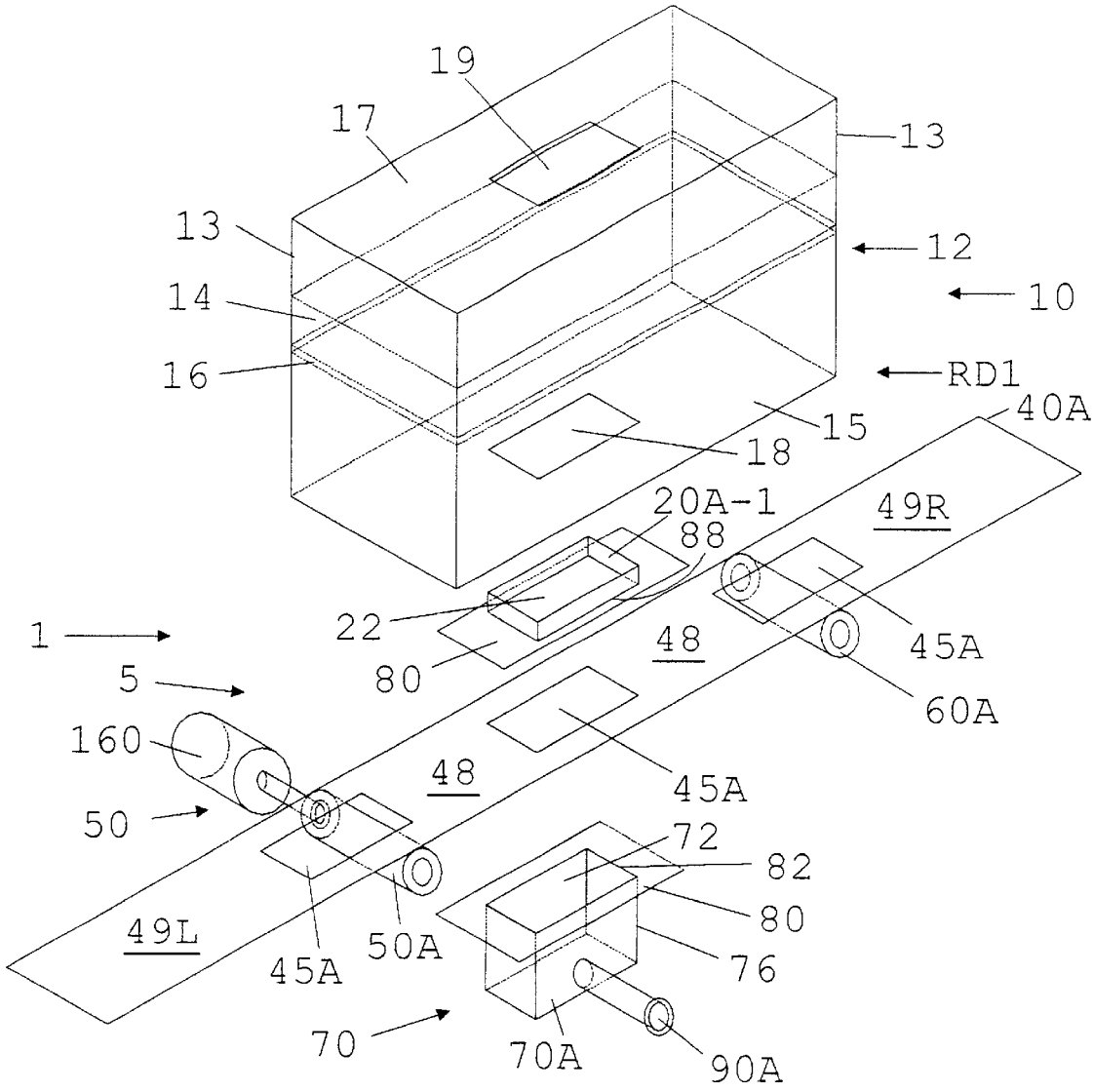
FIG. 1 is an exploded perspective representation showing a simplified embodiment of the regenerative system containing a single regenerative device and which uses a rigid flow control means according to the present invention.
Figure 2:
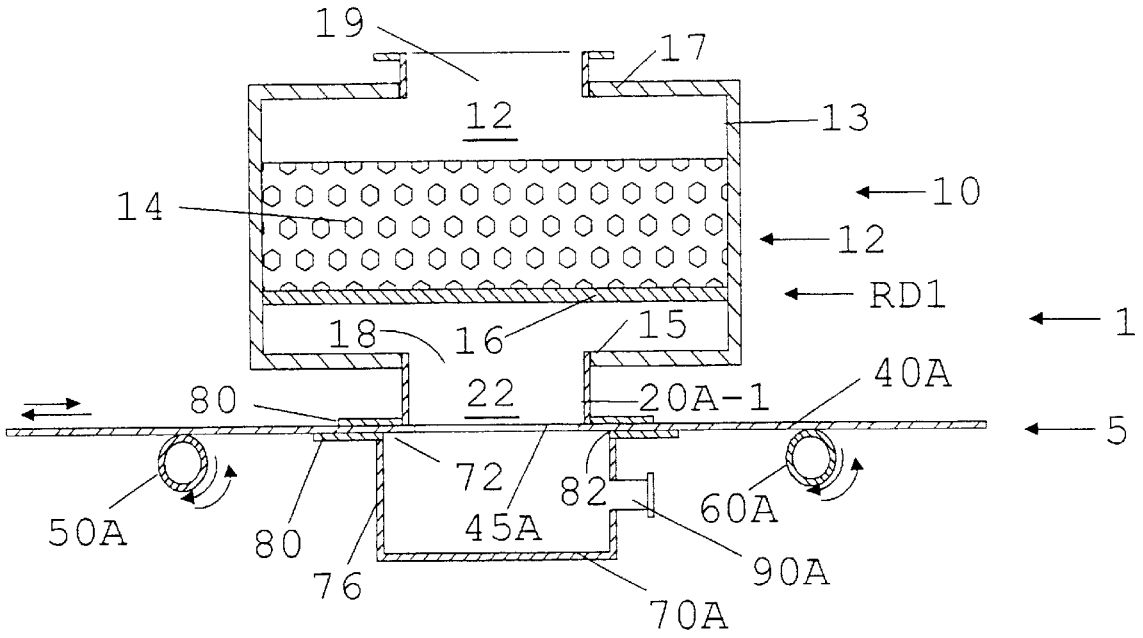
FIG. 2 is a sectional elevational representation of the regenerative system of FIG. 1.

FIGS. 1 and 2 show a simple embodiment of the present invention incorporated in a regenerative system 1 for processing a single process fluid, designated herein as process fluid A. As described above, regenerative system 1 has a regenerative section 10 which includes a set of regenerative devices which are designated herein as RDi where "i" is an integer which denotes the number of the regenerative device. In FIG. 1, the set of regenerative devices in regenerative section 10 consists of a single regenerative device RD1 only; however, as will be described in future sections of this description, there can be any number of regenerative devices in the set of regenerative devices 10. Regenerative device RD1 includes a regenerative media container 12, however, it may also include other components. As shown in FIGS. 1 and 2, regenerative media container 12 is a box-like container which has vertical walls 13, a bottom end 15, and a top end 17. Bottom end 15 has a fluid passage port 18 for flow of process fluid A into or out of regenerative media container 12. Top end 17 also has a fluid passage port 19 for flow of process fluid A into or out of regenerative media container 12. Regenerative material 14 which is supported on regenerative media support means 16 is located within regenerative media container 12 in the flow path between bottom fluid passage port 18 and top fluid passage port 19. Regenerative material 14 is located for contact with process fluid A during the operation of regenerative system 1. While a box-shaped regenerative media container 12 is shown in figures, regenerative media container 12 can have any shape. For example, it can be cylindrical or it can even have an U-configuration wherein the first ends and second ends are the extremities of the U-configuration. As another example, regenerative media container 12 can be configured as a duct wherein the cross-sectional area of fluid passage ports 15 and 18 is equal to the cross-sectional area of regenerative media container 12. Furthermore, while FIGS. 1 and 2 depict regenerative media container 12 as a flow through type of device wherein the process fluid A can flow between the bottom and top process fluid passage ports, regenerative media container 12 can also be a closed container which only has a fluid passage port at its bottom end and is closed at the top end. For example, regenerative media container 12 can be a closed tank with a single fluid passage port 18.

Regenerative media support means 16 can be a metallic or a non-metallic grating. Alternately, it can be standard media support beams such as those available from manufacturers such as Norton Process Industries. Detailed discussion of media support beams is provided in U.S. Pat. No. 5,149,259 to Greco and U.S. Pat. No. 5,770,165 to Truppi et al.

As used herein, the term "regenerative device" includes all devices which contain regenerative materials arranged for contact with a process fluid. As used herein, the term "regenerative materials" includes all materials which can assume a first operating state and a second operating state by the imposition of external influences. The two operating states may be thermodynamic, physical, or chemical states.

There may also be intermediate operating states between the two operating states. For example, regenerative materials can be heat-sink materials which can transfer and store heat upon contact with a hot fluid and release the stored fluid upon contact with a cold fluid. The first operating state is an initial cold state of the operating cycle and the second operating state is the final hot state of the operating cycle. The heat-sink material goes through intermediate hot and cold states between the two operating states. In this case, the external influences are the hot and cold fluids which cause a thermodynamic change in the regenerative materials.

Alternatively, regenerative materials can be any material which is capable of adsorbing or desorbing a chemical species upon change of thermodynamic operating conditions such as temperature, pressure, or concentration. For example, a regenerative adsorption material adsorbs or desorps a chemical species from a gas-mixture upon change in operating temperature or pressure or concentration of the gas-mixture in contact with the regenerative adsorption material. The first operating state is an initial "un-loaded" state of the operating cycle wherein the regenerative material is relatively free of VOCs. The second operating state is the final "loaded" state of the operating cycle wherein VOCs are adsorbed on the material. The adsorption material goes through intermediate "loaded" states between the two operating states. In this case, the external influences are the higher VOC-concentration adsorbing fluids and the relatively VOC-free desorbing fluids which cause an adsorption related thermodynamic change in the regenerative materials. Alternatively, a higher pressure adsorbing fluid and a lower pressure desorbing fluid could be the external influences. Yet alternatively, a lower temperature adsorbing fluid and a higher temperature desorbing fluid could be the external influences.

As yet another alternative, regenerative materials can also include materials which change their properties in a chemical reaction but which can be reverted back to their initial state by at least one subsequent chemical reaction. An example of a chemically regenerative material is copper oxide which changes its state to copper sulfate under a first set of operating conditions and is later re-converted back to copper oxide under a second set of operating conditions. In this example, the copper oxide represents the first operating state of the regenerative material and the copper sulfate represents the second state of the regenerative material. Again, there may or may not be intermediate reactions between the first operating state and the second operating state. In this case, the external influences are the chemical reactions which change the state of the regenerative material.

Examples of regenerative heat-sink media include structured and random packing made of metallic or non-metallic substances. Structured heat transfer media include stacked brick, stacked tubes, extruded monolith blocks with fluid flow passages such as those sold by Corning Inc., or assembled monolith blocks with fluid flow passages such as the MLM (TM) blocks manufactured by Lantec Inc., or blocks assembled from corrugated plates such as the Flexaramic (TM) blocks manufactured by Koch Industries. Random packing includes balls, randomly dumped rods, intallox saddles, berl saddles, raschig rings, etc. such as sold by Norton Process Industries. The regenerative heat-sink media can be made of metallic substances such as aluminum, steel, stainless steel, iron, etc., or of non-metallic substances such as ceramic refractory, porcelain, stoneware, feolite, iron-oxide, etc. The regenerative heat-sink material can also include liquids and phase-change capable solids such as molten salts which store heat energy in the form of latent heat of fusion or vaporization. Such materials can be stored within open or sealed metallic or non-metallic tubes which are placed in the path of flow of the process fluids. Alternately, the fluid can pass inside the tubes and the heat-sink materials can be located for heat-transfer outside the tubes similar to a shell-and-tube heat exchanger arrangement. Alternately, randomly or regularly packed vessels or jelly-bean like nodules which contain cores of phase-change-capable liquids or solids such as molten salts can also be used as regenerative heat-transfer material. Such materials will be capable of high amounts of heat-storage because heat can be stored at a constant temperature as latent heat of fusion or vaporization rather than as sensible heat only.

Examples of regenerative adsorption media include granulated activated carbon (GAC) such as that manufactured by Calgon Corporation or zeolites such as those manufactured by Munters Corporation or desiccant material such as Silica Gel. The regenerative adsorption materials can be installed in the regenerative device either as granular material or as material coated on suitable carrier substrates such as alumina. The substrate can be in the form of random particles on which the active zeolite is coated. Alternatively, it can be in the form of structured elements such as corrugated paper blocks on which the activated carbon is coated. Such activated carbon coated blocks are manufactured by Daikin, Japan. Yet alternatively the corrugated paper blocks described above can be coated with activated zeolite. Such zeolite coated blocks are manufactured by Munters Corp., and Seibu-Geiken, Japan. The corrugated active adsorbent material coated paper can be either made into oblong blocks which are stacked to form a bed of regenerative adsorption materials or they can be wound around a central core to form wheels which can be placed in the path of a process fluid flowing in a duct. Such blocks and rotors are readily available from the above manufacturers.

Example of chemically reversible materials include copper oxide used for the reduction of sulfur-dioxide and oxides of nitrogen from flue-gases. The copper oxide is supported on an alumina or other suitable substrate which can be configured in the shape of spheres, rods, or other suitable forms. A detailed description of a regenerative copper oxide process for the reduction of sulfur-dioxide and oxides of nitrogen from flue-gases is described by Chen and Yeh in an article in Environmental Progress, Volume 17, No. 2 (Summer 1998), Pages 61–69.

Regenerative materials can also include those that need an external energy source to bring them to an activated state for adsorption, catalysis, or chemical reaction. Examples of external energy sources include microwaves, visible light energy, IR light, UV light, magnetic fields, irradiation by alpha, beta, gamma or other radio-activity induced beams, electron beams, proton beams, etc. An example of such a material is Titanium Oxide which when exposed to UV light assumes an activated state and reverts back to its normal un-activated state upon removal of the UV light source.

Each of the class of regenerative materials described above can be used alone or in combination with each other. For example, the regenerative material 14 used in regenerative system 1 of FIG. 1 can include heat-storage materials and adsorption materials. Alternatively, it can include heat-storage materials, adsorption materials, and chemically reversible materials. Yet, alternatively, it can include adsorption materials and chemically reversible materials. The different regenerative materials can be arranged in discrete layers or zones or can be randomly mixed or homogeneously mixed together to form a single layer or bed of regenerative material 14.

The construction of regenerative media container 12 and regenerative material support 16 for supporting regenerative material 14 therein can follow standard design criteria of the specific regenerative system's industry standards. Thus if regenerative system 1 is a regenerative heat-exchanger, container 12 will generally be a duct made of carbon-steel which is internally insulated with ceramic or other suitable refractory. Alternatively, if regenerative system 1 is a regenerative adsorption system, container 12 will generally be an insulated or un-insulated (depending on temperature of process fluid A) duct made of carbon-steel. As another alternate, if regenerative system 1 is a chemical reactor, container 12 may be made of an exotic metal or metal-alloy which may be internally lined with a corrosion resistant lining and which may further be lined with an acid-resistant refractory lining. Such construction methods and techniques are well-known to persons having ordinary skill in the art pertaining to the type of regenerative system being considered.

As described herein, a Multi-Port Valve Assembly is used to direct the flow of process fluid A into regenerative device RD1. As used herein, a Multi-Port Valve Assembly is a mechanism for diverting one or more process fluids into or out of one or more sources or destinations. The Multi-Port Valve Assembly includes a set of fluid plenums for directing the one or more process fluids into or out of the Multi-Port Valve Assembly system. The Multi-Port Valve Assembly further includes a set of fluid communication means which can be connected to the sources or destinations of the process fluid. The fluid communication means can be separate from or can be integral with the regenerative media containers. The set of fluid communication means are further divided into sub-sets. Each sub-set of fluid communication means is aligned with a particular fluid plenum in the set of fluid plenums so that each sub-set of fluid communication means only allows the selected process fluid to flow from or to a source or destination of the selected process fluid. The Multi-Port Valve Assembly also includes a movable flow control means which is movably interposed between the set of fluid plenums and the set of fluid communication means. The flow control means is a planar member with a set of flow passage zones. The set of flow passage zones is further divided into sub-sets according to the process fluid being allowed to pass through the zones. Each sub-set of the flow passage zones on the flow control means is aligned with the fluid plenum which is dedicated to the process fluid whose flow is controlled by the flow passage zones in the subset. Each of the flow passage zone in each sub-set is also located at a predetermined position to enable its assigned process fluid to pass through the fluid communication means assigned to that process fluid into each of the regenerative devices in the set of regenerative devices when the flow control means is moved between the set of fluid plenums and the set of fluid communication means. The sub-set of flow passage zones for a process fluid is further made up of secondary sub-sets of flow passage zones. Each secondary subset of flow passage zones includes a number of fluid passage zones located adjacent to each other for the passage of the process fluid through the regenerative material. The number of flow passage zones in the secondary subset is determined by the number of contact periods (defined below) that the process fluid is required to contact the regenerative material. A continuous sequence of the secondary sub-sets of the fluid passage zones associated with each fluid forms an operating cycle for the regenerative system. The flow control means is configured to have more than one operating cycle on it. The flow control means can be a rigid planar member or a flexible planar member. The planar member can be a square or rectangular plate or a open-belt or an endless belt as will be described later in this description. The flow control means can also be moved reciprocatingly between two extreme positions or endlessly in a single direction.

As an example of a Multi-Port Valve Assembly, assume that three process fluids, A, B, and C are required to flow into six regenerative devices designated as RD1 to RD6. It is required that the process fluid A contact the regenerative material in the regenerative device for two contact periods followed by a contact period with process fluid C, followed by two contact periods with process fluid B, and finally followed by a contact period with process fluid C. As defined herein, a contact period is the period of time during which a process fluid contacts the regenerative material 14 in a regenerative device. Thus in the above example, the set of fluid plenums 70 would include fluid plenums designated as 70A, 70B, and 70C. Similarly, the set of fluid communication means 20 would include a subset of fluid communications means 20A which would include members 20A-i, where i=1 to 6 designates the number of the regenerative device into which process fluid A is directed by 20A-i. Similarly, the set of fluid communication means 20 would include a subset of fluid communications means 20B which would include members 20B-i, where i=1 to 6 designates the number of the regenerative device into which process fluid B is directed by 20B-i. Similarly, the set of fluid communication- means 20 would include a subset of fluid communications means 20C which would include members 20C-i, where i=1 to 6 designates the number of the regenerative device into which process fluid C is directed by 20C-i. The fluid control means 40 is a planar member which is movably interposed between fluid communication means 20A-i, 20B-i, and 20C-i and fluid plenums 70A, 70B, and 70C. Flow control means 40 would include a set of fluid passage zones 45 which in turn would include a sub-set of flow passage zones 45A for the passage of fluid A, a sub-set of flow passage zones 45B for the passage of fluid B, and a sub-set of flow passage zones 45C for the passage of fluid C. The subset of flow passage zones 45A would be further arranged in secondary subsets {45A, 45A} which are aligned with fluid plenum 70A and fluid communication means 20A-i. The subset of flow passage zones 45B would further be arranged in secondary subsets {45B, 45B} which are aligned with fluid plenum 70B and fluid communication means 20B-i. The subset of flow passage zones 45C would be further arranged in secondary subsets {45C} which are aligned with fluid plenum 70C and fluid communication means 20C-i. The sequence of the above secondary sub-sets {45A, 45A}, {45C}, {45B, 45B}, {45C} would provide the sequential flow of process fluids A, B C as described above through regenerative devices RD1 to RD6. This sequence is termed the operating cycle of the regenerative system.

Referring back to the simple embodiment of regenerative system 1 of FIGS. 1 and 2, Multi-Port Valve Assembly 5 includes a single-member set of fluid plenums 70 consisting only of fluid plenum 70A for the supply or removal of process fluid A to or from regenerative media container 12. Fluid plenum 70A is fitted with a fluid connector 90A for supply or removal of process fluid A to or from regenerative system 1. As shown in FIGS. 1 and 2, fluid plenum 70A is a square or rectangular cross-sectioned tub-like member having an open top end 72 through which process fluid A passes into or out of regenerative media container 12 through flow passage 18 and through flow control means 40A (to be described later). However, it can also have many different configurations. For example, as shown in the perspective representation of regenerative system 1 in FIG. 4B, fluid plenum 70A may also be a square or rectangular duct with an open end 90A and an opposite closed end 92. The duct has fluid passage openings 72 on its top surface 74. The number of fluid openings 72 is equal to the number of regenerative devices in regenerative system 1. Thus in the example shown in FIG. 4B, a duct plenum 70A with three fluid openings 72 is shown for passage of a process fluid to three regenerative devices. However, in the present embodiment of the regenerative system of FIG. 1, only one fluid opening 72 is required.

Figure 4A:
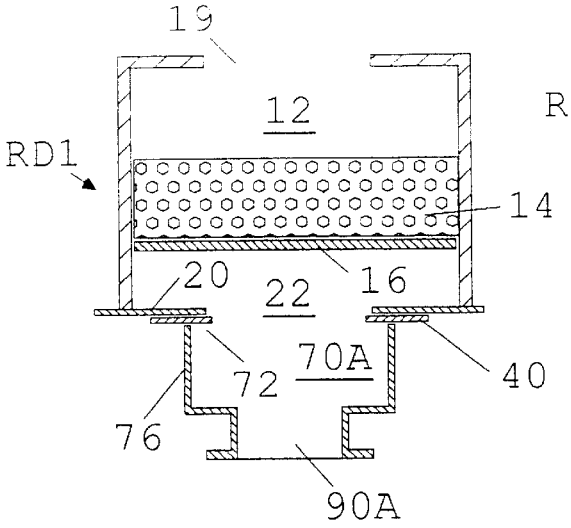
FIG. 4A is a sectional elevational representation of another embodiment of the regenerative system of FIG. 1.
Figure 4C:
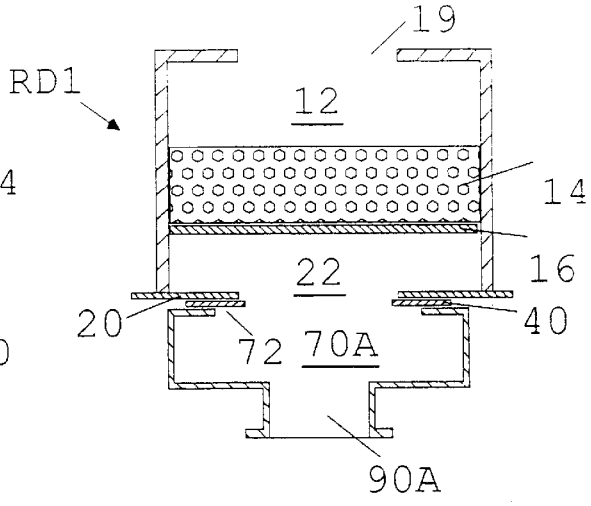
FIG. 4C is a sectional elevational representation of another embodiment of the regenerative system of FIG. 1.
Figure 4B:
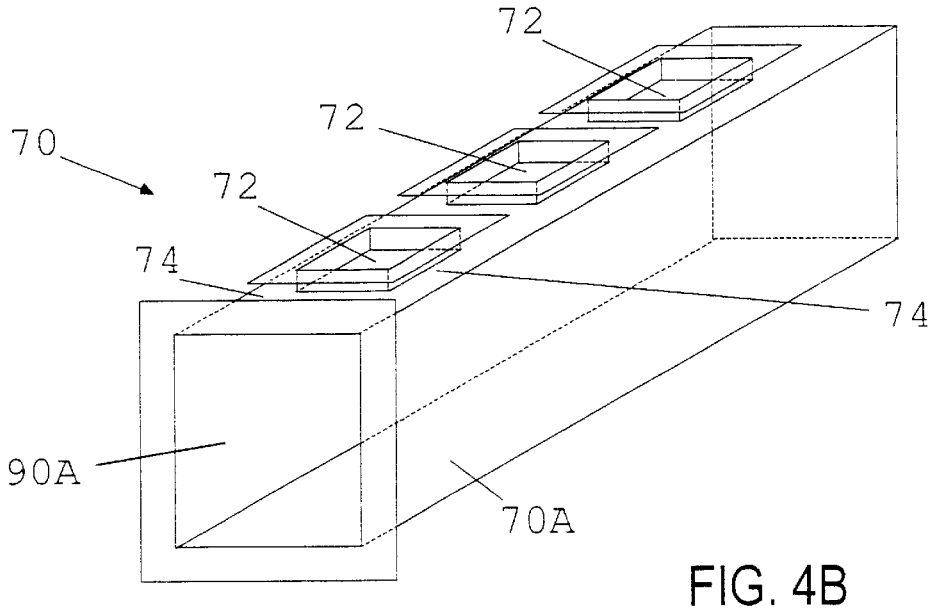
FIG. 4B is a perspective representation of an embodiment of the fluid plenum that can be used in the Multi-Port Valve Assembly of the regenerative system according to the present invention.
Figure 4D:
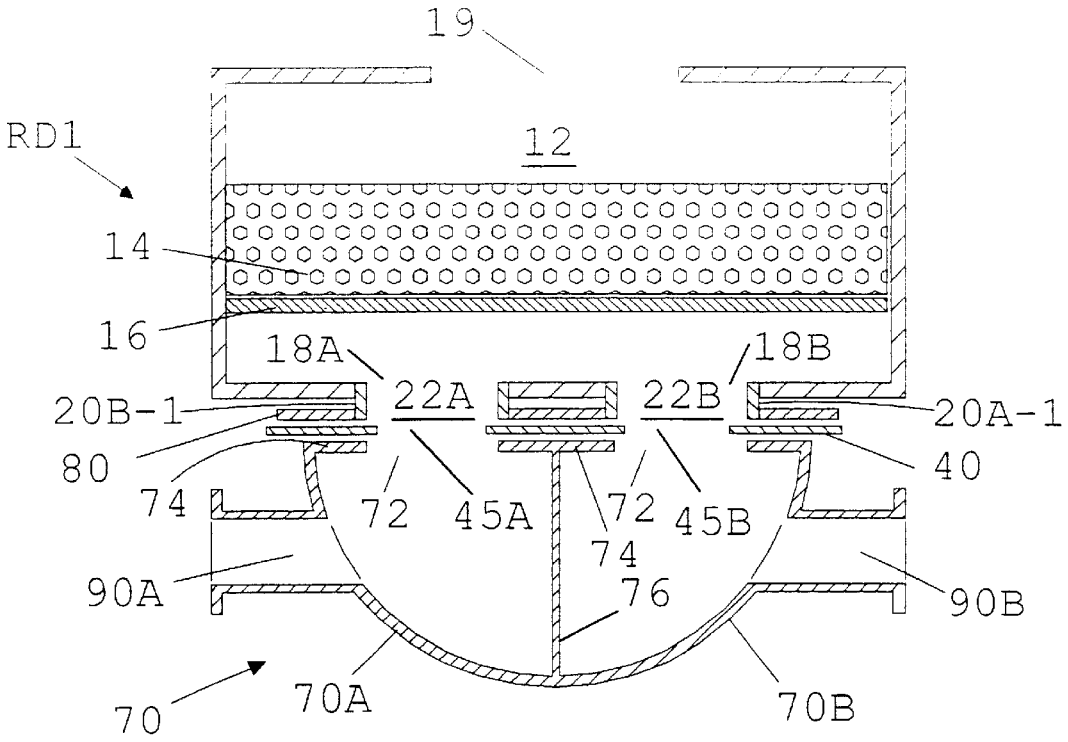
FIG. 4D is a sectional elevational representation of another embodiment of the regenerative system of FIG. 1 which shows a fluid plenum which is adapted for two process fluids.
Figure 4E:
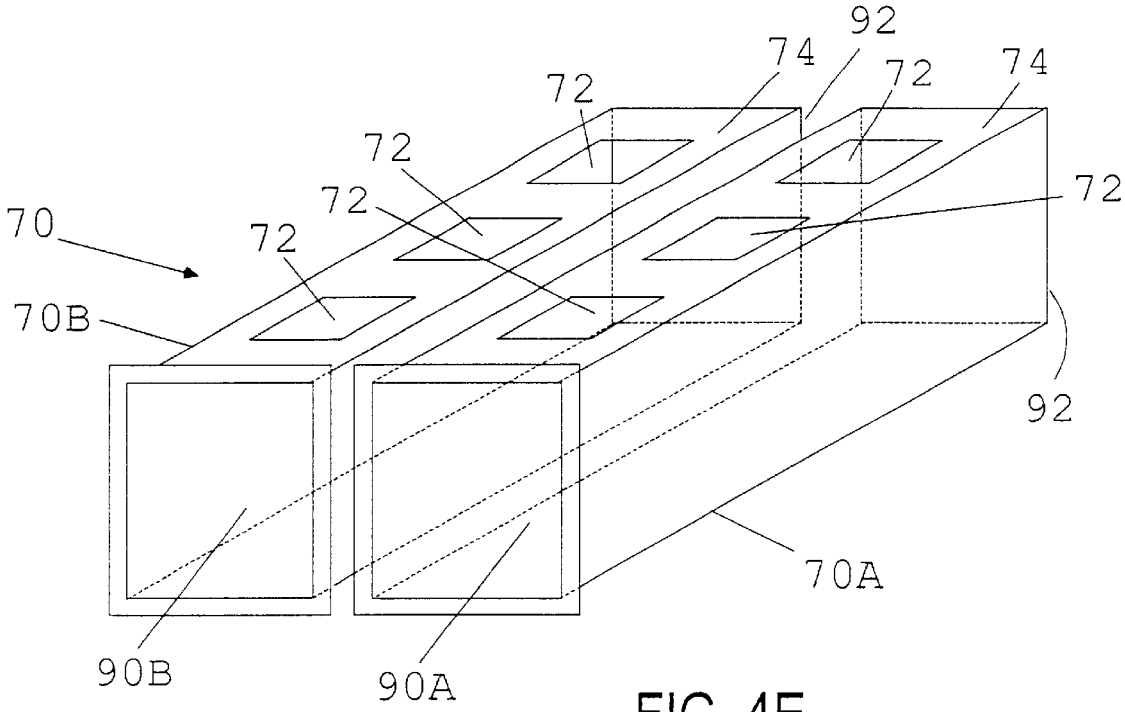
FIG. 4E is a perspective representation of an assembly of the fluid plenum shown in FIG. 4B which is adapted for two process fluids.

Alternately, as shown in FIG. 4D, fluid plenum 70 can be a semi-cylindrical cross-sectioned tub with a closed top-end 74 which has fluid passage openings 72. Since two process fluids are being processed, the number of fluid openings 72 are equal to twice the number of regenerative devices in regenerative system 1. Fluid plenum 70 has a common internal wall 76 which divides it into fluid plenum 70A for process fluid A and fluid plenum 70B for process fluid B respectively. Alternately, as shown in FIG. 4E for an alternate embodiment of fluid plenum 70 which is configured for two process fluids, fluid plenum 70 can be a plurality of individual rectangular cross-sectioned ducts of the type shown in FIG. 4B wherein fluid openings 72 are cut-outs in the top-surface 74 of the duct for directing a plurality of fluids into a plurality of regenerative devices. Other shapes and configurations of fluid plenum 70 will be readily apparent to one of ordinary skill in the art. For, example, the duct plenum 70A of FIG. 4B can be circular in cross-section. As an alternate example, the fluid plenum 70 of FIG. 4D can have a "V" cross-section.

As shown in FIGS. 1, and 2, fluid-leak control lips 80 are provided around fluid opening 72 on fluid plenum 70A to control the amount of process fluid A that can leak out of the system if process fluid A is under positive pressure or to control the amount of outside fluid that can leak into the system if process fluid A is under negative pressure. The sizes and configurations of the fluid-leak control lips 80 depends upon the potential leakage that needs to be controlled by the system designer. Fluid leak-control lips 80 can even be optional if the potential for leakage of fluid into or out of regenerative system 1 is negligible. They can even be eliminated if the width of fluid passage zones 45A or orifices (described later in FIGS. 3D and 3E) is less than the width of wall 13 of regenerative media container 12. In such a case, wall 13 of regenerative media container 12 can be made to function as a fluid leak-control lip by the addition of sealing mechanisms. Various sealing mechanisms can be used around the peripheries of fluid passage 72 and fluid leak control lips 80 to further restrict the flow of process fluid A or outside fluid into or out of the system. These sealing mechanisms are described in the subsequent sections of this disclosure.

Flow control means 40 comprises a non-porous web with a predetermined set of flow passage zones 45 for the control of the flow of the process fluids between the set of process fluid plenums 70 and the set of fluid communication means 20. As described previously, each member of the set of flow passage zone 45 further belongs to a sub-set corresponding to the fluid that it controls. For example, sub-set 45A of flow passage zones in set 45 controls the flow of process fluid A from fluid plenum 70A to individual regenerative devices in the set of regenerative devices. Similarly, subset 45B of flow passage zone set 45 controls the flow of process fluid B from fluid plenum 70B to individual regenerative devices in the set of regenerative devices. Similarly, subset 45C of flow passage zone set 45 controls the flow of process fluid C from fluid plenum 70C to individual regenerative devices in the set of regenerative devices.

Similarly, each fluid communication means member of the set of fluid communication means 20 further belongs to a sub-set corresponding to the fluid that it controls. For example, sub-set 20A of fluid communication means in set 20 allows process fluid A to flow from fluid plenum 70A to individual regenerative devices in the set of regenerative devices. Similarly, sub-set 20B of fluid communication means in set 20 allows process fluid B to flow from fluid plenum 70B to individual regenerative devices in the set of regenerative devices. Similarly, sub-set 20C of fluid communication means in set 20 allows process fluid C to flow from fluid plenum 70C to individual regenerative devices in the set of regenerative devices.

FIGS. 1 and 2 show a particular embodiment of flow control means 40 which is configured as a flat, rigid, rectangular plate designated as 40A and which can be made of metallic or non-metallic substances such as those described below. The dimensions of flow control means 40A are a function of the geometry of the regenerative devices and the size of the fluid passages 72 on fluid plenums 70. However, flow control means 40A is generally designed to be at least wider than the width of fluid passage 72. The length of flow control means 40A is determined by the dimensions of the flow passage zones, the number of flow passage zones and solid zones on it, and the lengths of end zones 48R and 48L (described below). The thickness of the flow control means 40A is determined by the type and the flexibility of the material used for flow control means 40A. In the case of rigid flow control means 40A, the thickness is selected so that flow control means 40A can be supported without excessive bowing between drive mechanism 50A and support mechanism 60A and the regenerative devices.

In FIGS. 1 and 2, flow control means 40A has a single sub-set of flow passage zones for the passage of process fluid A. These fluid passage zones are designated as 45A in FIGS. 1 and 2. They control the passage of fluid A between the process fluid plenum 70A and fluid communication means 20A (to be described later). As shown in the perspective representation of FIG. 1, flow control means 40A is movably sandwiched along its major axis between the fluid opening 72 containing surface 82 of fluid plenum 70A and the fluid opening 22 (described below) containing surface 88 of fluid communication means 20A (to be described below) of Multi-Port Valve Assembly 5.

Figure 3A:
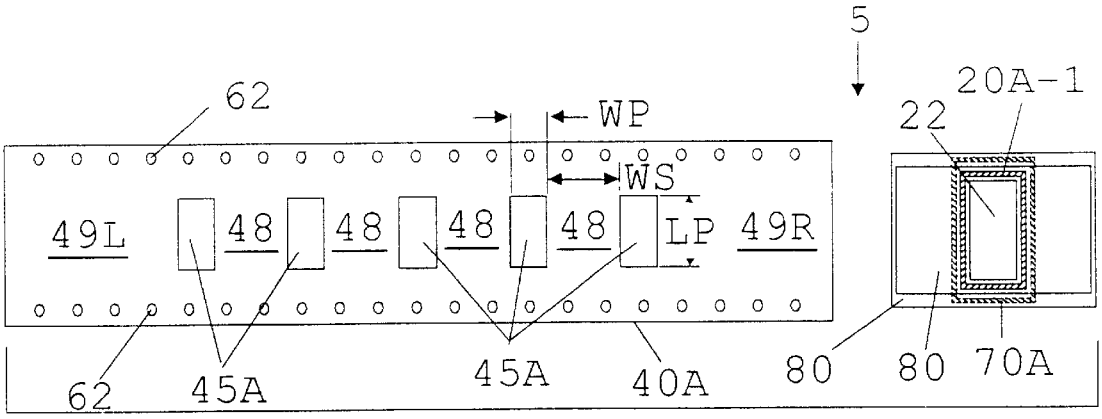
FIG. 3A is an dis-assembled plan representation of the Multi-Port Valve Assembly without the drive system used in the regenerative system of FIG. 1.

FIG. 3A is a plan representation of Multi-Port Valve Assembly 5 used in regenerative system 1 of FIG. 1. For clarity of explanation, FIG. 3A shows rigid flow control means 40A separated from the other components of Multi-Port Valve Assembly 5 and the drive system 50A (not shown). As can be seen in FIG. 3A, each flow passage zone 45A has a width WP and a length LP. Adjacent flow passage zones 45A are separated by solid zones 48 which has a width WS. The width dimension WP and the length dimension LP of flow passage zone (shown in FIG. 3D) is calculated from a requirement of area of flow required for the flow of process fluid A at a predetermined design velocity. Such calculations are well known to a person having ordinary skill in the art. Also it will be apparent that, dimensions WP and LP of 45A have to be at least equal but preferably less than the dimensions of opening 22 on fluid communication means 20A (to be described later) so that opening 22 can fully cover flow passage zone 45A when opening 22 overlaps flow passage zone 45A. Also it will be apparent that dimension LP of 45A have to be at least equal but preferably less than the width dimensions of opening 72 on fluid plenum 70A so that opening 72 can also fully cover flow passage zone 45A when opening 22 overlaps flow passage zone 45A. Further, it will also be apparent that in the embodiment of regenerative system 1 of FIG. 1, dimension WP has to be at least less than or equal to dimension WS so that the flow of the process fluid can be completely shut-off or to prevent cross-contamination of process fluids, if more than one fluid is passed through the regenerative system as will be described subsequently with respect to other embodiments of regenerative system 1.

Flow passage zone 45A can have a single large aperture or plurality of apertures to enable process fluid A to flow from fluid plenum 70A to fluid communication means 20A (to be described later) to regenerative media container 12. FIGS. 3D and 3E show some examples of the plurality of apertures that can be used in flow passage zone 45A.

FIG. 3D shows a plurality of circular apertures, 46C, contained within flow passage zone 45A for the flow of process fluid A from fluid plenum 70A to fluid communication means 20A (described later) to regenerative media container 12. FIG. 3E shows a plurality of slotted apertures, 46S contained within flow passage zone 45A for the flow of the process fluid A from fluid plenum 70A to fluid communication means 20A to regenerative media container 12. Other flow aperture shapes such as diamond, triangle, square, rectangular, oval, etc. can also be used based upon design and manufacturing considerations and will not change the functionality of flow control means 40A. The number and the dimensions of each flow aperture is determined from operating and design criteria for fluid flow velocities which will be apparent to one of ordinary skill in the art.

As shown in FIGS. 1 and 4A, 4C, and 4D, the width of rigid flow control means 40A is selected so that it extends beyond the outermost dimensions of fluid leak control lips 80. However, the width of rigid flow control means 40A can also be less than the outermost dimension of fluid leak control lips 80. In any event, it has to be greater than the dimensional width of fluid opening 72. If more than one fluid is present, then the width of flow control means 40A has to be greater than the outermost width edges of the two furthermost openings 72 as viewed along the cross-section of the system as shown in FIG. 4D.

Rigid flow control means 40A also has end-zones 48R and 48L on either end, the purpose of which will be described below.

Figure 5A:
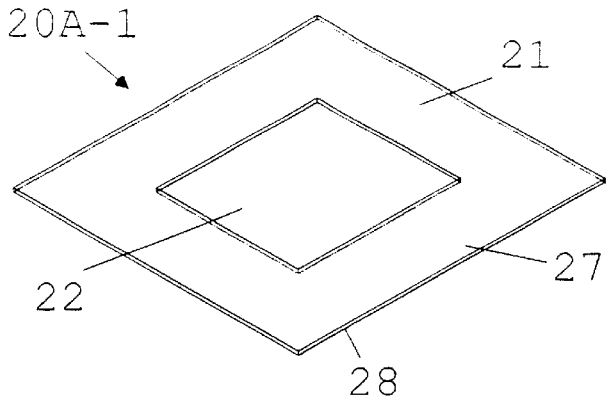
FIG. 5A is a perspective representation of an embodiment of the fluid communication means for passage of process fluid to and from a regenerative device in the regenerative system according to the present invention.
Figure 5B:
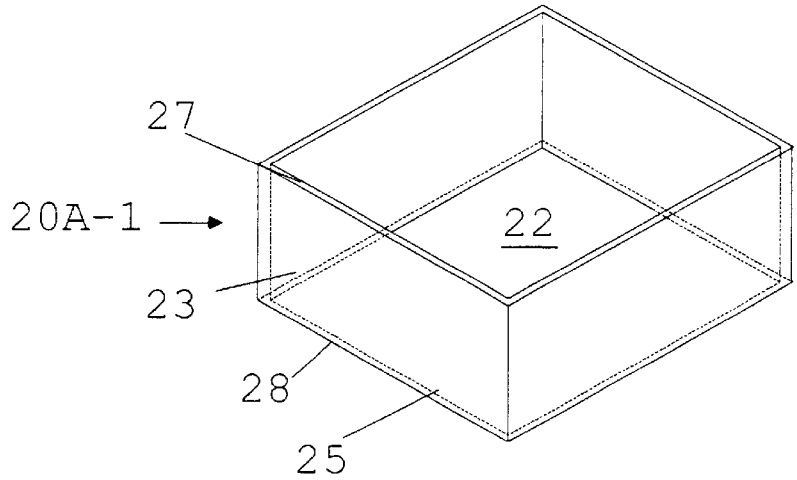
FIG. 5B is a perspective representation of another embodiment of the fluid communication means for passage of process fluid to and from a regenerative device in the regenerative system according to the present invention.
Figure 5C:
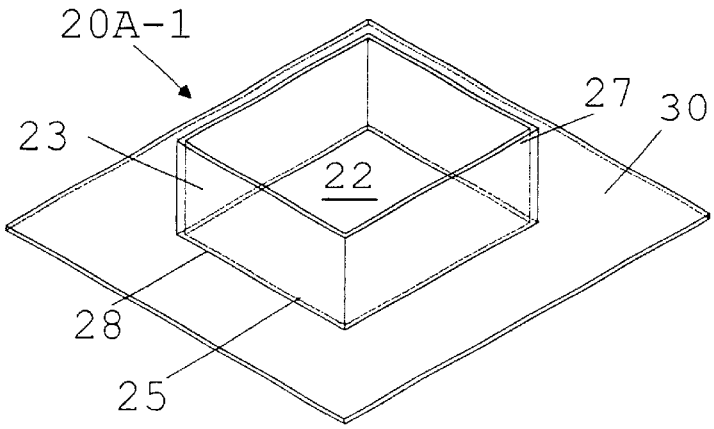
FIG. 5C is another perspective representation of another embodiment of the fluid communication means for passage of process fluid to and from a regenerative device in the regenerative system according to the present invention.

The embodiment of Multi-Port Valve Assembly 5 shown for regenerative system 1 in FIGS. 1 and 2 includes a set of fluid communication means 20. In FIGS. 1 and 2, the set is made up of one fluid communication means 20A for the passage of process fluid A from fluid plenum 70A to regenerative media container 12 through flow passage zone 45A on flow control means 40A. Some examples of different embodiments of fluid communication means 20A that can be used are shown in FIGS. 5A, 5B, 5C, and 5D. As shown in FIG. 5A, fluid communication means 20A may be a simple rigid plate 21 with an aperture or flow passage 22 for flow of the process fluid A between fluid plenum 70A (not shown) and regenerative media container 12 (not shown) of regenerative device RD1 through flow passage zone 45A on flow control means 40A (not shown). Plate 21 can be made so that it is integral with bottom 15 of regenerative media container 12. Alternately, as shown in FIG. 5B, fluid communication means 20A-1 may be a short spool piece 23 configured with a through fluid passage 22. Spool piece 23 has a first end 25 which is located adjacent to top surface 84 of flow control means 40 (not shown) and a second end 27 which is connected to fluid passage port 18 (not shown) of regenerative media container 12 (not shown). Spool piece 23 can be a separate member or it can be integral with regenerative media container 12 so that the lower edge portion of regenerative media container 12 functions as fluid communication means 20A-1. FIG. 5C shows another example of fluid communication means 20A-1 which is configured as a spool-piece 23, as described with respect to FIG. 5B, but which has an external flange 30 attached to end 25. In yet another alternate configuration, shown in FIG. 5D, spool piece 23 also includes an internal flange 29 on end 25 of spool piece 23 shown in FIG. 5B. Internal flange 29 and external flange 30 can be provided either on one end or both ends of spool-piece 23 shown in FIG. 5C. Internal flange 29 and external flange 30 can be fabricated in one piece as in the embodiment shown in FIG. 5D. Similarly, external flange 30 can be integral with flat plate 21 of FIG. 5A so that flat plate 21 functions both as fluid communication means 20A-1 and as external flange 30. Again as stated above with respect to FIG. 5B, spool piece 23 can be integral with regenerative media container 12 and yet function as fluid communication means 20A-1. Other embodiments of fluid communication means 20A-1 can be used without deviating from its functionality and will be obvious to one of ordinary skill in the art.

A plurality of each of the embodiments of the single fluid communication means 20A-1 shown in FIGS. 5A, 5B, 5C, and 5D can be used to provide a set of fluid communication means 20A which enables process fluid A to be selectively diverted to a plurality of regenerative devices. FIG. 5E shows an embodiment of a fluid communication means sub-set, for example 20A, which uses a fluid communication means of the type shown in FIG. 5C and wherein a single process fluid A is diverted to three regenerative devices, each one of which is in fluid communication with an end 27 of any one of the fluid communication means 20A contained in fluid communication means sub-set 20A of regenerative system 1. A regenerative system that uses such a configuration will be described later. A single member sub-set fluid communication means 20A of FIG. 5E can be used with regenerative system 1 shown in FIGS. 1 and 2.

To provide a relatively fluid-tight construction, sealing mechanisms 51, described in detail below, are provided both in the longitudinal and traverse directions relative to the major axis of flow control means 40. These seals are shown as 51L and 51T respectively in FIG. 5E. Seals 51L and 51T work together to provide a relatively fluid-tight construction for fluid communication means set 20A shown in FIG. 5E. Seals 51L and 51T can also be used in the flat plate 21 embodiment of fluid communication means set 20A, in which-case the seals will be located so as to provide an essentially complete seal around the periphery of fluid flow passage 22. Similar seals can also be provided around the periphery of flange 30 or the periphery of fluid leak control lips 80 to further control the cross-flow of process fluid or ambient air.

As shown in FIGS. 1 and 2, flow control means 40A is movably sandwiched between fluid plenum 70A and fluid communication means 20A-1. The movement of flow control means 40A may be free or constricted. For free movement of flow control means 40A between fluid plenum 70A and fluid communication means 20A-1, seals 51L and 51T can be gap seals wherein a small gap 26 can be provided between flow control means 40A and fluid communication means 20A-1. Similar gap seals can be provided between flow control means 40A and fluid plenum 70A.

Figure 5D:
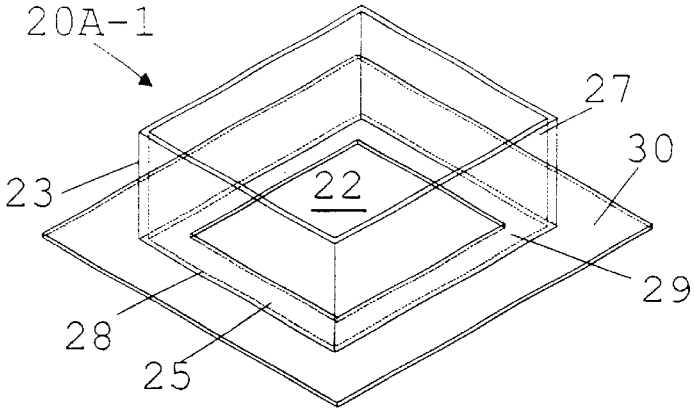
FIG. 5D is another perspective representation of another embodiment of the fluid communication means for passage of process fluid to and from a regenerative device in the regenerative system according to the present invention.
Figure 5E:
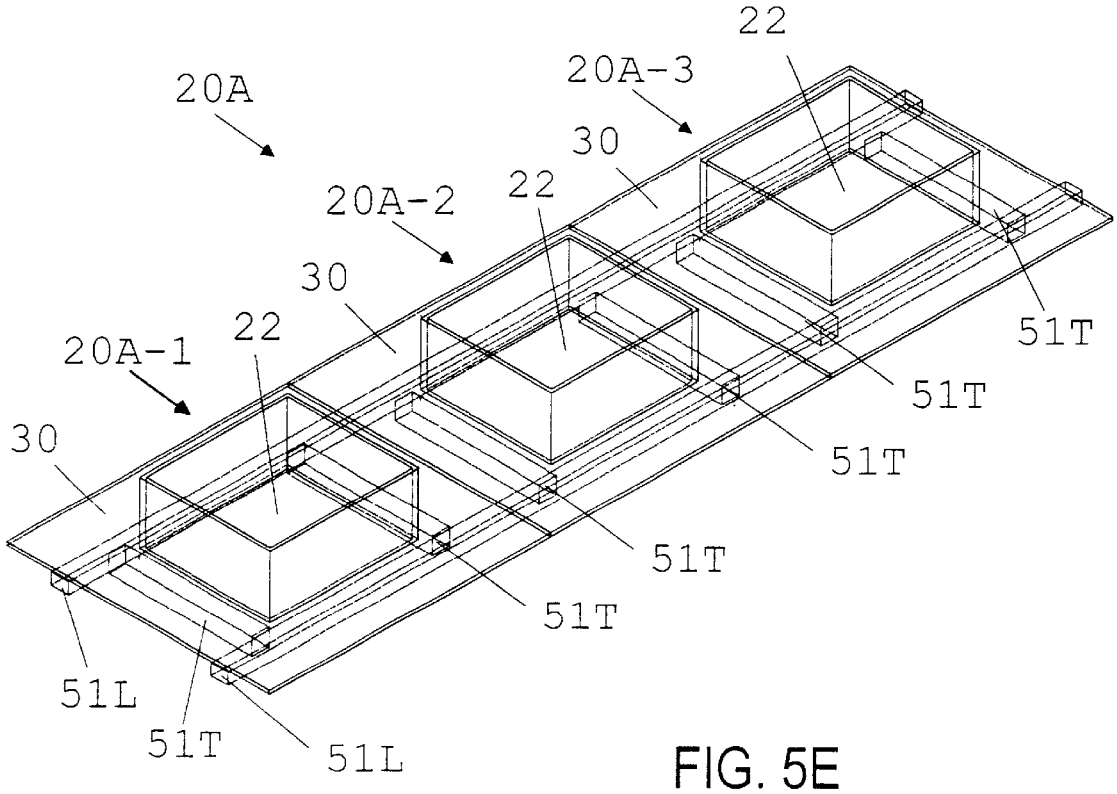
FIG. 5E is a perspective representation of an assembly of the fluid communication means shown in FIG. 5C adapted for the flow of a process fluid to three regenerative devices in the regenerative system according to the present invention.
Figure 6A:
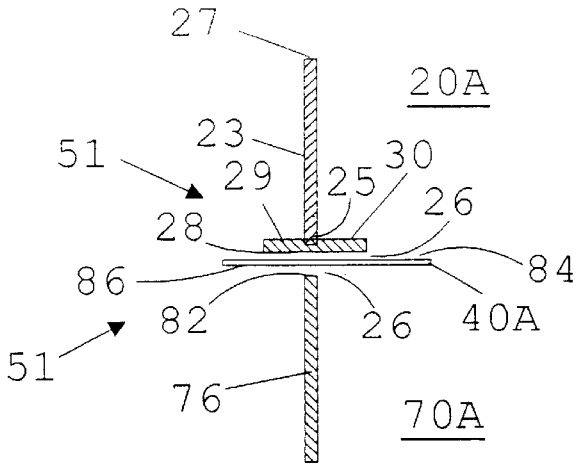
FIG. 6A is a representation of the details of the sealing mechanism used to minimize the passage of fluids between stationary and moving parts in the Multi-Port Valve Assembly of the regenerative system according to the present invention.

FIG. 6A shows a detail representation of an embodiment of seals 51T and 51L wherein a gap 26 is allowed between top surface 84 of flow control means 40A and surface 28 of fluid communication means 20A-1 (as shown in FIG. 5D) and between bottom surface 86 of flow control means 40A and surface 82 on a vertical wall 76 of fluid plenum 70A (as shown in FIG. 4A). The magnitude of the gap that can be used without excessive leakage can be determined according to the application but smaller gaps give better leak control. Thus a gap of 0.01 inch or less may be sufficient to prevent large amounts of process fluid from leaving regenerative system 1 if the process fluid is at a positive pressure or to prevent outside fluid from leaking into regenerative system 1 if the process fluid is at a negative pressure. The edge gap 26 of the type shown to be formed by the cooperation of surface 86 of flow control means 40A with vertical wall 76 of fluid plenum 70A can also be used with fluid communication means 20A-1. For example, the vertical wall 23 of the embodiment of fluid communication means 20A-1 shown in FIG. 5B could form gap 26 with flow control means 40A. Different gaps dimensions can be maintained in the same regenerative system. For example, a gap of 0.01 can be maintained between fluid communication means 20A-1 and flow control means 40C and a gap of 0.005 can be maintained between fluid plenum 70A and flow control means 40A.

Figure 6B:
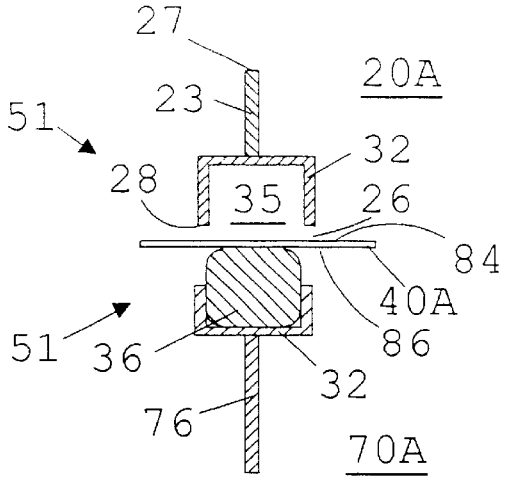
FIG. 6B is another representation of the details of the sealing mechanism used to minimize the passage of fluids between stationary and moving parts in the Multi-Port Valve Assembly of the regenerative system according to the present invention.

Another embodiment of the sealing mechanism shown in FIG. 6B, contemplates a horizontal inverted channel member 32 which is connected to wall 23 of fluid communication means 20A-1 shown in FIG. 5B. Member 32 has flat surfaces 28 at the end of its prongs. Flat surfaces 28 are maintained at a predetermined distance from upper surface 84 of flow control means 40A to create a labyrinth gap 26 between flat surface 28 and top surface 84 of flow control means 40A. Any fluid that passes across seal 51 first has to contract into gap 26 and then expand into expansion zone 35 and again contract into second gap 26. Thus a large pressure drop is created which reduces the amount of fluid that can pass across seal 51. While a simple expansion-contraction labyrinth gap is shown, other forms of labyrinth gaps can also be used to create a greater resistance to leaks of process fluid from the system or infiltration of outside fluid into the system. While labyrinth seal member 32 is shown attached to wall 23 of fluid communication means 20A-1, it can also be used with vertical wall 76 of fluid plenum 70A.

Figure 6C:
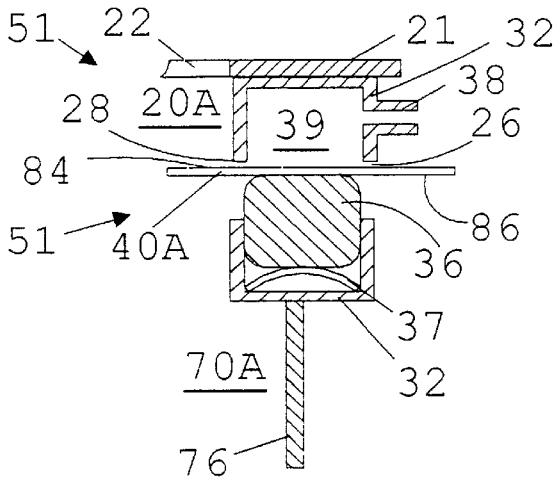
FIG. 6C is another representation of the details of the sealing mechanism used to minimize the passage of fluids between stationary and moving parts in the Multi-Port Valve Assembly of the regenerative system according to the present invention.

In yet another embodiment of a gap-seal 51 shown in FIG. 6C, the labyrinth seal member 32 of FIG. 6B is shown attached to flat plate embodiment 21 of fluid communication means 20A-1 of FIG. 5A. Labyrinth seal member 32 is provided with a fluid connector 38 which introduces a non-contaminating sealing fluid to further prevent cross-flow of process fluid or ambient fluid across seal 51. The sealing fluid creates a pressurized zone 39 within the labyrinth seal member 32 to prevent cross-flow of process or ambient fluids. Alternately, fluid connector 38 can be connected to a vacuum pump to capture fugitive process fluid and prevent its leakage to the outside environment. Thus a negative pressure is maintained within zone 39 which captures process and ambient fluids which may cross gap 26. The use of sealing fluids to prevent cross-contamination of process fluids is well know to practitioners of the art. As used herein, the term sealing fluid includes any fluid, such as clean air, nitrogen, carbon-dioxide, etc., which does not contaminate any of the process fluids and which is maintained at a higher pressure than either of the two process fluids on either side of a seal. The sealing fluid maintains a positive pressure between the two sides of the seals to prevent movement of a process or ambient fluid from one side to another side. The use of pressurized sealing fluid seals and the use of negative pressure to capture fugitive process fluid and to prevent its leakage to atmosphere is well known to persons having ordinary skill in the art.

To make fluid communication means 20A-1 even more fluid-tight than is possible with the gap-seals described above, seals 51L and 51T can be designed as contact seals. The contact seals can be provided between flow control means 40A and fluid communication means 20A-1. Similar contact seals can be provided between flow control means 40A and fluid plenum 70A. Any combination of gap and contact seals can also be used. For example, a gap seal can be used between flow control means 40A and fluid communication means 20A-1 and a contact seal can be used between fluid plenum 70A and flow control means 40A and vice versa.

Different embodiments of contact seals that can be used for controlling the flow of process or outside fluids into or out of fluid plenum 70A and fluid communication means 20A-1 while enabling constricted movement of flow control means 40A relative to stationary parts, fluid plenum 70A and fluid communication means 20A-1, are shown in FIGS. 6B, 6C, 6D, 6E, and 6F.

An embodiment of seal 51 wherein contact is made between the seal and the moving part is shown in FIG. 6B wherein wall 76 of fluid plenum 70A is fitted with a channel 32 which contains a contact seal element 36. Contact seal element 36 can be a soft metal seat made of a soft metal such as Babbitt , copper, aluminum, etc. Alternatively, it can be a soft non-metal seat fabricated from conventional sealing materials such as Teflon (TM), Buna rubber, Viton (TM), refractory rope, carbon blocks, carbon fibers, etc. Commercially available compound contact seals can also be used. An example of a commercially available compound contact seal is the spring energized Turcon Variseal (TM) seal manufactured by American Variseal Corp. Such sliding or moving-part seals are well known to practitioners of the art.

FIG. 6C shows the contact seal of FIG. 6B further incorporating a spring mechanism 37 to bias contact element 36 against lower surface 86 of flow control means 40A. Spring mechanism 37 improves sealing efficiency by maintaining a constant pressure against surface 86 to compensate for the possible wear of contact element 36 during its operation.

Figure 6D:
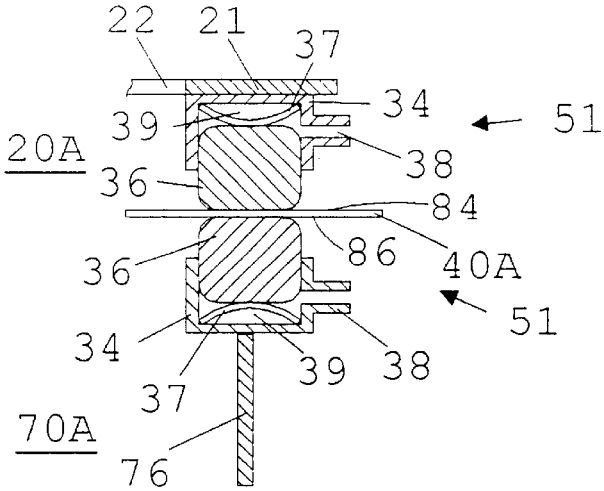
FIG. 6D is another representation of the details of the sealing mechanism used to minimize the passage of fluids between stationary and moving parts in the Multi-Port Valve Assembly of the regenerative system according to the present invention.

Another embodiment of seal 51 is shown in FIG. 6D, where flat plate embodiment 21 of fluid communication means 20-1 (as shown in FIG. 5A) has a channel 32 attached to it. A contact seal element 36 is located in channel 32. Element 36 is biased against upper surface 84 of flow control means 40A. Additional means to improve and maintain sealing efficiency during prolonged use through the use of spring biasing mechanisms 37, as described above, to press packing 36 against surface 84 of flow control means 40A are also shown in FIG. 6D with respect to the seal on plate 21 of fluid communication means 20A-1. To further improve sealing efficiency, a suitable pressurized sealing fluid (as described above) is injected into channel 32 through a fluid nozzle 38 attached to channel 32. Thus a pressurized zone 39 is created within channel 32 to further prevent any cross-flow of process or ambient fluid across seal 51. In FIG. 6D, the spring-biased, sealing-fluid separated sealing mechanism is shown used both with fluid plenum 70A and with fluid communication means 20A-1.

Figure 6E:
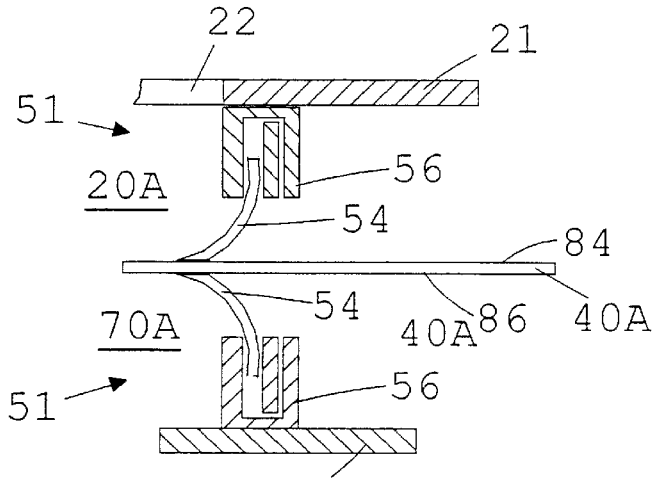
FIG. 6E is another representation of the details of the sealing mechanism used to minimize the passage of fluids between stationary and moving parts in the Multi-Port Valve Assembly of the regenerative system according to the present invention.

FIG. 6E shows yet another embodiment of a contact seal 51 wherein a wiper blade 54 is held biased against upper surface 84 of flow control means 40A. Wiper blade 54 is seated in a channel 56 which is attached to the flat plate embodiment of the fluid communication means 20A-1 shown in FIG. 5A. A similar sealing blade mechanism is shown on lower surface 86 of flow control means 40A wherein wiper blade 54 is held biased against lower surface 86 of flow control means 40A. The lower wiper blade 54 is held in channel 56 which is attached to top-plate 74 of fluid plenum 70 as shown in FIG. 4D.

Figure 6F:
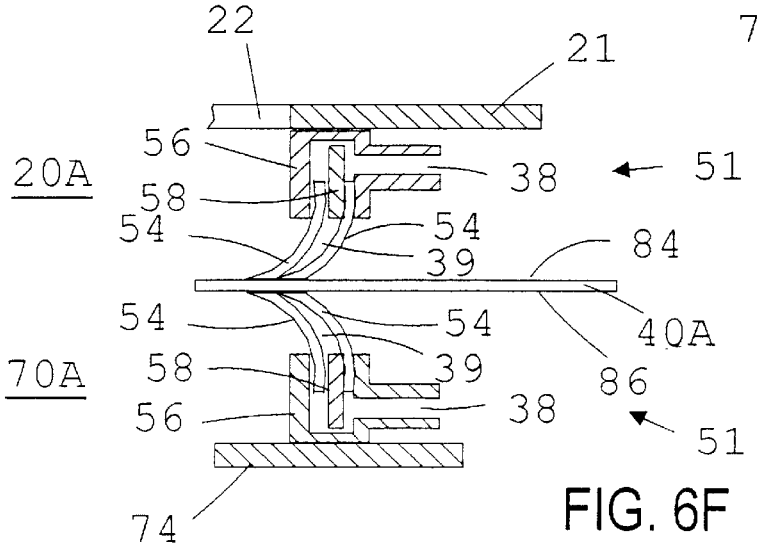
FIG. 6F is another representation of the details of the sealing mechanism used to minimize the passage of fluids between stationary and moving parts in the Multi-Port Valve Assembly of the regenerative system according to the present invention.

FIG. 6F shows yet another embodiment of a contact seal wherein a pair of wiper blades 54 are held biased against the upper surface 84 of flow control means 40. Wiper blades 54 are seated in a channel 56 which is attached to the fluid communication means 20A-1 shown in FIG. 5A. Spacers 58, separated by gaps between adjacent spacers, are located within the two wiper blades 54 to create a gap between the two wiper blades 54. For further improve the sealing efficiency, a sealing fluid nozzle 38 is attached to channel 56 to introduce a pressurized sealing-fluid into the space created by spacer 58 between the two wiper blades 54. The sealing fluid passes through the gaps between two adjacent spacers and into the gaps between the two wiper blades to create a pressurized zone 39 to prevent the cross-flow of process or ambient fluids. A similar sealing blade mechanism is shown on the lower surface 86 of flow control means 40A wherein a pair of wiper blades 54 is held biased against the lower surface of flow control means 40A. The lower wiper blades are held in channel 56 which is attached to top-plate 74 of the embodiment to the fluid plenum 70A shown in FIG. 4D. The wiper blades can be made of spring-steel, rubber or any other material which is suitable for the operating conditions of the regenerative system. The use of wiper-blades as sealing mechanisms between stationary and moving parts is well known to persons having ordinary skill in the art.

The above sealing mechanisms are meant to be representative only of the various type of sealing mechanisms that can be used between the moving and the stationary parts in Multi-Port Valve Assembly 5 of regenerative system 1. Each of the sealing mechanism can be independently used either with fluid communication means 20A-1 or the fluid plenum 70A or with both. Further, while the above seals have been described with respect to fluid communication means 20A-1 and fluid plenum 70A, they can be used with any of the fluid communication means in fluid communication means set 20 or with any of the fluid plenums in fluid plenum set 70. Thus embodiments of regenerative system 1 which have more than one fluid plenum or more than one fluid communication means, as will be described later, can use any of the above sealing mechanisms with any of the fluid plenums or fluid communication means in the system. Yet other sealing mechanisms to create fluid seals between moving and stationary parts are well known to persons of ordinary skill in the art and can be used instead of the sealing mechanisms described above without departing from the spirit of the invention.

Referring back to FIGS. 1, 2, 3A, 3B, and 3C, drive system 50 operates rigid flow control means 40A in a reciprocating manner between fluid plenum 70A and fluid communication means 20A-1 so as to alternately move fluid passage zone 45A in or out of fluid communication means 20A-1. When drive system 50 is operated so that flow passage zone 45A overlaps fluid passage 22 of fluid communication means 20A-1, a through passage for the flow of process fluid A from overlapping open end 72 of fluid plenum 70A into flow passage zone 45A and into fluid passage 22 of fluid communication means 20A-1 is created. Therefore, process fluid A passes between fluid communication means 20A-1 and fluid plenum 70A or between fluid plenum 70A and fluid communication means 20A-1. When drive system 50 is again operated, it moves solid zone 48 into an overlapping position with fluid passage 22 on fluid communication means 20A-1. Since solid zone 48 is solid, it shuts off the flow of process fluid A between fluid communication means 20A-1 and fluid plenum 70A. FIG. 3A shows a flow control means 40A which has five flow passage zones 45 and five solid zones 48. However, a minimum of one flow passage zone and two solid zones is required for operation of the embodiment of regenerative system 1 which is shown in FIG. 1. The use of more flow passage zones reduces the number of times that rigid flow control means 40A has to change direction and therefore reduces wear and tear on drive system 50.

In FIGS. 1 and 2, drive system 50 consists of a reciprocating drive means 50A and an idle drive element 60A. Reciprocating drive means 50A can be any mechanical means such as a motorized cam and shaft mechanism or an electrical device such as a linear actuator or a combination of electric and mechanical devices that will move rigid flow control means 40A back and forth in gap 26 (not shown, but previously described) between fluid communication means 20A-1 and fluid plenum 70A so as to control the flow of process fluid A between fluid communication means 20A-1 and fluid plenum 70A as described above. Such mechanical, electrical, and electromechanical devices are well known to persons of ordinary skill in the art. For example, drive means 50A could be a toothed sprocket wheel that engages regularly spaced sprocket holes 62 on both sides of flow control means 40A of FIGS. 3A, 3B, and 3C. The sprocket wheel 50A could be directly or indirectly connected to a reversible continuous or indexing-movement electric motor (shown as 160 in FIG. 1) which in conjunction with control logic and limit switches alternatively rotates in opposing directions so that rigid flow control means 40A is first moved in a first direction and then in a opposing direction. Alternately, drive means 50A could be a set of friction rollers (not shown) which grasp flow control means plate 40A and through frictional means move it as described above. Yet alternately, drive means 50A could be a set of V-Belt pulley wheels (not shown) which grasp V-belts (not shown) attached to the bottom surface of 40A and through frictional means move it as described above. Other mechanical means such as piston-actuated grasping devices, mechanical fingers, crank and rod mechanisms, and other devices will be apparent to a person having ordinary skill in the art. Many examples of drive mechanisms for reciprocating devices are well known and will be suitable for moving rigid flow control means 40A. These means can be easily adapted by persons having ordinary skill in the art for reciprocatingly moving rigid flow control means 40A as described above.

As stated above, drive mechanism 50A moves rigid flow control means 40A in a first direction until the last flow passage zone 45A on either end of rigid flow control means 40A is overlapped with flow passage 22 of fluid communication means 20-1. End zones 49R and 49L are additional solid sections of rigid flow control means 40A that are provided to allow the last flow passage zone 45A to be used. Thus drive mechanism 50A engages the engaging mechanism, such as sprocket holes 62, on end zone 49R when the last flow passage zone 45A adjacent to end zone 49R is overlapping with flow passage 22 of fluid communication means 20A-1. Similarly, drive mechanism 50A engages the engaging mechanism on end zone 49L when the last flow passage zone 45A adjacent to end zone 49L is overlapping with flow passage 22 of fluid communication means 20A-1. Idler mechanism 60A on the other end of rigid flow control means 40A is used to support and align rigid flow control means 40A as it moves from one end to the other. Idler mechanism 60A can be a simple sliding support member, or a roller, or a set of rollers, or any other suitable device which can hold and align flow control means 40A as it moves between its two extreme positions: Such idler mechanisms are well known and will also be obvious to a person having ordinary skill in the art.

Figure 3B:
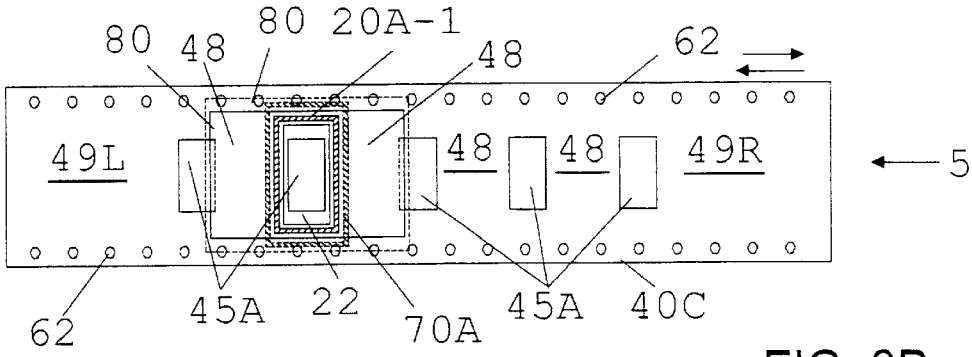
FIG. 3B is an assembled "freeze-frame" plan representation of the Multi-Port Valve Assembly of FIG. 3A during the operation of the regenerative system of FIG. 1.
Figure 3C:
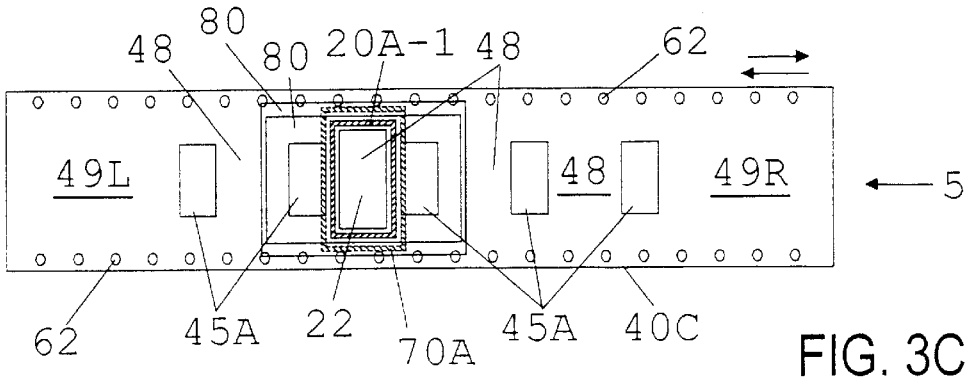
FIG. 3C is another assembled "freeze-frame" plan representation of the Multi-Port Valve Assembly of FIG. 3A during the operation of the regenerative system of FIG. 1.
Figure 3D:
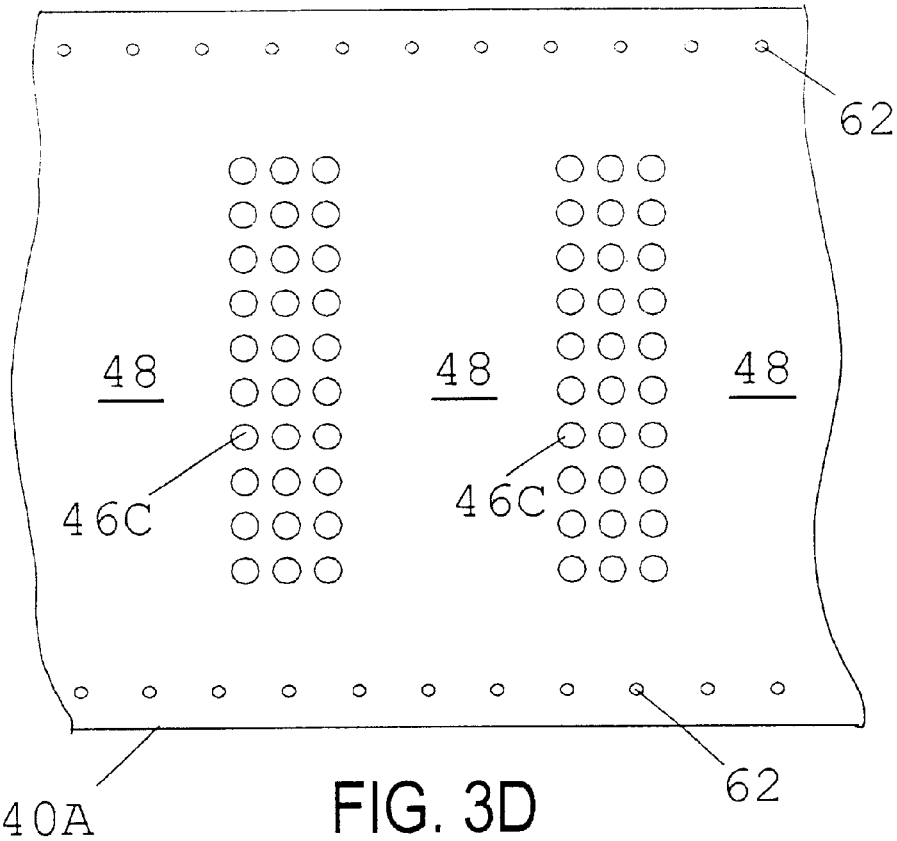
FIG. 3D is a detailed plan representation of the flow-orifices on the flow control means used in the Multi-Port Valve Assembly of FIG. 3A.
Figure 3E:
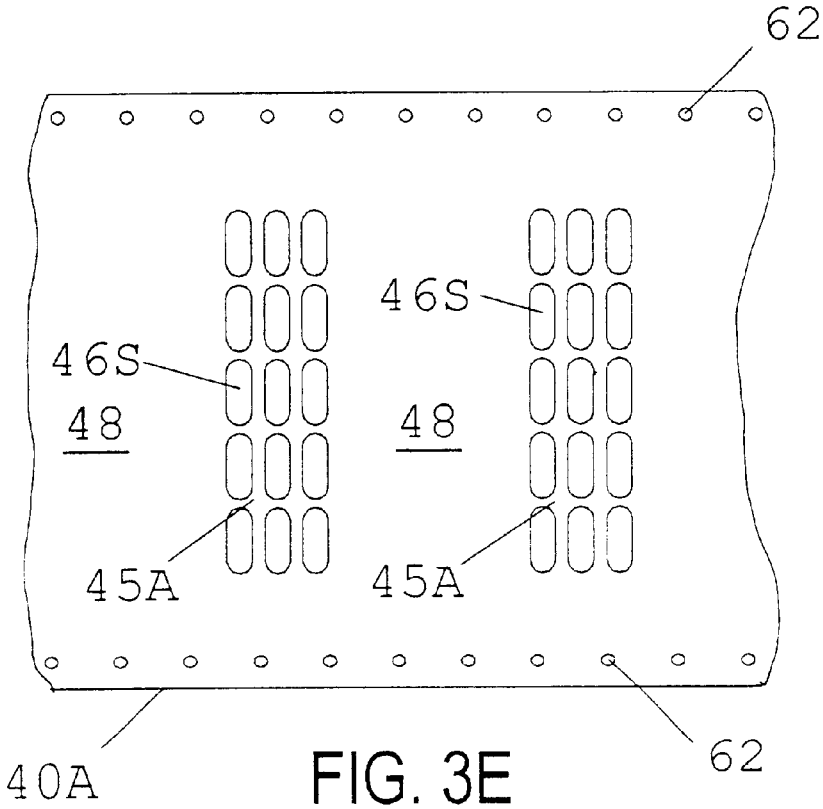
FIG. 3E is a detailed plan representation of another embodiment of the flow-orifices on the flow control means used in the Multi-Port Valve Assembly of FIG. 3A.

The sequence of operations of the drive mechanism 50A can be explained using the "freeze-frames" in FIGS. 3B and 3C as references. FIG. 3B shows an initial position wherein the rigid flow control means 40A of FIGS. 1 and 2, is initially positioned so that one of the flow passage zones 45A is in an overlapping position with flow passage 22 of fluid communication means 20A-1. This particular alignment of flow passage zone 45A on rigid flow control means 40A and fluid passage 22 on fluid communication means 20A-1 and opening 72 on fluid plenum 70A creates a path for movement of process fluid A between fluid communication means 20A-1 and fluid plenum 70A or between fluid plenum 70A and fluid communication means 20A-1. As flow control means 40A is moved to the left by the operation of drive mechanism 50A (not shown), it brings solid zone 48 on flow control means 40A into an overlapping position with flow passage 22 on fluid communication means 20A-1. This second alignment is shown in the "freeze-frame" of FIG. 3C. Since solid zone 48 is solid, it blocks the passage of process fluid A between fluid communication means 20A-1 and fluid plenum 70A. After a predetermined period of time, drive mechanism 50A is again operated to move flow control means 40A further to the left bringing the next flow passage zone 45A into an overlapping position with flow passage 22 and again allowing process fluid A to pass between fluid communication means 20A-1 and fluid plenum 70A. Instead of intermittently operating drive mechanism 50A as described above, drive mechanism 50A can also be operated continuously at a predetermined speed which is determined by the amount of contact time required between regenerative material 14 in regenerative device RD1 and process fluid A. Movement of flow control means 40A to the left is continued until the last flow passage zone 45A on flow control means 40A is in an overlapping position with flow passage 22. The direction of movement of drive mechanism 50A is then reversed so that flow control means 40A now moves from left to right. The sequence described above is continued in the reverse direction until the first flow passage zone 45A on the left-hand side of flow control means 40A is an overlapping position with flow passage 22. The direction of movement is again reversed so that flow control means 40A now moves from right to left. Thus the movement of process fluid between fluid plenum 70 and fluid communication means 20A-1 can be periodically switched on and off by the reciprocating movement of flow control means 40A.

Flow control means 40 can also be a flexible member rather than the rigid member described in FIG. 1 as flow control means 40A. For example, flow control means 40 can be made of a flexible, heat-resistant, wear-resistant, non-permeable, VOC-resistant material such as spring-steel or stainless-steel or carbon steel or aluminum or other suitable metal or metallic alloy. Metallic belts suitable for use in the above application are readily available from a number of commercial suppliers such as Sandvik Process Systems, Endless Belt Industries, and others. Alternately, flow control means 40 can also be made of a non-metallic material similar to those used in flexible expansion joints for flue ducts. Examples of such materials are elastomeric materials such as Neoprene, Butyl, EPDM, Fluoroelastomer and others and fabric composite materials such as Butyl, Fluoroelastomer, and others. Other materials that can be used are Viton (TM) and Teflon (R). Belts made of Teflon (R) materials are readily available from a number of suppliers such as Greenbelt Industries, Inc. Belts used for conveying applications in ovens, furnaces, etc. can also be used and are readily available from a number of manufacturers. Other materials will be readily apparent to one having ordinary skill in the art. The selection of the proper material is made based upon design criteria which would be unique to each regenerative system and would include factors such as operating temperature and corrosiveness of process fluid and concentrations of any VOCs in the process fluid stream. The thickness of the belt is chosen from design considerations, such as the material of the belt, the expected wear, pressure differential, diameter of drive and idle pulleys, period of operation, etc. The method of calculating the thickness of the belt is well known.

Figure 3F:
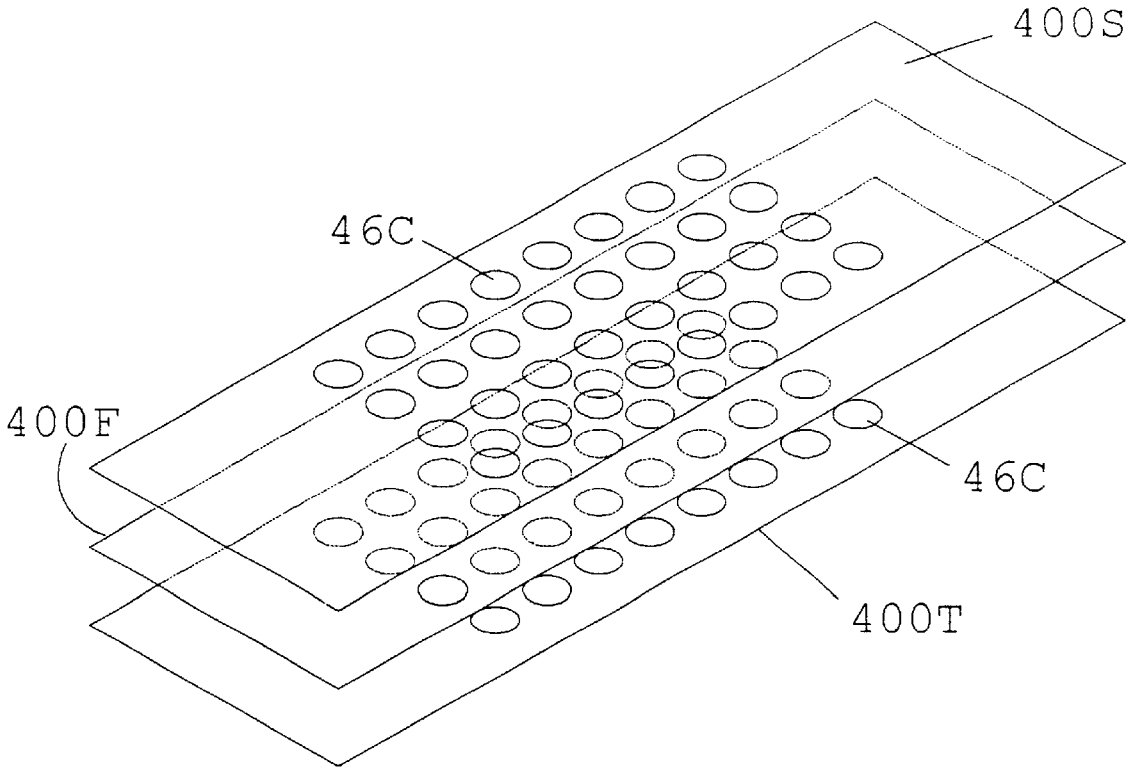
FIG. 3F is a detailed representation of a multi-layered composite flow control means used in the Multi-Port Valve Assembly of FIG. 3A.

Composite belts consisting of layers of any of the materials described above can also be used. Such belts will be particularly useful where there are different operating conditions on each planar surface of the belt. Furthermore, one of the belt layers of a composite belt can be made of a filter material to prevent particulate matter in the process stream from entering the regenerative device. For example, the filter layer can be a porous filter media material such as a bag-house filter media felt or a molecular filter material or a ultrafiltration material or HEPA filter. Unlike the other belts, the filter belt is fabricated so that it does not have any fluid passage zones 45 on it. Thus the filter material will cover the fluid passage zones 45 on the other belt layers to create an integral particulate filter in the composite belt. The filter belt can be bonded to a carrier belt which has fluid passage zones 45 on it as described above or it can be sandwiched between two such belts. An example of a composite belt that uses three layers is shown in FIG. 3F wherein a porous filter belt 400F is sandwiched between a non-porous stainless steel belt 400S and a non-porous Teflon belt 400T. The stainless steel belt 400S and the Teflon belt 400T are identical in dimensions and flow passages and are aligned so that their identical flow passage zones 45 are overlapping with each other. The filter belt 400F is a solid web and does not have flow passage zones 45 on it. Thus the filter material in filter belt covers the fluid passages in the flow passage zones 45 of the stainless steel belt 400S and Teflon belt 400T to create a filter zone which is integral with flow control means 40. It will be obvious to a person having ordinary skill in the art that a separate filter belt is unnecessary to achieve the filtration results described above. For example, the fluid passages in flow passage zone 45 of a single layer flow control means 40 can be covered with flexible filter material to provide the same results. The flow passage zones 45 in any of the above composite flow control means 40 would therefore allow the process fluid to pass through its fluid passage zones while filtering out any solid particulate matter and preventing its entry into the regenerative device. Such refinements will be obvious to a person having ordinary skill in the art.

Figure 7:
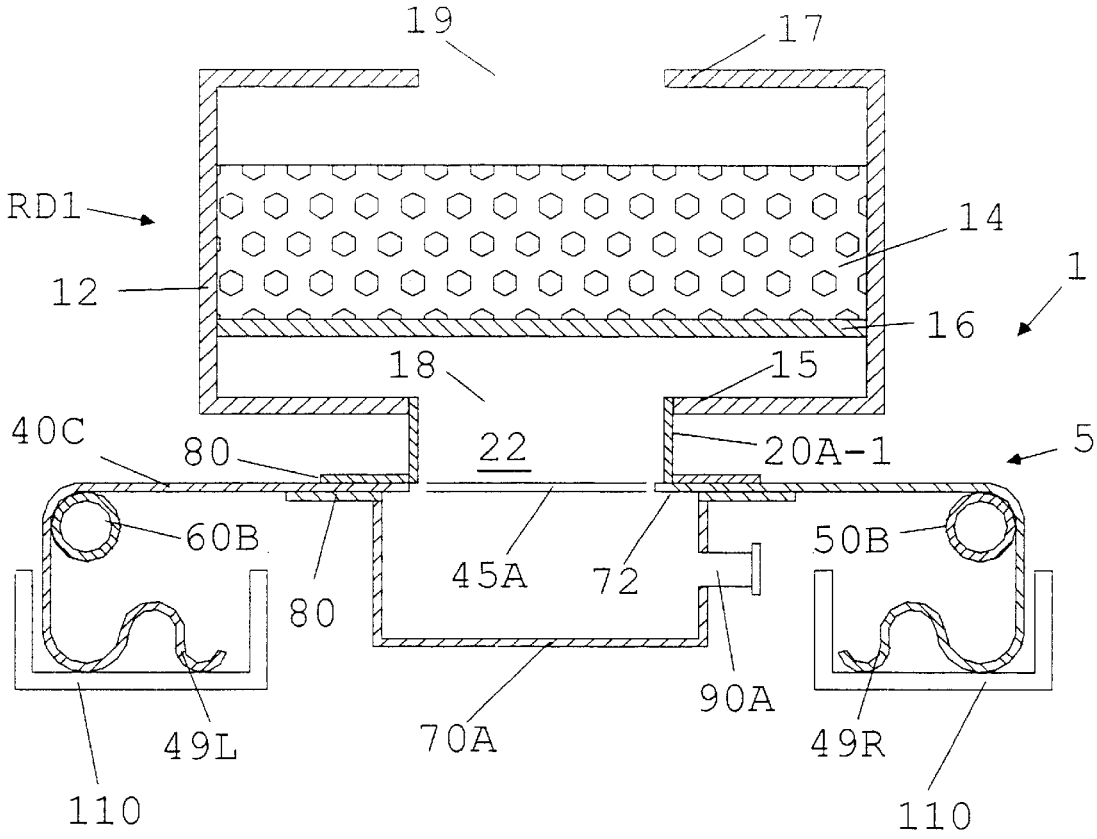
FIG. 7 is a sectional elevational representation showing a simplified embodiment of the regenerative system according to the present invention, which uses a flexible flow control means and wherein the ends of the flexible control means are dropped into take-up wells.

FIG. 7 shows another embodiment of regenerative system 1 of FIG. 1 which uses a flexible open-ended belt, having the configuration described above for the rigid member 40A, as a flow control means. The flow control means is designated as 40B in FIG. 7. The ends of flow control means 40B are allowed to drop into wells 1 10 on either side of regenerative system 1. The constructional details of regenerative system 1 of FIG. 7 are the same as those of regenerative system 1 of FIG. 1 except for the use of flexible flow control means 40B instead of rigid flow control means 40A. The same type of drive mechanisms described above for the rigid flow control means 40A in FIG. 1, can also be used for flexible flow control means 40B. It will be obvious that the advantage of using flexible flow control means 40B is the reduction in space required for the system because of the ability to fold flow control means 40B in wells 1 10.

Figure 8:
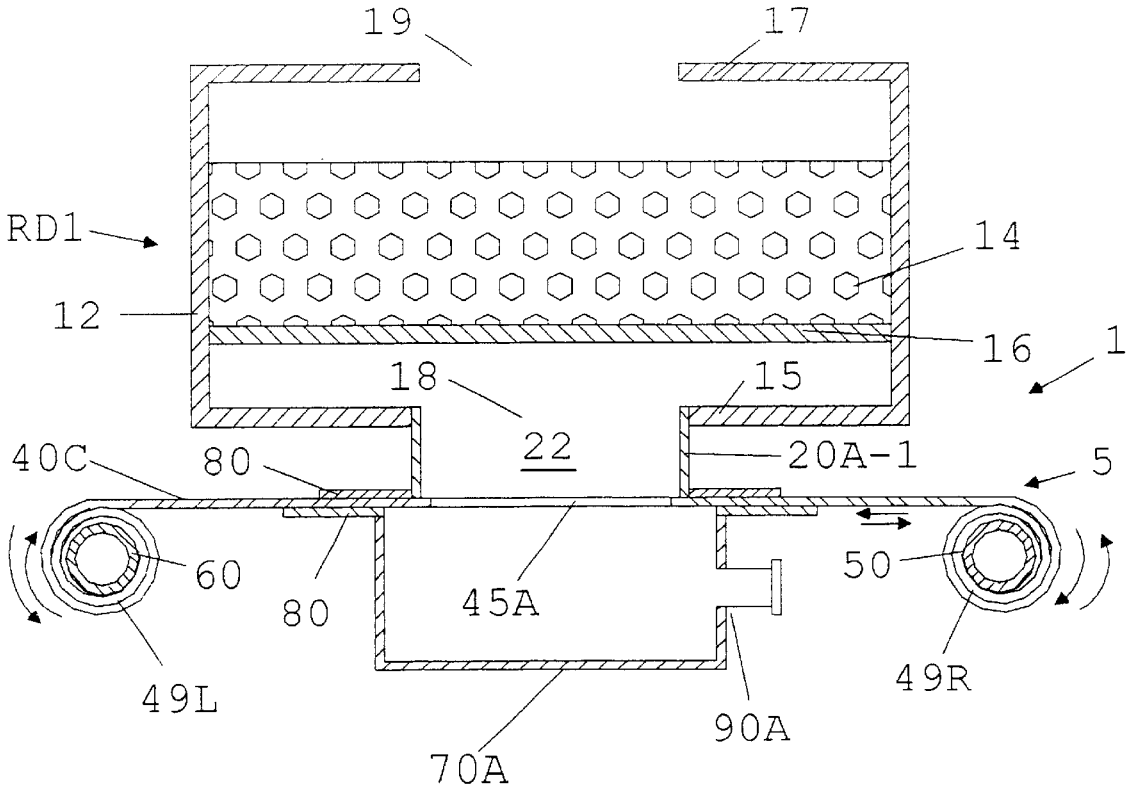
FIG. 8 is a sectional elevational representation showing a simplified embodiment of the regenerative system according to the present invention which uses a flexible flow control means and wherein the ends of the flexible control means are wound on take-up spools.

FIG. 8 shows yet another embodiment of regenerative system 1 of FIG. 7 wherein the ends of flow control means 40B are spooled on spool-drums 100 on active drive 50A and idle drive 60A of regenerative system 1. The same type of drive mechanisms described above for rigid member 40A can also be used for flexible flow control means 40B. Again, it will be obvious that the advantage of using flexible flow control means 40B is the reduction in space required for regenerative system 1 because of the ability to wrap flow control means 40B on spools 100.

Figure 9:
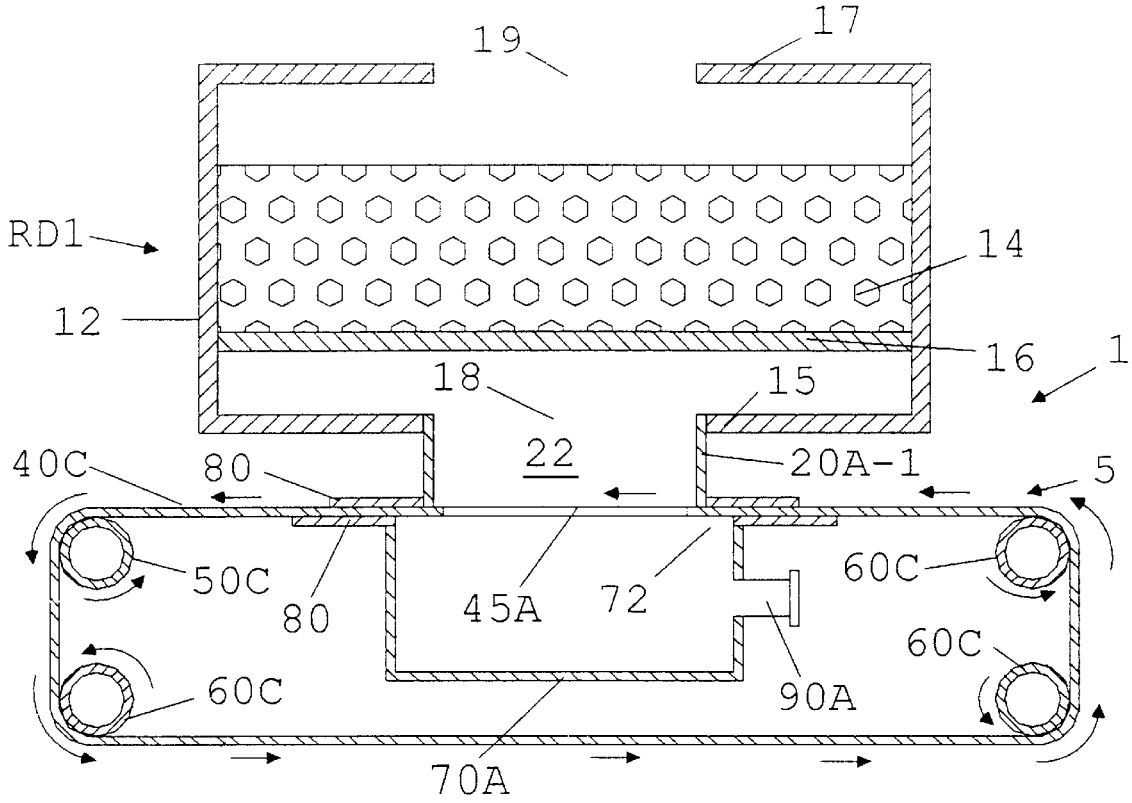
FIG. 9 is a sectional elevational representation showing a simplified embodiment of the regenerative system according to the present invention which uses an endless flexible belt as a flow control means in the Multi-Port Valve Assembly.
Figure 10:
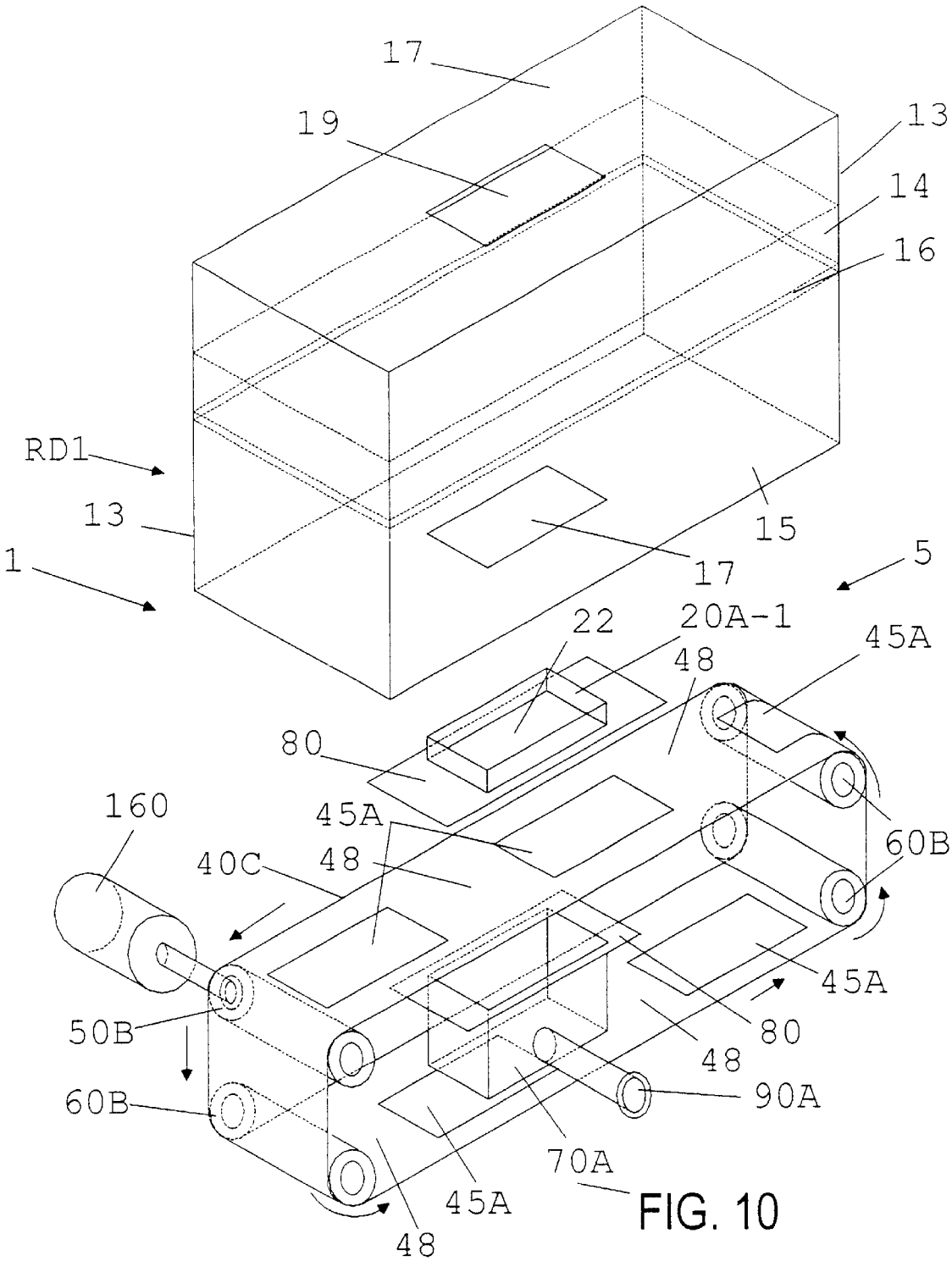
FIG. 10 is an exploded perspective representation of the regenerative system of FIG. 9.

FIG. 9 shows another embodiment of the regenerative system 1 shown in FIG. 7 which uses a flexible endless belt designated as 40C as a flow control means instead of the open-ended flexible belt 40B shown in FIG. 7. An exploded perspective view of the embodiment shown in FIG. 9 is also shown in FIG. 10. The advantage of using endless belt 40C relative to the open belts 40B of FIGS. 7 and 8 is that a shorter length of belt is required because end zones 48R and 48L are not required. A minimum of two operating cycles of fluid passage zones 45A and solid zones 48 are required for continuous operation of regenerative system 1 through the alternate cycles. However, to physically accommodate endless belt 40C around the fluid plenums 70 and the drive system 50, a minimum of three operating cycles are required. Another advantage of using an endless belt is that an uni-directional drive system can be used to move flow control means 40C because the cycles are repeated as belt 40C is continuously moved forward. Thus the bi-directional drive system described above in FIGS. 1, 2, 7, and 8 is not required even though it could be used. The use of an uni-directional drive system reduces the complexity of the regenerative system and makes it simpler to design, operate, and maintain.

The operation of the regenerative system 1 of FIGS. 9 and 10 is similar to the operation of regenerative systems 1 of FIGS. 1, 2, 7, and 8. However as discussed above, process fluid A is either allowed to enter or is prevented from entering regenerative device RD1 by the movement of flow control means 40C in one direction only. The alignment of flow passage zone 45A of flow control means 40C with fluid passage 22 on fluid communication means 20A-1 and opening 72 of fluid plenum 70A allows process fluid A to pass between fluid communication means 20A-1 and fluid plenum 70A. The alignment of solid zone 48 of flow control means 40C with fluid passage 22 on fluid communication means 20A-1 and opening 72 of fluid plenum 70A shuts off the flow of process fluid A between fluid communication means 20A-1 and fluid plenum 70A.

A regenerative system 1, such as that shown in FIGS. 1, 2, 7, 8, 9, and 10, with only one process fluid A and only one regenerative device RD1 is particularly useful for batch processes. For example, a batch reactor may emit an exhaust stream containing large amounts of water-vapor which could cause a plume if emitted directly to atmosphere. A regenerative system having a single regenerative device containing some water adsorbing material such as cotton fibers or silica gel can be used to temporarily capture the water-vapor when flow passage zone 45A allows process stream A to flow into RD1. The captured water-vapor-can then be slowly evaporated through natural evaporation or heating means to the atmosphere so that a plume is not created. Other uses of a single process fluid, single regenerative device system will be apparent to a person having ordinary skill in the art.

The principles of the Multi-Port Valve Assembly as used with regenerative devices have been described so far with respect to the regenerative system embodiments shown in FIGS. 1, 2, 7 8, 9, and 10 using one process fluid and one regenerative device only. It will now be apparent that the principles of the above-described Multi-Port Valve Assembly can also be used with more than one process fluid and more than one regenerative device. The fluid passage zones 45 and solid passage zones 48 on endless belt flow control means 40C can be arranged so that the flow of any process fluid from a set of process fluids can be sequenced for any required length of time through any regenerative device in a set of regenerative devices. Various embodiments of regenerative systems using many different combinations of fluids, regenerative devices and flow sequences are described below.

Figure 11:
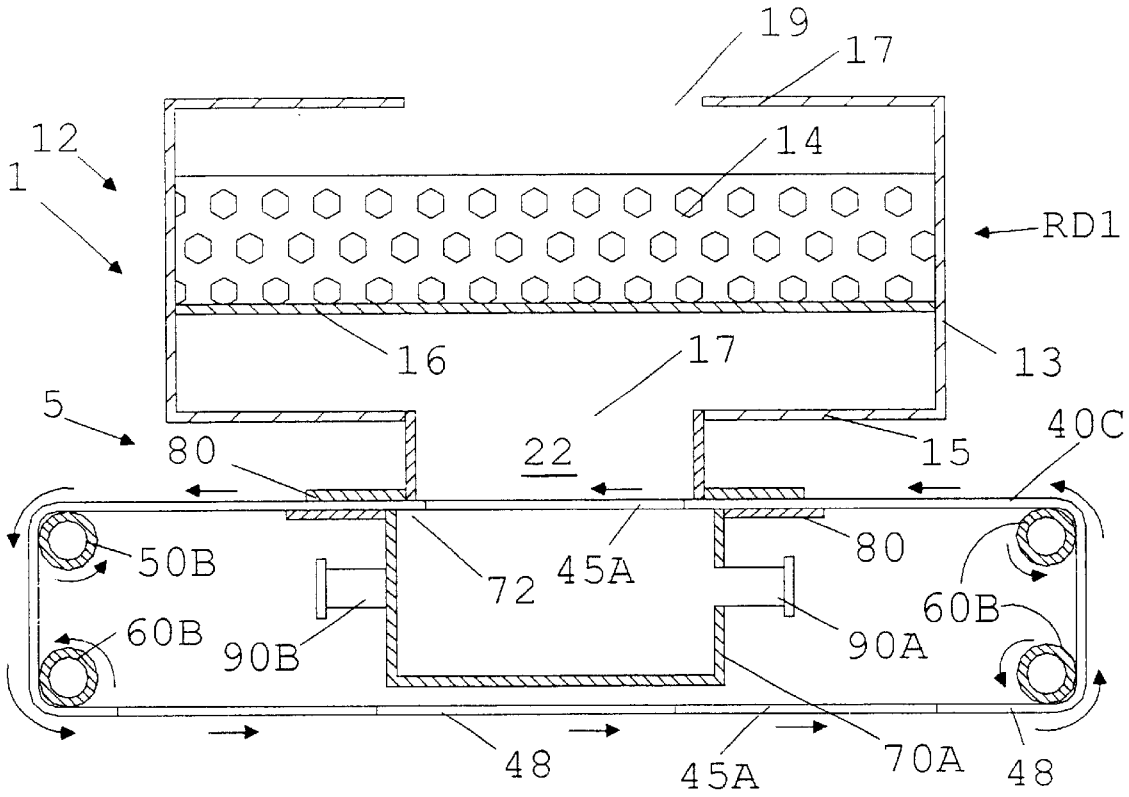
FIG. 11 is a sectional elevational representation showing a simplified embodiment of the regenerative system according to the present invention which uses an endless flexible belt as a flow control means in the Multi-Port Valve Assembly and which is adapted to the flow of two process fluids into a single regenerative device.
Figure 12:
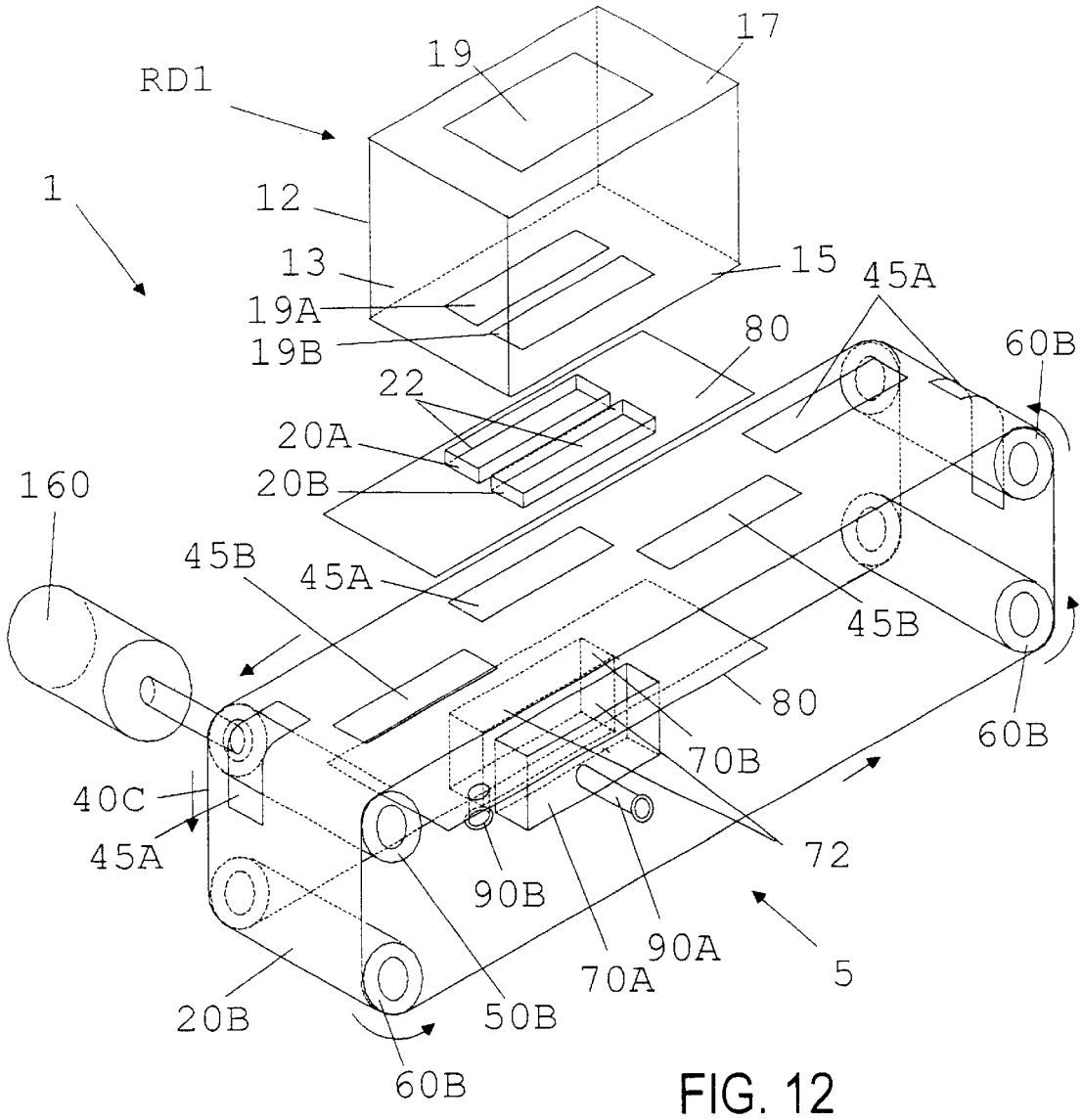
FIG. 12 is an exploded perspective representation of the regenerative system of FIG. 11.
Figure 13A:
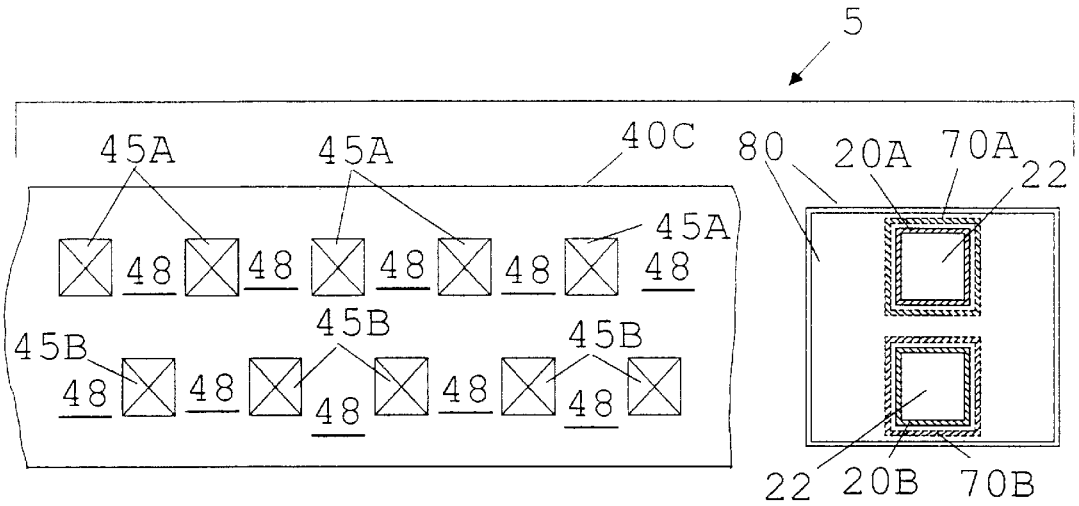
FIG. 13A is a dis-assembled plan representation of the Multi-Port Valve Assembly without the drive system used in the regenerative system of FIG. 11.
Figure 13B:
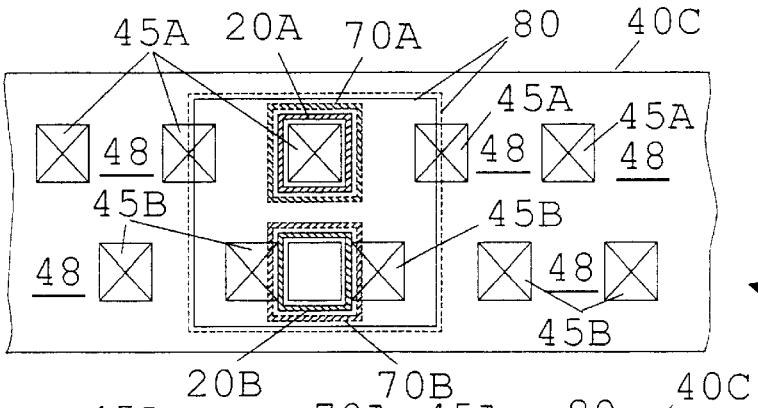
FIG 13B is an assembled "freeze-frame" plan representation of a portion of the Multi-Port Valve Assembly of FIG. 13A during the operation of the regenerative system of FIG. 11.
Figure 13C:
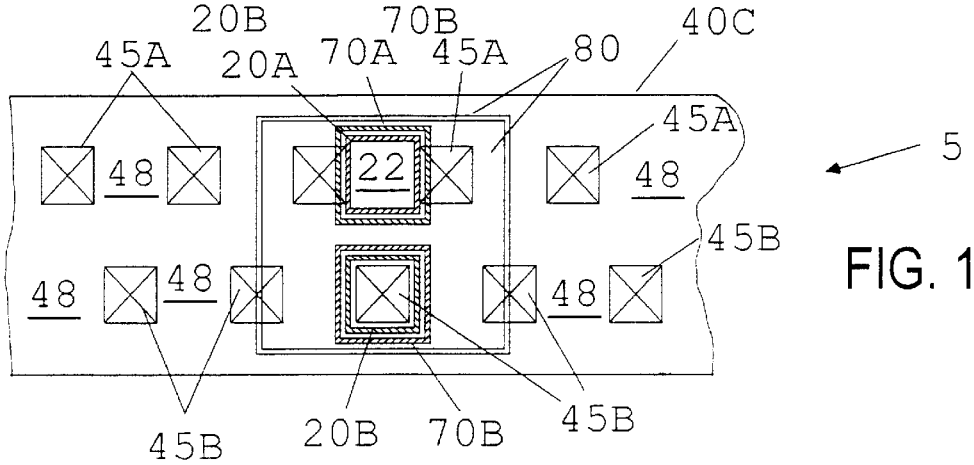
FIG. 13C is another assembled "freeze-frame" plan representation of a portion of the Multi-Port Valve Assembly of FIG. 13A during the operation of the regenerative system of FIG. 11.

An example of an embodiment of regenerative system 1 wherein the flow of two process fluids, designated as fluid A and fluid B, is controlled into a single regenerative device RD1 is shown in FIG. 11. An exploded perspective representation of the embodiment of regenerative system 1 of FIG. 11 is also shown in FIG. 12. FIG. 13A shows a disassembled representation of the Multi-Port Valve Assembly without the drive system in which endless belt flow control means 40C is shown separated from the fluid plenums and the fluid communication means. In this representation, a portion of flow control means 40C is shown laid out in a flattened position to show the number and location of the flow passage zones and solid zones. In this representation, flow control means 40C is also shown separated from fluid communication means 20A-1 and 20A-2 and fluid plenums 70A and 70B of Multi-Port Valve Assembly 5 for clarity of description. FIGS. 13B and 13C are "freeze-frame" representations of a portion of flow control means 40C as it passes through gap 26 (not shown but previously described) between fluid plenums 70A and 70B and fluid communication means 20A-1 and 20A-2.

As shown in the FIGS. 11, 12, 13A, 13B, and 1 3C, each process fluid has an individual fluid supply/removal plenum of the type described above with respect to FIG. 1. Thus fluid A has fluid plenum 70A and fluid B has fluid plenum 70B. Each fluid plenum 70A and 70B has fluid supply or removal means 90A and 90B respectively for supply or removal of process fluids A and B from fluid plenum 70A and 70B respectively. The fluid plenums are shown adjacent to each other but can also be located at any other suitable location. As described previously, sealing mechanisms 51 (not shown but previously described with respect to FIGS. 6A and 6D) can also be used with plenums 70A and 70B to control the potential leakage of process fluids from the system.

The set of fluid communication means includes a fluid communication means for each process fluid and regenerative device. Thus process fluid A has a fluid communication means 20A-i and process fluid B has a fluid communication means 20B-i where the suffixes "A" and "B" denote the fluid which can flow through the fluid communication means and the suffix"-i" is a positive integer which denotes the regenerative device number into which flow in directed by the fluid communication means. Thus fluid communication means 20A-1 denotes that process fluid A flows to RD1. Similarly, fluid communication means 20B-1 denotes that process fluid B flows to RD1. Sealing mechanisms (not shown but previously described with respect to FIGS. 6A and 6D) can also be used with fluid communication means 20A and 20B to control the potential leakage of process fluid from the system.

As shown in FIG. 13A, a set of flow passage zones associated with each process fluid is located on flow control means 40C. Thus the set of flow passage zones 45A on flow control means 40C allow the passage of process fluid A between fluid communication means 20A-1 and fluid plenum 70A and set of flow passage zones 45B on flow control means 40C allow the passage of process fluid B between fluid communication means 20B-1 and fluid plenum 70B. Similarly, the set of solid zones 48 on flow control means 40C shut off the passage of process fluid A between fluid communication means 20A-1 and fluid plenum 70A and process fluid B between fluid communication means 20B-1 and 70B.

Drive mechanism 50B (shown in FIGS. 11 and 12) moves flow control means 40C between gap 26 (not shown) created by fluid plenums 70A and 70B and fluid communication means 20A-1 and 20B-1. Drive mechanism 50B is an uni-directional drive mechanism as described previously. However, it preferably moves flow control means 40C in a predetermined direction with respect to fluid plenum 70A. In the "freeze-frame" representation of FIG. 13B of the embodiment of Multi-Port Valve Assembly 5 used in regenerative system 1 of FIG. 11, a flow passage zone 45A on flow control means 40C overlaps flow passage zone 22 of fluid communication means 20A-1 and opening 72 of fluid plenum 70A. Thus flow of process fluid A is enabled between plenum 70A and regenerative device RD1 through flow passage zone 45A and fluid communication means 20A-1. At the same time, a solid zone 48 on flow control means 40C blocks flow passage zone 22 of fluid communication means 20B-1 and opening 72 of fluid plenum 70B. Thus the flow of fluid B is blocked because solid zone 48 of flow control means 40C overlaps fluid communication means 20B-1. As flow control means 40C is moved to the left by drive mechanism 50B, flow passage zone 45A leaves fluid communication means 20A-1 and is replaced by solid zone 48. Thus the flow of fluid A between fluid plenum 70A and regenerative device RD1 is interrupted. Simultaneously, solid zone 48 leaves fluid communication means 20B-1 and flow passage zone 45B enters fluid communication means 20B-1. Thus passage of process fluid B between 70B and regenerative device RD1 is enabled. This operating position is shown in FIG. 13C. Further forward movement of flow control means 40C again provides the operating position shown in FIG. 13B. Yet further forward movement of flow control means 40C again provides the operating position shown in FIG. 13C. Thus regenerative system 1 alternates between the operating positions of FIG. 13B and FIG. 13C so that the regenerative material 14 in regenerative device RD1 is alternately contacted by process fluid A and process fluid B.

While single instances of flow passage zones 45A and 45B are shown in FIGS. 13A, 13B, and 13C to make up an operating cycle, any combinations of instances of flow passage zones 45A and 45B could be used. Thus if a continuous drive mechanism 50B is used and it is required that fluid B contact the regenerative material in RD1 for twice the period of time, then the operating cycle would consist of the flow passage zone - solid zone sequence 45A, 48, 45B, 45B, 48. Alternately, the operating cycle could contain the sequence 45A, 48, 45B, 48 and the operation of drive 50B could be made intermittent so that it would pause for twice the period of time when flow of fluid B is enabled to regenerative device RD1 than when flow of fluid A is enabled to regenerative device RD1. Also while five operating cycles have been shown in FIGS. 13A, 13B, and 13C, only three operating cycles are required for the satisfactory operation of regenerative system 1. Also, the number of flow passage zones 45A and solid zones 48 shown in FIG. 12 are for representational purposes only; the actual number of operating cycles on flow control means 40C of regenerative system 1 of FIG. 12 can be selected as described above with respect to FIGS. 13A, 13B, and 13C.

As an example of the use of the regenerative system of FIG. 11, consider a process which periodically exhausts a moisture-laden cold process fluid A and a hot process fluid B. If fluid A creates a plume when exhausted to the atmosphere, the heat in fluid B can be transferred to fluid A even though fluid B is exhausted after fluid A. The heat in process fluid B can be transferred to process fluid A in the regenerative system 1 of FIG. 11 by alternately passing process fluids A and B through regenerative device RD1. Thus the heat in process fluid B is transferred to regenerative material 14 in RD1 and is then transferred to cold fluid A. When the heated cold fluid A is then exhausted to atmosphere, the undesirable plume is eliminated.

Figure 14:
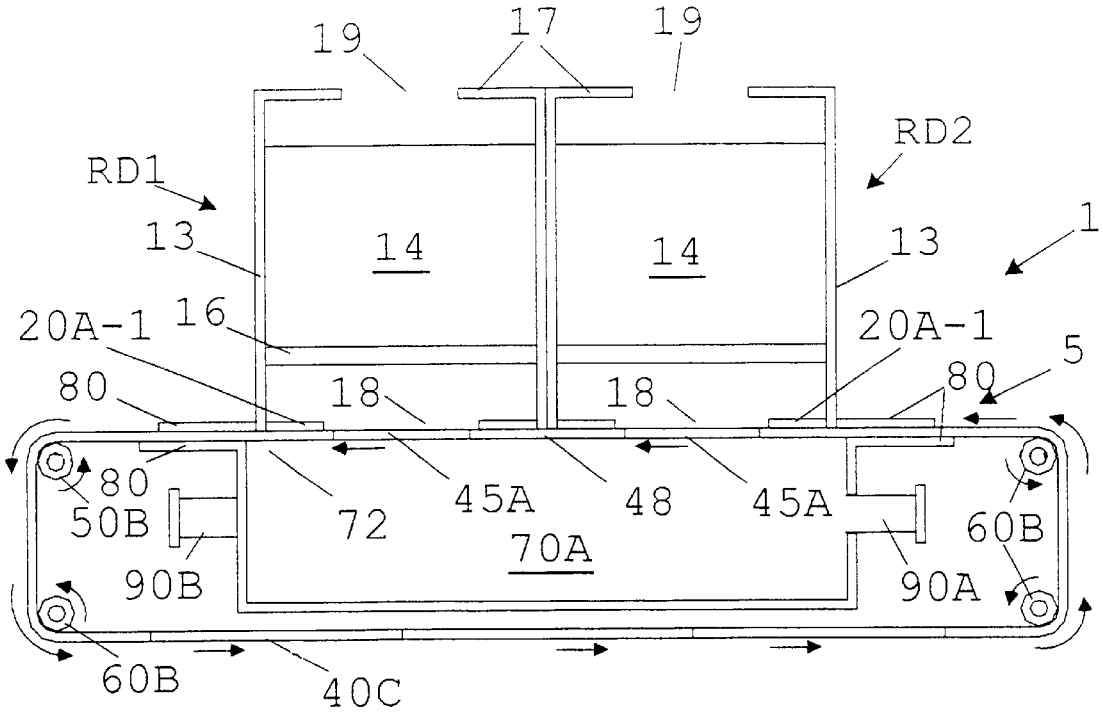
FIG. 14 is a sectional elevational representation showing a simplified embodiment of the regenerative system according to the present invention which uses an endless flexible belt as a flow control means in the Multi-Port Valve Assembly and which is adapted to the flow of two process fluids into two regenerative devices.
Figure 15:
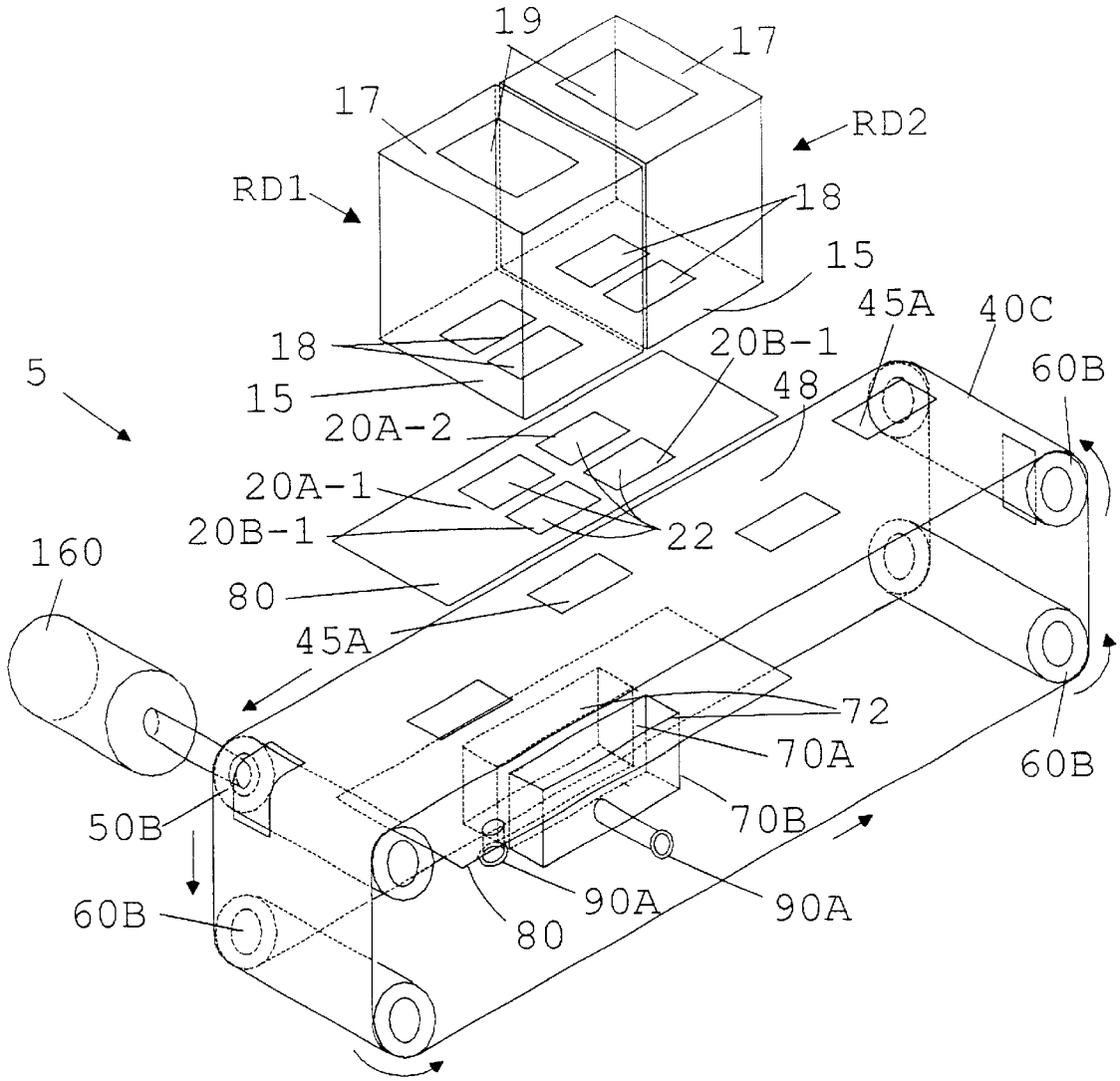
FIG. 15 is an exploded perspective representation of the regenerative system of FIG. 14.

Following the descriptional narrative used above, FIGS. 14, 15, 16A, 16B, 16C, and 16D show yet another embodiment of regenerative system 1 wherein 2 process fluids, A and B, are contacted with a set of regenerative devices 10, which includes two regenerative devices, RD1 and RD2. FIG. 15 is an exploded perspective view of regenerative system 1 of FIG. 14. Process fluids A and B are supplied or removed from regenerative devices RD1 and RD2 by a set of fluid plenums 70 which includes fluid plenums 70A and 70B for process fluids A and B respectively. As described previously with respect to the embodiment of regenerative system 1 shown in FIG. 11, flow control means 40C has two sets of flow passage zones 45A and 45B for the two process fluids A and B respectively. Each process fluid also has a corresponding set of fluid communication means 20 associated with each bed. Thus in FIG. 16A, fluid communication means 20A-1 allows fluid A to communicate from fluid plenum 70A to regenerative device RD1 through flow passage zone 45A on flow control means 40C. Similarly, in FIG. 16A, fluid communication means 20A-2 allows fluid A to communicate from fluid plenum 70A to regenerative device RD2 through flow passage zone 45A on flow control means 40C. Similarly, fluid communication means 20B-1 allows fluid B to communicate from fluid plenum 70B to regenerative device RD1 through flow passage zone 45B on flow control means 40C and fluid communication means 20B-2 allows fluid B to communicate from fluid plenum 70B to regenerative device RD2 through flow passage zone 45B on flow control means 40C.

Figure 16A:
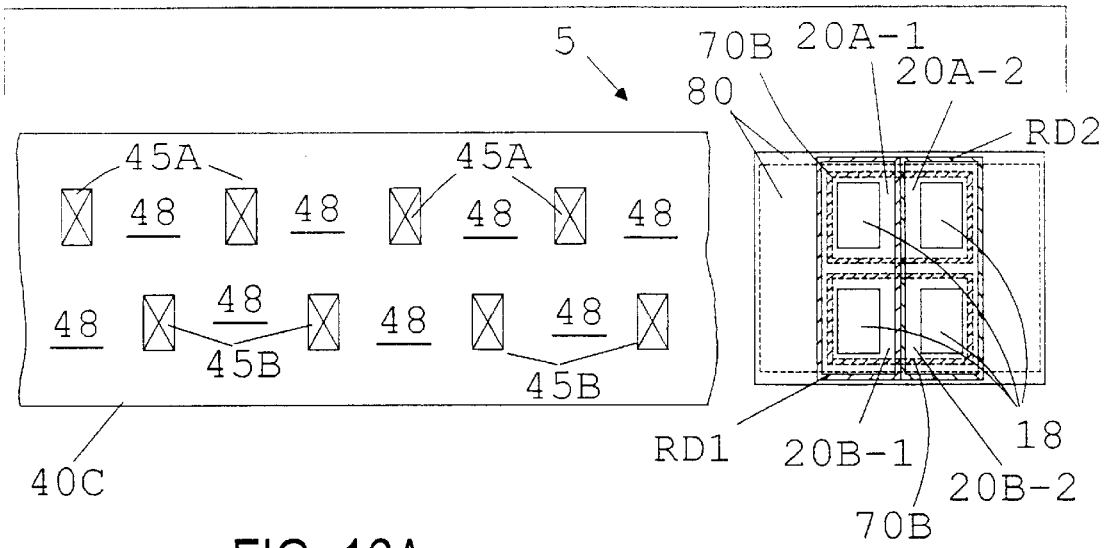
FIG. 16A is a dis-assembled plan representation of the Multi-Port Valve Assembly without the drive system used in the regenerative system of FIG. 14.
Figure 16B:
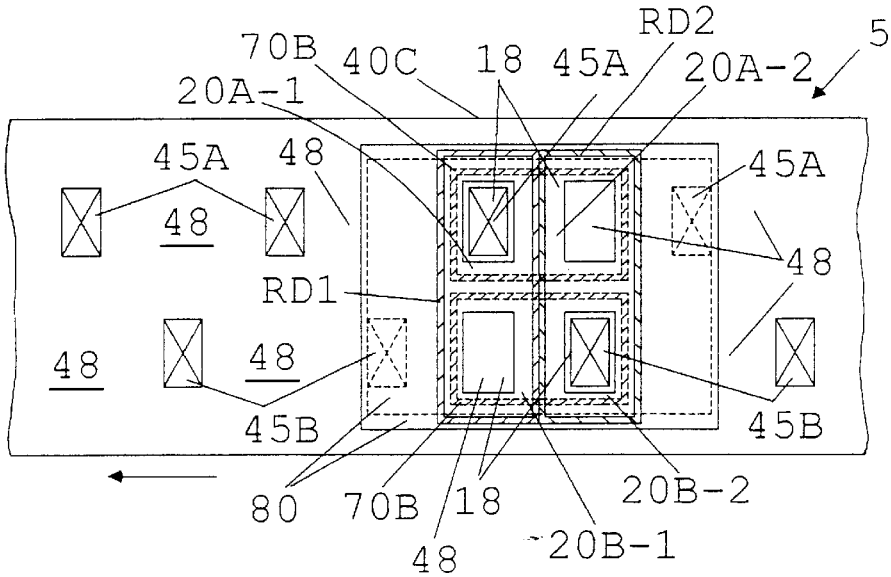
FIG. 16B is an assembled "freeze-frame" plan representation of a portion of the Multi-Port Valve Assembly of FIG. 16A during the operation of the regenerative system of FIG. 14.
Figure 16C:
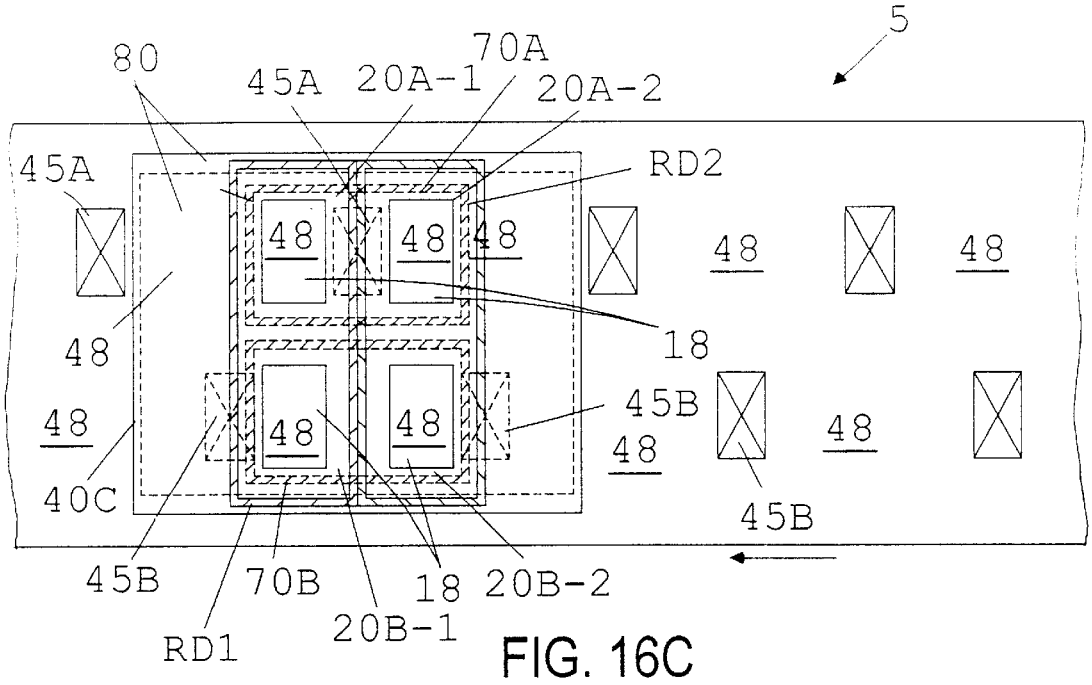
FIG. 16C is another assembled "freeze-frame" plan representation of a portion of the Multi-Port Valve Assembly of FIG. 16A during the operation of the regenerative system of FIG. 14.
Figure 16D:
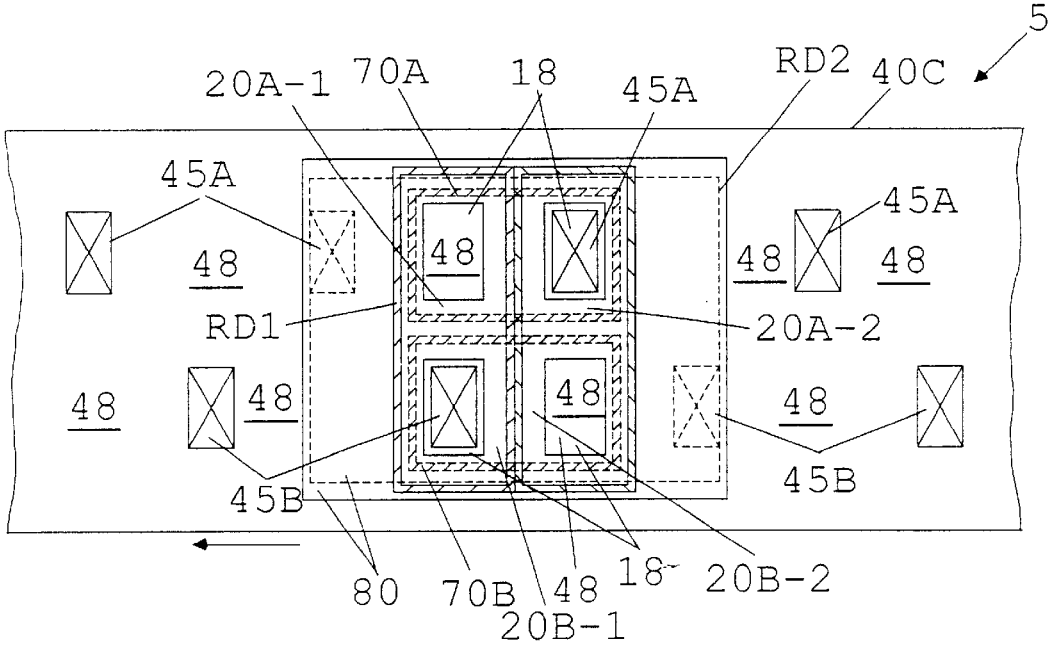
FIG. 16D is yet another assembled "freeze-frame" representation of a portion of the Multi-Port Valve Assembly of FIG. 16A during the operation of the regenerative system of FIG. 14.

FIG. 16A shows a disassembled view of the Multi-Port Valve Assembly, without the drive system, used in the regenerative system of FIG. 14 in which flow control means 40C is shown separated from fluid plenums 70A and 70B and fluid communication means 20A-1, 20A-2, 20B-1, and 20B-2. FIGS. 16B, 16C, and 16D are "freeze-frame" sequential representation of the positions of flow passage zones 45A and 45B relative to fluid communication means 20A-1, 20A-2, 20B-1, and 20B-2 during the operation of regenerative system 1. In FIG. 16B, flow passage zone 45A is an overlapping position with fluid communication means 20A-1 while neighboring flow passage zone 45B is an overlapping position with fluid communication means 20B-2. Simultaneously, the adjacent solid zones 48 of flow control means 40C are in an overlapping position with fluid communication means 20A-2 and fluid communication means 20B-1 respectively. Thus in this first position of flow control means 40C, process fluid A is allowed to contact the regenerative material 14 in RD1 while fluid B is allowed to contact the regenerative material 14 in regenerative device RD2. FIG. 16C is another "freeze-frame" representation of Multi-Port Valve Assembly 5 which shows an intermediate operating position of regenerative system 1 after flow control means 40C has been moved to the left. In this second position, solid zones 48 overlap fluid communication means 20A-1, 20A-2, 20B-1, and 20B-2. Thus contact of both process fluid A and process fluid B with regenerative material 14 in regenerative devices RD1 and RD-2 is temporarily shut-off.

FIG. 16D is another "freeze-frame" representation of Multi-Port Valve Assembly 5 which shows the next operating position of regenerative system 1 after flow control means 40C has been moved to the left. In this second position, flow passage zone 45A overlaps fluid communication means 20A-2 and flow passage zone 45B overlaps fluid communication means 20B-1 while solid zones 48 of flow control means 40 overlap fluid communication means 20A-1 and fluid communication means 20B-2. Thus contact of fluid A with regenerative material 14 in regenerative device RD2 is now enabled while contact of fluid B with the regenerative material 14 in regenerative device RD1 is also enabled. Therefore, by moving flow control means 40C continuously to the left, successive flow passage zones 45A and 45B are overlapped with fluid communication means 20A-1, 20A-2, 20B-1, and 20B-2 as described above. Thus process fluids A and B are alternately contacted with the regenerative material 14 in regenerative devices RD1 and RD2 respectively.

As an example of the use of the regenerative system of FIG. 14, consider a process which exhausts a moisture-laden cold process fluid A which creates an undesirable plume. There is also another process which also exhausts a hot process fluid B. The heat in process fluid B can be transferred to process fluid A in the regenerative system 1 of FIG. 14 by alternately passing process fluids A and B through each of regenerative devices RD1 and RD2. Thus the heat in process fluid B is transferred to regenerative material 14 in RD1 and RD2 and is then transferred to cold fluid A. When the heated cold fluid A is then exhausted to atmosphere, the undesirable plume is eliminated.

By now, it will be apparent to one of ordinary skill in the art that any combination of fluids and regenerative devices can be used in regenerative system 1. Also for design and constructional reasons, flow passage zones 45 can be provided on more than one flow control means 40C. For example, if three process fluids A, B, and C are to be processed, flow passage zones 45A and 45B can be located on a first flow control means 40C which can be designated as flow control means 40C1 and flow passage zones 45C can be located on a second flow control means 40C which can be designated as flow control means 40C2. Such an arrangement may be necessary in cases where fluids A, B, and C have different physical or chemical characteristics. For instance, in the above example, if process fluid C is corrosive, then flow control means 40C2 can be made of Teflon while flow control means 40C1 can be made of a less expensive material such as spring steel. The use of two flow control means will not affect the operation of regenerative system 1 if the movement and positions of the flow passage zones, 45A and 45B, on flow control means 40C1 is synchronized with the movement and positions of the flow passage zones 45C on flow control means 40C2 so that the two flow control means operate similar to a single flow control means which contains flow passage zones 45A, 45B, and 45C on it.

The previous example assumed that a regenerative device is continuously contacted by a process fluid. However, it is not necessary that the regenerative material in the regenerative devices be continuously contacted with a fluid. By omitting a flow passage zone 45 on flow control means 40, a regenerative device can experience an idle period wherein no fluid contacts the regenerative material within it. Thus a "blind" flow passage zone 45 in which no fluid passages are present can be incorporated on flow control means 40 so that no fluid can pass through it during a "contact" period. Thus the regenerative device will experience an idle period before it is again contacted with a process fluid. Such idle periods may be necessary for process reasons or to reduce cross-contamination of process fluids during operation of regenerative system 1.

The various combinations of fluids, regenerative devices, and flow control means flow configurations for regenerative systems using endless belts can be concisely described with the nomenclature "NF/NRD-belt description" where NF is the number of process fluids being processed by the regenerative system and NRD is the number of regenerative devices in the system. The "belt description" can be represented by the nomenclature "NB/NC/$S_i$/WP*LP*WS/TO" wherein NB is the number of belts used for flow control in the system, NC is the number of cycles on the belt, $S_i$ denotes either the flow passage zone or the solid zone location corresponding to fluid "i" on the belt, WP is the width of flow passage zone 45, LP is the length of flow passage zone 45, WS is the width of solid zone 48 between each flow passage zone, and TO represents the dimension of the orifice in the flow passage zone. In the above nomenclature, WP, LP, and WS are described in length units such as inches or feet or centimeters. In the nomenclature, $S_i$ takes the value 1 if a flow passage zone is present or the value 0 if a solid zone is present. For example, the regenerative system shown in FIG. 1 using the belt cycles shown in FIG. 3A with WP=24 inches, LP=36 inches, WS=26 inches and using 1 inch diameter fluid passage orifices shown in FIG. 3D can be concisely represented by the nomenclature "1/1-1/5/$01_A$/24"*36"*26"/1"Dia.". Similarly, the regenerative system shown in FIG. 1 using the belt cycles shown in FIG. 3A with 1 inch by 3 inch slotted holes shown in FIG. 3E can be concisely represented by the nomenclature "1/1-1/5/$01_A$/24"*36"*26"/1"×3"" if the dimensions used in the above example are used . As a further example, the regenerative system shown in FIG. 11 using the belt cycles shown in FIG. 13A with 1 inch diameter holes shown in FIG. 3D can be concisely represented by the nomenclature "2/1-1/5/$1_A1_B$/WP*LP*WS/1"Dia." where WP, LP, and WS are in length units as in the preceding two examples. As yet another example, the regenerative system shown in FIG. 14 using the belt cycles shown in FIG. 16A with 1 inch by 3 inch elongated holes shown in FIG. 3E can be concisely represented by the nomenclature "2/2-1/4/$1_A1_B$/WP*LP*WS/1"×3"".

As a further example, a regenerative system (not shown) in which three process fluids, A, B, and C contact the regenerative material in two regenerative devices RD1 and RD2 respectively, can be concisely represented by the nomenclature "3/2-1/3/$1_A1_B1_C$/WP*LP*WS/1"Dia.". This example assumes that the 1 inch diameter inch holes shown in FIG. 3D are used as fluid passages in the fluid passage zone 45 of flow control means 40C. This example also assumes that three operating cycles, as described above, are provided on flow control means 40C.

As yet another example, a regenerative system (not shown) in which three process fluids, A, B, and C contact regenerative material in two regenerative devices RD1 and RD2 respectively and which further incorporates an idle period of operation of the regenerative device after contact by fluids A, B, and C, can be concisely represented by the nomenclature "3/2-1/3/$1_A1_B1_C$0/WP*LP*WS/1.5"Dia." where 0 designates the blind fluid passage zone as described above. This example assumes that 1.5 inch diameter holes similar to those shown in FIG. 3D are used as fluid passages in the fluid passage zone 45 of flow control means 40C. This example also assumes that three operating cycles, as described above, are provided on flow control means 40C.

As yet another example, a regenerative system (not shown) in which three process fluids, A, B, and C contact regenerative material in three regenerative devices RD1, RD2, and RD3 respectively and in which fluid B contacts the regenerative material in between contacts with fluids A and C, can be concisely represented by the nomenclature "3/3-1/3/$1_A1_B1_C1_B$/WP*LP*WS/1.5"×2.5"". This example assumes that 1.5 inch by 2.5 inch elongated holes shown in FIG. 3E are used as fluid passages in the fluid passage zone 45 of flow control means 40C. This example also assumes that three operating cycles, as described above, are provided on flow control means 40C.

As yet another example, a regenerative system (not shown) in which three process fluids, A, B, and C contact regenerative material in four regenerative devices RD1, RD2, RD3, and RD4 respectively and in which fluid B contacts the regenerative material in between contacts with fluids A and C, can be concisely represented by the nomenclature "3/4-1/3/$1_A1_B1_C1_B$/WP*LP*WS/1.5"Dia.". This example assumes that 1.5 inch diameter holes similar to those shown in FIG. 3D are used as fluid passages in the fluid passage zone 45 of flow control means 40C. This example also assumes that three operating cycles, as described above, are provided on flow control means 40C. From previous descriptions, it will be apparent that each regenerative device experiences a fluid contact cycle of fluid A, followed by fluid B, followed by fluid C, and finally followed by fluid B. The use of four regenerative devices ensures that the flow of any of the fluids through the regenerative system is not interrupted.

Figure 17B:
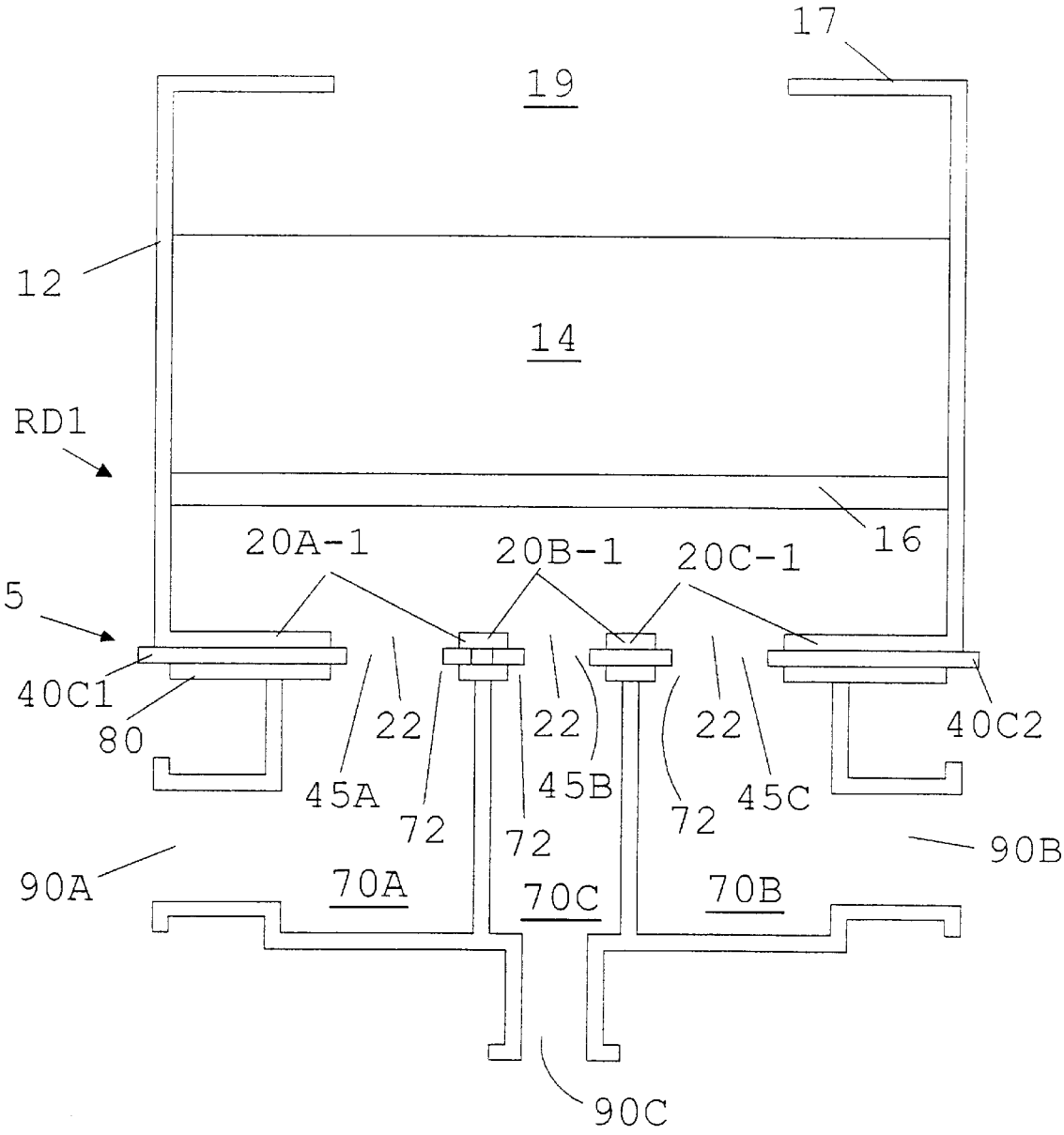
FIG. 17B is a sectional side-elevational representation of the regenerative system of FIG. 17A.

As stated above with respect to the above examples, all kinds of combinations of regenerative devices, process fluids, and flow passage zone locations are possible. Also, as stated previously, more than one endless belt can be used as the flow-control means. The flow passage zones for different fluids can also be located on different belts. FIGS. 17A, 17B, 18A, 18B, 18C, 18D, 18E and 18F show an embodiment of a regenerative system 1 wherein regenerative device set 10 contains six regenerative devices RD1, RD2, RD3, RD4, RD5, and RD6 which are selectively contacted by process fluids A, B, and C respectively FIG. 17A is a Front elevational representation. FIG. 17B is a side elevational representation. The regenerative system of FIGS. 17A and 17B uses two endless belts as the flow control means. The first belt is designated as 40C1 and the second belt is designated as 40C2. The first belt 40C1 contains flow passage zones 45A. The second belt 40C2 contains flow passage zones 45B and 45C. The two belts are arranged so the flow passage zones 45A, 45B, and 45C follow the sequence required to create an operating cycle. Thus the positions of flow passage zones 45A, 45B, and 45C are equivalent to their positions on an equivalent single belt flow control means 40C.

As described above, the regenerative system 1 of FIGS. 17A and 17B can be described by the modified nomenclature "3/6-1/3/($1_A1_A$)($1_C1_B1_B1_C$)/WP*LP*WS/1"Dia." if 1" diameter holes shown in FIG. 3D are used in flow passage zone 45 of flow control means 40C1 and 40C2. Further, the example assumes that the belt has three operating cycles. In this modified nomenclature, the brackets indicate that flow passage zones 45A are located on a first belt and flow passage zones 45B and 45C are located on a second belt. From previous descriptions, it will be apparent that each regenerative device experiences a fluid contact period with process fluid A, followed again by another fluid contact period with fluid process A, followed by a process fluid contact period with fluid C, followed by a process fluid contact period with process fluid B, followed again by another process fluid contact period with fluid B and finally followed by a process fluid contact period with fluid C. The use of six regenerative devices ensures that the flow of any of the fluids through the regenerative system is not interrupted. The use of repeat contact periods of a fluid as described above with respect to fluids A and B may be required in some process cases to ensure the completion of the regenerative step to a predetermined level of completion.

Different configurations of flow passage zones 45 and solid zones 48 on flow control means 40C will give different operating results for regenerative system 1. For example, in the embodiment of regenerative system 1, shown in FIG. 17A, the belt designation could be "−1/3/($1_A$)($1_C1_B1_B1_B1_C$)/WP*LP*WS/1"Dia.". Thus in this situation, each regenerative device will experience a fluid contact period with fluid A, followed by a fluid contact period with fluid C, followed by three fluid contact periods with fluid B, and finally followed by a fluid contact period with fluid C. In this same example, if the belt designation is "−1/3($1_A1_C$( $1_B1_B1_B$)$1_C$)/WP*LP* WS/1"Dia.", then flow passage zones 45A and 45C are located on the first belt and flow passage zones 45B are located on the second belt.

As another example, in the embodiment of regenerative system 1, shown in FIG. 17A, the belt designation could be "−1/3/($1_A$)($1_C1_B1_B1_B$0)/WP*LP*WS/1"Dia.". Thus in this situation, each regenerative device will experience a fluid contact period with fluid A, followed by a fluid contact period with fluid C, followed by three fluid contact periods with fluid B, and finally followed by an idle period wherein no fluid contacts the regenerative material.

The above examples assume that the dimensions WP and WS are equivalent for the flow passage zones associated with each process fluid. If the flow passage zone for each fluid has a different WS and WP dimension, then the nomenclature can be changed to $WP_A$×$LP_A$×$WS_A$ for flow passage zones 45A, $WP_B$×$LP_B$×$WS_B$ for flow passage zones 45B, $WP_C$×$LP_C$×$WS_C$ for flow passage zones 45C, etc. Thus in a case where there are three process fluids each having different sized flow passage zones then the regenerative system nomenclature described above could be changed to "3/6-1/3/($1_A1_A$)($1_C1_B1_B1_C$)$WP_A$×$LP_A$×$WS_A$/$WP_B$×$LP_B$×$WS_B$/$WP_C$×$LP_C$×$WS_C$/1"Dia." to reflect the different sizes of flow passage zones 45A, 45B, and 45C respectively.

The operation of the regenerative system of FIG. 17A is described in FIGS. 18A, 18B, 18C, 18D, 18E, and 18F. A cross-sectional representation of the regenerative system which shows the fluid plenums and fluid passage zones is also shown in FIG. 17B. For clarity, the drive mechanism 50 is not shown in FIG. 17B. Also for clarity, the flow passage zones 45A, 45B, and 45C in FIG. 17B are shown to be simultaneously exposed to the same regenerative device resulting in process air streams A, B, and C all simultaneously entering the regenerative device. However, in actual practice, flow passage zones 45A, 45B, and 45C are located as shown in FIG. 18A so that only one of the process fluids can enter a regenerative device at any time.

Following the descriptional narrative used in describing previous embodiments of the regenerative system 1, FIG. 18A shows a representational view of flow control means 40C1 and 40C2 showing the location of fluid passage zones 45A, 45B, and 45C. It should be noted that the width of the solid portion of flow control means 40C between adjacent flow passage zone 45A and 45C and between adjacent flow passage zone 45C and 45B should be at least one-half of the width of opening 22 in the fluid communication means to prevent cross-mixing of fluids A and B In FIG. 18A, the width of the solid portion of flow control means 40C between adjacent flow passage zone 45A and 45C and between adjacent flow passage zone 45C and 45B is shown equal to the width of opening 22 in the fluid communication means to prevent cross-mixing between fluids A and C and between fluids C and B: Furthermore, the width of secondary sub-set of flow passage zone {45A, 45A} is shown to be equal to twice the width of opening 22. The flow passage zones in secondary sub-set {45A, 45A} are shown to be located close to each other to reduce the amount of pressure and flow fluctuation that may occur when flow control means 40C is moved. In practice, a single flow passage zone with width equal to two times the width of opening 22 may also be used instead of the two flow passage zone sub-set {45A, 45A} without affecting the operation of the regenerative system. Other combinations of sizes of fluid passage zones and distances between the passage zones are possible and will be obvious to a person having ordinary skill in the art.

FIG. 18B shows a representational view of the fluid plenums 70A, 70B and 70C and fluid communication means 20A-1, 20A-2, 20A-3, 20A-4, 20A-5, 20A-6 and fluid communication means 20B-1, 20B-2, 20B-3, 20B-4, 20B-5, 20B-6 and fluid communication means 20C-1, 20C-2, 20C-3, 20C-4, 20C-5, 20C-6. FIGS. 18C, 18D, 18E, and 18F are "freeze-frame" sequential representation of the positions of flow passage zones 45A, 45B, and 45C relative to fluid communication means 20A-1, 20A-2, 20A-3, 20A-4, 20A-5, 20A-6 and fluid communication means 20B-1, 20B-2, 20B-3, 20B-4, 20B-5, 20B-6 and fluid communication means 20C-1, 20C-2, 20C-3, 20C4, 20C-5, 20C-6 during the operation of regenerative system 1. For clarity, drive system 50 is not shown in these figures. In FIG. 18C, flow passage zones 45A are shown in an overlapping position with fluid communication means 20A-5 and 20A-6, while flow passage zones 45C are shown in an overlapping position with fluid communication means 20C4 and 20C-1, and flow passage zones 45B are shown in an overlapping position with fluid communication means 20B-2 and 20B-3. Thus in this first position of flow control means 40C1 and 40C2, process fluid A is allowed to contact the regenerative material 14 in regenerative devices RD5 and RD6, and process fluid B is allowed to contact the regenerative material 14 in regenerative devices RD2 and RD3 while process fluid C is allowed to contact the regenerative material 14 in regenerative devices RD1 and RD4.

FIG. 18D is another "freeze-frame" representation of Multi-Port Valve Assembly 5 which shows another operating position of regenerative system 1 after flow control means 40C1 and 40C2 have been moved to the left. Following the above description, it will be seen that in this second position of flow control means 40C1 and 40C2, process fluid A is allowed to contact the regenerative material 14 in regenerative devices RD4 and RD5, and process fluid B is allowed to contact the regenerative material 14 in regenerative devices RD1 and RD2 while process fluid C is allowed to contact the regenerative material 14 in regenerative devices RD3 and RD6.

Similarly, in the "freeze-frame" representation of Multi-Port Valve Assembly 5 in FIG. 18E, it can be seen that process fluid A is allowed to contact the regenerative material 14 in regenerative devices RD3 and RD4, and process fluid B is allowed to contact the regenerative material 14 in regenerative devices RD1 and RD6 while process fluid C is allowed to contact the regenerative material 14 in regenerative devices RD2 and RD5. Similarly, in the "freeze-frame" representation of Multi-Port Valve Assembly 5 in FIG. 18F, it can be seen that process fluid A is allowed to contact the regenerative material 14 in regenerative devices RD2 and RD3, and process fluid B is allowed to contact the regenerative material 14 in regenerative devices RD5 and RD6 while process fluid C is allowed to contact the regenerative material 14 in regenerative devices RD1 and RD4. Thus it can be seen that successive movement of flow control means 40C1 and 40C2 to the left results in regenerative material 14 in each regenerative device, RD1 to RD6, being contacted twice by process fluid A, once by process fluid C, twice by process fluid B, and once again by process fluid C to complete an operating cycle for the regenerative system 1 of FIGS. 17A and 17B.

The regenerative system of FIG. 17A is particularly useful in a situation such as that described above for FIG. 14. If process fluids A and B react with each other, a third inert fluid C can be introduced into the regenerative device between process fluids A and B to remove any residual process fluid A or process B prior to the entry of process fluid B or process fluid A. Thus each regenerative device will experience two contact periods with process fluid A, followed by a contact period with process fluid C, followed by two contact periods with process fluid B, and finally followed by a contact period with process fluid C.

All of the embodiments of the invention that have been described so far utilize one Multi-Port Valve Assembly 5 for flow control of various fluids through selected regenerative devices for pre-determined periods of time. However a regenerative system can also utilize more than one Multi-Port Valve Assembly to control the flow of fluids through individual regenerative devices. FIGS. 19A and 19B show another embodiment of regenerative system 1 wherein each of regenerative devices RD1, RD2, RD3, RD4, RD5, and RD6 have a second end which is adapted for fluid communication similar to the first end. In this embodiment, the configuration of flow control means 40C is similar to that shown above for flow control means 40C1 and 40C2 in FIG. 18A, however, all flow passage zones 45 are assumed to be on one flow control means only even though they could be located on more than one flow control means as in FIG. 18A. A second Multi-Port Valve Assembly 5' is located adjacent to the second end of regenerative devices RD1, RD2, RD3, RD4, RD5, and RD6. Though not necessary, Multi-Port Valve Assembly 5' can be made identical to Multi-Port Valve Assembly 5. Thus Multi-Port Valve Assembly 5' can have complementary fluid plenums 70A', 70B', 70C', etc for each fluid A, B, C, etc. Multi-Port Valve Assembly 5' also has a flow control means 40C' which can be identical to flow control means 40C in Multi-Port Valve Assembly 5. Flow control means 40C and flow control means 40C' are arranged so that individual flow passage zones 45A, 45B, and 45C in flow control means 40C are aligned with similar flow passage zones 45A', 45B', and 45C' in flow control means 40C'. Multi-Port Valve Assembly 5' also has a set of fluid communication means for example 20A'-1, 20B'-1, etc. which can be identical to a set of fluid communication means for example fluid communication means 20A-1, 20B- 1, etc which is located on Multi-Port Valve Assembly 5.

Multi-Port Valve Assembly 5' also has a drive system 50' which can be identical, except for its direction of movement of flow control means 40C', to drive mechanism 50 on Multi-Port Valve Assembly 5. Hence, drive mechanisms 50B and 50B' in regenerative system 1 of FIG. 19A, move flow control means 40C and 40C' at equal speeds in the same direction relative to fluid plenums 70A and 70A'. Thus if flow control means 40C moves from right to left within gap 26 (not shown) between the set of fluid communication means 20 and the set of fluid plenums 70, then flow control means 40C' also moves from right to left within gap 26' (not shown) between the set of fluid communication means 20' and the set of fluid plenums 70'. Thus any one of regenerative devices RD1, RD2, RD3, RD4, RD5, and RD6 which is seeing a flow passage zone 45A or 45B or 45C at its first end will see a correspondingly matched flow passage zone 45A' or 45B' or 45C' at its second end. It is not necessary that flow passage zones 45A, 45B, and 45C exactly overlap flow passage zones 45A', 45B', and 45C'. As shown in FIG. 18B, they could be on different sides of the flow control means. Thus if flow passage zones 45A are located on the right side of flow control means 40C, then flow passage zones 45A' can be located on the right side or the left side of flow control means 40C'. If flow passage zones 45A' are located on the left side of flow control means 40C', the flow of fluid A will be between the bottom right corner of the regenerative device being contacted by fluid B and the upper left comer of the regenerative device. Similar arrangement of flow passage zones 45B and 45B' will cause fluid B to flow between the upper right corner of the regenerative device being contacted by fluid B and the bottom left comer of the regenerative device. Such an arrangement may be advantageous to ensure that there is no direct by-passing of the process fluid across the smallest flow-path within the regenerative device.

The supply and removal of process fluids A, B, C, etc. from the regenerative system 1 of FIG. 19A can be arranged so that a process fluid can flow either in the same direction within the regenerative device as another process fluid or it can flow in an opposite direction to the other process fluid.

Assume, for example, that two process fluids A and B are processed in the regenerative system shown in FIG. 19A. Also assume that plenum 70A is the plenum to which fluid A is supplied. Also assume that plenum 70A' is the plenum from which fluid A is removed and plenum 70B is the plenum to which fluid B is supplied and plenum 70B' is the plenum from which fluid B is removed. Thus, in this configuration, fluid A and fluid B will flow in the same direction within the regenerative direction. Therefore, the regenerative device is a "parallel flow regenerative device" with respect to the flow of fluids A and B.

Alternatively, it can be assumed that plenum 70A is the plenum to which process fluid A is supplied and plenum 70A' is the plenum from which fluid A is removed and plenum 70B' is the plenum to which fluid B is supplied and plenum 70B is the plenum from which fluid B is removed. Thus, in this configuration, fluid A and fluid B will flow in opposite directions within the regenerative device. Therefore, the regenerative device is a "counter-flow regenerative device" with respect to the flow of fluids A and B.

In the embodiment of the regenerative system 1 of FIG. 19A, flow control means 40C and 40C' are identically constructed and positioned so that flow passage zones on 40C are matched with corresponding flow passage zones on 40C'. Thus the corresponding flow passage zones on flow control means 40C and 40C' move as a matched pair in the same direction. If the endless belt designation for the two flow control means used in this regenerative system is "$2/3/1_A1_A01_B1_B0/1_A'1_A'0'1_B'0'$/WP*LP*WS/1"Dia." belt, then at any time the regenerative material 14 in any two of regenerative devices RD1, RD2, RD3, RD4, RD5, and RD6 will be in contact with fluid A and the regenerative material 14 in another two of the above regenerative devices will be in contact with fluid B while the remaining two intermediate regenerative devices will be experiencing an idle period. Thus each regenerative device will experience an idle period followed by two contact periods with fluid A, followed by an idle period, and followed in turn by two contact periods with fluid B before the cycle is repeated.

Any number of process fluids can be used in regenerative system 1 of FIG. 19A. Also the flow of any of the process fluids can be arranged so that it is in a parallel-flow configuration with a second process fluid but in a counter-flow configuration with a third process fluid. It is contemplated that regenerative system 1 of FIGS. 19A and 19B will be particularly useful for energy conservation.

For example, an industrial facility which desires to recover exhaust heat from several exhaust-air streams can direct these to a regenerative system similar to regenerative system 1 of FIG. 19A. In this application, regenerative system 1 of FIG. 19A contains regenerative heat-sink materials 78 for removal and storage and transfer of heat from one process fluid to another. The direction of flow i.e. parallel or counterflow, sequence and contact period of these streams can be individually arranged so that the maximum heat is transferred from the exhaust streams to a clean air stream which can be used within the facility for space-heating or process purposes.

In the above example, assume that an industrial facility has 4 process fluids A, B, C, and D respectively which are currently exhausted to atmosphere. These process fluids have exhaust temperatures $T_A$, $T_B$, $T_C$, and $T_D$ respectively where $T_A>T_B>T_C>T_D$. Further assume that the facility wishes to strip the sensible heat from these process fluid streams to heat two process fluid-streams, E and F to preheat temperatures of $T_E$ and $T_F$ respectively. A regenerative heat-exchanger such as that described in FIG. 19A, can be used to carry out the preheating of process fluid streams E and F by utilizing the waste heat in process fluid streams A, B, C, and D. Such a regenerative heat-exchanger would use regenerative heat-sink media 78 as the regenerative material and can be described by the nomenclature established above as "$6/6\text{-}2/3/1_D1_C1_B1_A1_E\ 1_F/1_D'1_C'1_B'1_A'1_E'1_F'$/WP*LP*WS/1"Dia.". Thus, the regenerative heat-sink materials 78 in any regenerative device RD1 to RD6 of FIG. 19A will initially contact the least hot exhaust stream (stream D), then contact the next hotter exhaust stream (stream C), then contact the next hotter exhaust stream (stream B), and finally contact the hottest exhaust stream (stream A) so that the regenerative heat-sink materials 78 are raised to the highest temperature in the cycle. The regenerative heat-sink materials 78 are then used to heat up the process fluid stream which requires the highest preheat temperature. In this example, process fluid stream E will be first heated up to preheat temperature $T_E$. The partially cooled regenerative heat-sink materials 78 is then used to preheat process fluid stream F to its required preheat temperature $T_F$. Additional purge streams or blind flow passage zones can be incorporated in flow control means 40C and 40C' if necessary to reduce potential cross-mixing of the various process streams. Such refinements will be obvious to a person having ordinary skill in the art.

The regenerative system of FIG. 19A can also be used as a VOC Concentrator by using regenerative adsorption materials as defined above instead of the regenerative heat-sink materials 78. Such a system is shown in FIG. 20 in which regenerative heat-sink materials 78 are shown replaced by regenerative adsorption materials 172. The operation of the regenerative system as a VOC Concentrator follows the operational steps described above for the regenerative heat-exchanger shown in FIG. 19A and will be obvious to a person having ordinary skill in the art.

As an example of the use of such a system, assume that an industrial facility has a VOC containing exhaust stream A. The concentration of the VOCs in process stream A is assumed to be about 10 ppmv. To economically recover the VOCs, it may be necessary that the VOC concentration be at least 100 ppmv. It is contemplated that a regenerative adsorption system can be used to carry out the concentration of the VOC laden process steams. The regenerative adsorption system described by the nomenclature established above as "2/6-2/3/$1_A1_A1_A1_A1_A1_B$/$1_A'1_A'1_A'1_A'1_A'1_B'$/WP*LP*WS/1"Dia." is used to carry out the concentration of the VOCs.

When process stream A is passed through the regenerative system 1 of FIG. 20, the VOCs are adsorbed on to the regenerative adsorption media 172. A clean air-stream designated as process fluid B is then used to desorb the VOCs from the regenerative media. Process fluid B is generally passed counter-current to process fluid A. Generally, process stream B has a volumetric flow-rate which is approximately one-tenth that of process stream A. Therefore, the concentrations of the VOCs in process stream B after the transfer of the VOCs from fluid A to fluid B is approximately 10 times that of the concentrations of the VOCs in process stream A. The VOCs in process fluid B are then recovered using conventional condensation and fractionation methods or by other separation process or they can be destroyed in a thermal or catalytic oxidizer.

Referring now to FIG. 20, regenerative devices RD1, RD2, RD3, RD4, RD5, and RD6 are each filled with regenerative adsorption material 172. Process fluid A is introduced into the regenerative system 1 through inlet 90A on fluid plenum 70A. Assume that flow control means 40C is positioned so that one of its flow passage zone 45A is aligned with a fluid communication means 20A-1 of regenerative device RD1. As described above with respect to FIG. 19A, flow control means 40C' is also positioned so that a corresponding flow passage zone 45A' is aligned with a fluid communication means 20A'-1 of regenerative device RD1. Thus process fluid A flows from fluid plenum 70A to fluid plenum 70A'. The VOC in process fluid A is stripped and adsorbed onto regenerative material 172 in RD1. Thus the concentration of VOCs in process fluid A as it leaves fluid plenum 70' is greatly reduced resulting in relatively VOC-free process fluid A.

Similarly, process fluid B is introduced into regenerative system 1 through inlet 90B' on fluid plenum 70B'. Assume that flow control means 40C' is positioned so that one of its flow passage zone 45B' is aligned with fluid communication means 20B'-1 of regenerative device RD2. As described above with respect to FIG. 19A, flow control means 40C is also positioned so that a corresponding flow passage zone 45B is aligned with a fluid communication means 20B-1 of regenerative device RD2. Thus process fluid B flows, counterflow to process fluid A, from fluid plenum 70B' to fluid plenum 70B. Assume further that regenerative device RD2 had previously been contacting process fluid A as described above with respect to RD1. Thus regenerative adsorption materials 172 in RD2 are loaded with VOCs prior to their being contacted with process fluid B. Since process fluid B is relatively free of VOCs, it strips the loaded VOCs from regenerative adsorption materials 172 in RD2. Therefore, the concentration of VOCs in process fluid B as it leaves fluid plenum 70B is increased resulting in concentrated VOC-containing process fluid stream B. As is well known, the stripping of VOCs from regenerative materials can be accelerated by heating process stream B to a higher temperature at which desorption is facilitated. A temperature regulation device, as described below for FIG. 23, can also be used to maintain the optimum adsorption and desorption temperatures in adsorption material 172 during the adsorption and desorption cycles.

As described above by the nomenclature, the regenerative adsorption materials 172 in any of regenerative devices RD1 to RD6 in regenerative system 1 of FIG. 20 contact process fluid A for five contact periods and process fluid B for one contact period. If the amount of regenerative adsorption materials 172 in regenerative devices RD1 to RD6 is correctly chosen for the design contact period, it is expected that this contact should remove most of the VOCs from the process fluid A. However other configurations of the embodiment of the regenerative adsorption system shown in FIG. 20 can also be used without departing from the spirit of the invention. For example, a greater or lesser number of regenerative adsorption devices can be used The relative flowrates of process fluids A and B can also be different from the ten to one ratio described above. Additional purge streams or blind flow passage zones can also be incorporated in the regenerative adsorption system to prevent cross-mixing of process streams from occurring. Such methods are well known and are described at length in sales literature from manufacturers of rotary VOC Concentrators such as Siebu-Gieken, Daikin, Munters, etc. For example, a regenerative adsorption system which incorporates purging using a purging fluid C can be described by the nomenclature "3/6-2/3/$1_A1_A1_A1_A1_C1_B1_C$/$1_A'1_A'1_A'1_C'1_B'1_C'$/WP*LP*WS/1"Dia.". In this configuration, the regenerative device is purged with purging fluid C in between three periods of contact with process fluid A and one period of contact with process fluid B respectively.

Other configurations can also be used in the VOC Concentrator described above in FIG. 20. For example, eight regenerative adsorption devices could be used and purge air could be used to flush out the residual VOC-laden air from the inlet zones prior to switch over from process fluid A to process fluid B and vice versa. If the purging fluid is designated as fluid C, such an VOC Concentrator would be described by the nomenclature "3/8-2/3/$1_A1_A1_A1_A1_C1_B1_B1_C$/$1_A'1_A'1_A'1_A'1_C'1_B'1_B'1_C'$/WP*LP*WS/1"Dia.". In this configuration, each regenerative device is purged with purging fluid C in between four periods of contact with process fluid A and two periods of contact with process fluid B respectively. The use of purging air-in multiple bed VOC Concentrators has been well described in literature and will be apparent to a person having ordinary skill in the art. The above examples of VOC concentration devices using regenerative adsorption materials are not meant to be all-encompassing of the art. Yet other arrangements will be apparent to one of ordinary skill in the art.

The regenerative system of FIG. 19A can also be adapted for use as a Regenerative Thermal Oxidizer or Regenerative Catalytic Oxidizer (RCO). An embodiment of regenerative system 1 that is used as a Regenerative Thermal Oxidizer is shown in FIG. 21. In this embodiment, the regenerative material 14 used is regenerative heat-sink materials 78 as defined previously in this description. Heating means 120 is provided to heat up the regenerative heat-sink materials 78 in each of the regenerative devices RD1 to RD6. Heating means 120 could include fossil fuel combustion devices, electric heater elements, external hot air sources, induction heaters, microwave heaters, infra-red heaters, hot-oil coils, steam coils, external heat-conducting members, heat-exchangers, solar-energy heaters, etc. FIG. 21 shows heating means 120 located near the middle of regenerative heat sink material 78. However, as is known, heating means 120 could also be located outside the bed and operated to produce a hot zone near the center of regenerative heat-sink material 78.

As an example, the Regenerative Thermal Oxidizer shown in FIG. 21 can be described by the nomenclature established above as "$2/6\text{-}2/3/1_A1_A1_A1_B1_B1_B/1_A'1_A'1_A'1_B'1_B'1_B'$/WP*LP*WS/1"Dia.". The single VOC-containing process stream is divided into two streams, designated as process fluid A and process fluid B which are passed in a counter-flow manner in the regenerative device as described above with respect to FIG. 19A. Thus, for example, process fluid A can be introduced into regenerative system 1 through fluid inlet 70A and can leave the system through fluid outlet 70A' and fluid B can be introduced into regenerative system 1 through fluid inlet 70B' and can leave the system through fluid outlet 70B.

For operation of the regenerative system 1 of FIG. 21, heating means 120 is first activated until the middle section 78M of the regenerative heat-sink bed 78 in each of regenerative devices RD1 to RD6 reaches a temperature greater than the auto-ignition temperature of the VOCs. Process fluids A and B are then allowed to flow through regenerative system 1. As an example, assume the flow control means 40C and 40C' are positioned so that process fluid A enters regenerative device RD1 through fluid plenum 70A and leaves regenerative device RD1 through fluid plenum 70A'. When process fluid A reaches the hot middle section 78M of regenerative device RD1, it gets heated to above the auto-ignition temperature of the VOCs contained in it. The VOCs start oxidizing and release heat further raising the temperature of process fluid A. The hot, oxidized process fluid A then flows through the upper section 78U of regenerative device RD1. The upper section 78U of regenerative device RD1 is relatively colder than the oxidized process fluid A. Upper section 78U therefore removes heat from the hot oxidized fluid A and gets heated while fluid A gets cooled. Thus heat is removed from oxidized process fluid A and is recovered in upper section 78U resulting a high degree of thermal energy recovery.

Now further assume that flow control means 40C and 40C' are moved and are now positioned so that process fluid B enters regenerative device RD1 through fluid plenum 70B' and leaves regenerative device RD1 through fluid plenum 70B. When process fluid B enters the upper section 78U of regenerative device RD1, it strips some of the previously stored heat from section 78U. Thus process fluid B gets preheated while upper section 78U gets cooled. When process fluid B reaches the hot middle section 78M of regenerative device RD1, it gets further heated to above the auto-ignition temperature of the VOCs which start oxidizing and release heat further raising the temperature of fluid B. The hot, oxidized process fluid B then flows through the lower section 78L of regenerative device RD1. Lower section 78L of regenerative device RD1 is relatively colder than oxidized process fluid B. Lower section 78L therefore removes heat from the hot oxidized fluid B and gets heated while fluid B gets cooled. Thus heat is removed from oxidized process fluid B and is recovered in lower section 78L resulting a high degree of thermal energy recovery.

The above steps provide for the recovery of heat by transferring the stored heat from the upper section 78U or the lower section 78L of regenerative device RD1 to its lower section 78L or upper section 78U respectively while facilitating the pre-heating and cooling of process streams B and A.

The process described above with respect to the flow of fluids A and B in regenerative device RD1 also takes place in each of the other regenerative devices RD2 to RD6 in regenerative system 1 of FIG. 21. Thus the regenerative heat-sink bed 78 in each regenerative device RD1 to RD6 alternately contacts fluids A and B resulting in alternate heating and cooling of its upper and lower sections 78U and 78L respectively. The cycles described above are repeated for continuous oxidation of the VOCs in the polluted air-stream. As will be obvious, other configurations can also be used in regenerative system 1 of FIG. 21. For example, eight regenerative beds could be used and purge fluid could be used to flush out the residual VOC-laden air from the inlet zones prior to switch over from fluid A to fluid B and vice versa. If the purging fluid is designated as fluid C, the Regenerative Thermal Oxidizer would be described by the nomenclature "$3/8\text{-}2/3/1_A1_A1_A1_A1_C1_B1_B1_B1_C/1_A'1_A'1_A'1_C'1_B'1_B'1_B'1_C'$/WP*WS/1"Dia." The use of purging air in multiple bed Regenerative Thermal Oxidizers is well known and will be apparent to a person having ordinary skill in the art. The above examples of Regenerative Thermal Oxidizers are not meant to be all-encompassing of the art. Yet other arrangements will also be apparent to one of ordinary skill in the art.

The regenerative oxidizer system described above with respect to FIG. 21 can be easily adapted for catalytic oxidation by incorporating catalyst about the middle section 78M of regenerative heat-sink bed 78. An embodiment of regenerative system 1 of FIG. 21, which incorporates a catalyst 130 for oxidation of the VOCs at a lower auto-ignition temperature is shown in FIG. 22. Catalyst 130 can be coated on heat sink media 78 or can be mixed with the heat-sink materials 78 or can be arranged in layers within the heat-sink materials 78. In any case, catalyst 130 is so located so that it gets heated to its operating temperature by heating means 120 which is shown located within heat sink bed 78. The operation of the catalytic regenerative oxidizer follows the operational steps described above for the Regenerative Thermal Oxidizer system of FIG. 21 and will be obvious to a person having ordinary skill in the art.

While the Regenerative Thermal Oxidizer of FIG. 21 and the regenerative catalytic oxidizer of FIG. 22 have been shown with heating means 120 only, there may also be situations where the regenerative heat sink bed 78 has to be cooled because excess heat is generated by the oxidation of the VOCs. To maintain a stable operating condition under such circumstances, temperature regulating device 122 which will be described below with respect to FIG. 23 can be used instead of heating device 120 shown in FIGS. 21 and 22. The temperature regulating device 122 has the capability of adding or removing heat as needed from the regenerative heat sink beds 78 to maintain a stable operating temperature within the heat sink beds.

The regenerative system of FIG. 21 can also be easily adapted for use as a Reversible Chemical Reactor. An example of an embodiment of regenerative system 1 that is used as a Reversible Chemical Reactor is shown in FIG. 23. In this example, copper oxide supported on alumina substrate material in the form of alumina spheres is used as the chemically reversible material, 174. Each of the regenerative devices RD1 to RD6 in regenerative system 1 of FIG. 23 further has a temperature regulating device 122 for controlling the temperature of the chemical reversible material 174 at an optimum temperature for the chemical reaction under consideration. Temperature regulating device 122 could include heating and cooling devices or a combination of heating and cooling devices. Heating devices could include fossil fuel combustion devices, electric heater elements, external hot air sources, induction heaters, microwave heaters, infra-red heaters, hot-oil coils, steam coils, external heat-conducting members, heat-exchangers, solar-energy heaters, etc. Cooling devices could include cooling coils, refrigeration devices, external heat-conducting members, heat-exchangers, thermo-electric cooling devices, cooling fluid injectors, etc. The temperature regulating device 122 of FIG. 23 is located so that essentially all of the chemically reversible material 174 is maintained at an uniform optimum temperature for the chemical reaction to take place. However, temperature regulating device 122 can also be located so that only a part of chemically reversible material 174 is heated or cooled as described above. The Reversible Chemical Reactor of FIG. 23 is particularly useful for removing pollutants such as sulfur-dioxide and oxides of nitrogen from flue gases generated by industrial and commercial facilities. However, it could also be used for other chemical processes.

As an example, the Reversible Chemical Reactor of FIG. 23 can be described by the nomenclature established above as "2/6-2/3/$1_A1_A01_B1_B0/1_A'1_A'0'1_B'1_B'0'$/WP*LP *WS/1"Dia." Process fluid A is the flue-gas stream mixed with a pre-determined quantity of ammonia for reduction of the nitrogen oxides and process fluid B is an air-methane mixture used for regenerating the copper oxide from its reacted state.

Assume that fluid A is introduced into regenerative system 1 through fluid inlet 70A and leaves regenerative system 1 through fluid outlet 70A' and fluid B is introduced in to regenerative system 1 through fluid inlet 70B' and leaves regenerative system 1 through fluid outlet 70B. Thus the flow of process fluids A and B is counter to each other.

In this example, it is assumed the flow control means 40C and 40C' are positioned, as described previously with respect to other two-belt embodiments of regenerative system 1, such that process fluid A enters regenerative device RD1 through fluid plenum 70A and leaves regenerative device RD1 through fluid plenum 70A'. Therefore, flow passage zone 45A overlaps fluid communication means 20A-1 and flow passage zone 45A' overlaps fluid communication means 20A'-1. Using regenerative device RD1 as an example, temperature regulating means 122 is first activated until chemically reversible material 174 in regenerative device RD1 is at a temperature which is suitable for the reducing reaction to be carried out. In this particular example, a reaction temperature of about 400 degrees centigrade is contemplated as the optimum temperature for the chemical reaction.

The flow of process fluid A through regenerative device RD1 is then started to initiate the reducing reaction wherein the copper oxide in chemically reversible material 174 reacts with the sulfur dioxide and oxygen in the flue gas to form copper sulfate. The copper sulfate and the unreacted copper oxide further act as catalysts to react the oxides of nitrogen with the ammonia and the oxygen in the flue gas to produce nitrogen and water. When enough of the copper oxide is reacted to copper sulfate as evidenced by the decrease in conversion efficiency at fluid plenum 70A', regenerative device RD1 is put into an idle mode by advancing flow control means 40C and 40C' to overlap solid zone 48 and 48' of flow control means 40C and 40C' with fluid communication means 20A-1 and 20A'-1. Thus regenerative device RD1 is isolated from process fluids A and B.

When regenerative device RD1 is in an idle mode, temperature regulating device 122 is activated to increase the temperature of the reacted regenerative materials 174 in regenerative device RD1 to a suitable temperature for regeneration of the copper sulfate back to copper oxide. In this example, a temperature of about 450 degrees centigrade is contemplated. When the temperature of reacted materials 174 in regenerative device RD1 is at the desired temperature, regenerative device RD1 is put into the regeneration reaction mode by advancing flow control means 40C and 40C' to overlap flow passage zone 45B and 45B' of flow control means 40C and 40C' with fluid communication means 20B-1 and 20B'-1. For optimum conversion, process fluid B is passed in a counter-current manner in regenerative device RD1 relative to process fluid A. Therefore, process fluid B enters regenerative system 1 through fluid plenum 70B' and leaves regenerative system 1 through fluid plenum 70B. In the regeneration reaction, the methane in process fluid B converts the copper sulfate in reacted materials 1-74 in regenerative device 1 back to copper. The copper then reacts with the oxygen in the air in process fluid B to copper oxide which is the initial state of chemically reversible materials 174.

When enough of the copper sulfate has been regenerated back to copper oxide as evidenced by the decrease in conversion efficiency of the methane at fluid plenum 70A, regenerative device RD1 is put into a second idle mode by advancing flow control means 40C and 40C' to overlap solid zones 48 and 48' of flow control means 40C and 40C' with fluid communication means 20B-1 and 20B'-1.

When regenerative device RD1 is in an idle mode, temperature regulating device 122 is activated to reduce the temperature of the regenerated regenerative materials 174 in regenerative device RD1 back to a suitable temperature, contemplated to be about 400 degrees centigrade, in preparation for the reduction reaction as described above. When the temperature of reacted materials 174 in regenerative device RD1 is at the required temperature, regenerative device RD1 is put into the forward reaction mode by advancing flow control means 40C and 40C' to overlap flow passage zone 45A and 45A' of flow control means 40C and 40C' with fluid communication means 20A-1 and 20A'-1. This completes the entire reducing reaction and regeneration reaction cycle.

The process described above with respect to the flow of process fluids A and B in regenerative device RD1 also takes place in each of the other regenerative devices RD2 to RD6. Thus the regenerative materials 174 in each regenerative device RD1 to RD6 go through a cycle of first contacting process fluid A to reduce the sulfur dioxide and nitrogen oxides, then being further heated in an idle operating mode to a temperature suitable for the regeneration reaction to take place, then being contacted with process fluid B to regenerate the copper oxide, and finally being cooled down to a temperature suitable for the reducing reaction to take place.

While an equal number of contact periods have been assumed for both process fluid A and B, the contact periods for process fluid A, fluid B, and the idle periods in between fluid contact can be individually adjusted depending on conversion and chemical kinetic considerations.

Other configurations can be used in the Reversible Chemical Reactor described above. For example, 8 regenerative beds could be used and purge fluid could be used to flush out the residual pollutant-laden air from the inlet zones prior to switch over from process fluid A to process fluid B and vice versa. If the purging fluid is designated as fluid C, such a Reversible Chemical Reactor would be described by the nomenclature "3/8-2/3/$1_A1_A1_C01_B1_B1_C$0/$1_A$'$1_A$'$1_C$'0'$1_B$'$1_B$'$1_C$'0'/WP*LP*WS/1"Dia." The use of purging air in multiple bed regenerative devices is well known and will be apparent to a person having ordinary skill in the art. The above example of a Reversible Chemical Reactor is only meant to be illustrative of the method of chemical regeneration. The application of the above example of a Reversible Chemical Reactor can be extended to other reducing-regenerating reactions. Yet other reducing-regenerating reactions and configurations of the Reversible Chemical Reactor will be apparent to one of ordinary skill in the art.

Yet another embodiment of a regenerative system 1 which is used as a Regenerative thermal Oxidizer and which uses one Multi-Port Valve Assembly is shown in FIGS. 24A and 24B and can be described by the nomenclature "3/6-1/3/$1_C1_A1_A1_C1_B1_B$/WP*LP*WS/1"Dia.". The flow control means described by this nomenclature is a single endless belt 40C having its flow passage zones 45A, 45B, and 45C in the relative positions shown on FIG. 18A. In this nomenclature, process fluid A represents the VOC containing process air which is to be cleaned in regenerative system 1, process fluid B represents the process air after the VOCs have been oxidized in combustion chamber 140 (described below), and process fluid C represents the fluid used to purge the residual gases from individual regenerative devices between the passage of the polluted process fluid A and clean process fluid B.

As described previously, regenerative system 1 includes a Multi-Port Valve Assembly 5 which includes a set of fluid plenums 70A, 70B, and 70C. The fluid plenums are shown in FIG. 24B is a side elevational representation of regenerative system 1. Process fluid A, is introduced into regenerative system 1 through inlet 90A on fluid plenum 70A, while the cleaned process fluid B, is removed from regenerative system 1 through outlet 90B on fluid plenum 70B. Purge process fluid C, is either introduced or removed from regenerative system 1 through outlet 90C on fluid plenum 70C. For clarity, flow passage zone 45A, 45B, and 45C are all shown on FIG. 25B even though their actual positions are as shown above in FIG. 18A.

As described previously with respect to the other embodiments of regenerative system 1, fluid communication means 20A-i, 20B-i, and 20C-i (where "i" designates the serial number of the regenerative device RDi) enable fluid flow from fluid plenums 70A, 70B, and 70C to regenerative devices RD1, RD2, RD3, RD4, RD5, and RD6 respectively through flow passage zones 45A, 45B, and 45C on flow control means 40C. Regenerative devices RD1, RD2, RD3, RD4, RD5, and RD6 contain regenerative heat-sink materials 78 of the type described above. At their second ends, regenerative devices RD1, RD2, RD3, RD4, RD5, and RD5 are each in fluid communication with common combustion chamber 140.

The design and construction of combustion chambers for Regenerative Thermal Oxidizer applications is well known to persons having ordinary skill in the art. Combustion chamber 140 has an energy transfer device 150 which could be a fossil-fuel combuster, an electric heating device, electric heater elements, an external hot fluid source, an induction heater, a microwave heater, an infra-red heater, a hot-oil coil, a steam coil, an external heat-conducting member, a heat-exchanger, a solar-energy heater, etc. The use of combustion chamber heating devices in Regenerative Thermal Oxidizers is also well known to persons having ordinary skill in the art. The purpose of energy transfer device 150 is to initially provide heat-energy to bring the regenerative heat-sink materials 78 in the regenerative devices, RD1, RD2, RD3, RD4, RD5, and RD6, up to a predetermined operating temperature prior to the introduction of VOC containing fluid A into regenerative system 1. Techniques of preheating the regenerative heat-sink materials in Regenerative Thermal Oxidizers to a suitable operating temperature using a clean fluid such as ambient air are well known in the Regenerative Thermal Oxidizer industry.

Assume, for example, that flow control means 40C is positioned so that flow passage zones 45A overlap fluid communication means 20A-1 and 20A-2, flow passage zones 45B overlap fluid communication means 20B-4 and 20B-5, and flow passage zones 45C overlap fluid communication means 20C-3 and 20C-6. Thus process fluid A passes through fluid inlet 90A into fluid plenum 70A, then passes through flow passage zone 45A, fluid communication means 20A-1 and fluid communication means 20A-2 into regenerative devices RD1 and RD2. Regenerative material 78 in regenerative devices RD1 and RD2 has been heated in the start-up operation as described above or in a previous operating cycle. Since process fluid A is cooler than regenerative material 78, it removes heat from regenerative material 78. Regenerative material 78 in regenerative devices RD1 and RD2 therefore get cooled while process fluid A gets heated to a higher temperature which is termed a preheat temperature. The preheated fluid A now enters combustion chamber 140 where it is further elevated in temperature either through spontaneous thermal oxidation of the VOCs contained in it, or by accepting energy provided by energy transfer device 150 or by a combination of VOC oxidation and external energy input through energy transfer device 150.

The cleaned hot process fluid, now designated as process fluid B, leaves combustion chamber 140 and enters regenerative devices RD4 and RD5. The regenerative heat-sink material 78 in regenerative devices RD4 and RD5 was previously contacted by cold process fluid A in a previous cycle and is therefore at a relatively lower temperature than hot process fluid B. Process fluid B therefore gives up its sensible heat to the regenerative heat-sink material 78 in regenerative devices RD4 and RD5. The regenerative heat-sink material 78 in regenerative devices RD4 and RD5 therefore gets heated while process fluid B gets cooled. The cooled process fluid B then enters fluid plenum 70B through flow passage zones 45B on flow control means 40C and fluid communication means 20B-4 and 20B-5. Process fluid B finally exits regenerative system 1 through process fluid outlet 90B on fluid plenum 70B.

As described above with respect to the regenerative system 1 in FIG. 21, purge fluid C is used to remove residual VOC containing fluid (process fluid A) from any of regenerative devices RD1 to RD6 prior to its receiving the cleaned process fluid (process fluid B). As described previously, purge fluid C can be an external clean fluid such as ambient air. Alternately, it can be a portion of the cleaned process fluid (process fluid B) which is recycled from fluid plenum 90B or the exhaust stack (not shown) of regenerative system 1. In such a situation, the purge fluid C is introduced under positive pressure by means of a fan or blower (not shown), if necessary, into fluid plenum 70C through fluid inlet 90C. Purge fluid C then enters the two regenerative devices which are currently being purged. In the above example, regenerative device RD3 and RD6 are being purged. Therefore, purge fluid C flows through flow passage zones 45C into fluid communication means 20C-3 and 20C-6 into regenerative devices RD3 and RD6 and pushes the residual process fluid A into combustion chamber 140 where the VOCs are oxidized.

Alternately, a source of negative pressure such as an induced-draft fan (not shown) can be connected to fluid outlet 90C on fluid plenum 70C. The induced draft fan pulls the residual process fluid A from regenerative devices RD3 and RD6. In this case, the residual process fluid A that is pulled from the regenerative device is designated as purge fluid C. Purge fluid C flows from regenerative devices RD3 and RD6 through fluid communication means 20C-3 and 20C-6 through flow passage zones 45C into fluid plenum 70C and then through process fluid outlet 90C into the induced-draft purge fan. The purge fan then recycles purge fluid C back into the process fluid inlet duct where it mixes with and becomes a part of fluid A.

As will be obvious from previous descriptions of other embodiments of regenerative system 1, as flow control means 40C is moved, each of the regenerative devices RD1 to RD6 experiences two contact periods with fluid A, one contact period with purge fluid C, two contact periods with fluid B, and one contact period with purge fluid C.

It is not necessary that a purge fluid C be used with regenerative system 1 of FIGS. 24A and 24B. If the VOC Destruction and Removal Efficiency (DRE) requirements are not stringent, then a regenerative system without a purge can be used. As an example, such a regenerative system could be described by the nomenclature "2/6-1/3/$1_A1_A1_A1_B1_B$/WP*LP*WS/1"Dia." In this example, three regenerative devices are being cooled by dirty process fluid A and three regenerative devices are being heated by oxidized fluid B, no regenerative devices are being purged. Similarly, it is not necessary that two regenerative devices be purged at a time as shown in the first example. If the VOC DRE requirements are not stringent, then a system in which only one regenerative device is purged at a time can be used. Such a Regenerative Thermal Oxidizer system could be described by the nomenclature "3/6-1/3/$1_A1_A1_C1_B1_B$0/WP*LP*WS/1"Dia.". In this example, two regenerative devices are being cooled by dirty process fluid A and two regenerative devices are being heated by oxidized fluid B, one regenerative device is being purged by purge fluid C, while another regenerative device is idle. Thus the purge system only purges the regenerative device which previously received dirty process fluid A and does not purge the purge device which previously received the clean oxidized process fluid B. Also it is not necessary that an equal number of beds contact fluids A and B respectively. For example, the Regenerative Thermal Oxidizer described above could have three beds contacting fluid A, two beds contacting fluid B, and one bed being purged. Such a Regenerative Thermal Oxidizer system could be described by the nomenclature "3/6-1/3/$1_A1_A1_A1_C1_B1_B$/WP*LP*WS/1"Dia." In this example, three regenerative devices are being cooled by dirty process fluid A and two regenerative devices are being heated by oxidized process fluid B while only one regenerative device, which previously received dirty process fluid A, is being purged. Many other combinations of flow arrangements of the process fluids through the regenerative devices are possible and will be apparent to a person having ordinary skill in the art. Further, any number of beds can be used. For example, a Regenerative Thermal Oxidizer system can have 12 beds as described by the nomenclature "3/12-1/3/$1_A1_A1_A1_A1_A1_C1_B1_B1_B1_B1_B1_C$/WP*LP*WS/1"Dia.". In this example, five regenerative devices are being heated and five regenerative devices are being cooled while the remaining two intermediate regenerative devices are being purged. Yet other combinations of the number of beds, the allocation of fluids to beds, and purge systems are possible. These combinations will be readily apparent to a person having ordinary skill in the art.

The regenerative oxidizer system described above with respect to FIGS. 24A and 24B can be easily adapted for catalytic oxidation by incorporating catalyst 130 about the upper section 78U of regenerative heat-sink material 78. An embodiment of regenerative system 1 which incorporates a catalyst 130 for oxidation of the VOCs at a lower auto-ignition temperature is shown in FIG. 25. As described previously with respect to the embodiment of the regenerative system 1 of FIG. 22, catalyst 130 can be coated on heat sink regenerative material 78 or could be mixed with the heat-sink regenerative material 78 or could be arranged in a single layer or multiple layers within or on top of the heat-sink regenerative material 78. Catalyst 130 is located so that it is initially heated to its operating temperature, either directly or indirectly by energy input device 150. The use of catalysts for oxidizing VOCs is well known. The operation of the catalytic regenerative oxidizer follows the operational steps described above for the Regenerative Thermal Oxidizer system of FIGS. 24A and 24B and will be obvious to a person having ordinary skill in the art.

Yet other embodiments of the regenerative systems described above are possible and will be apparent to a person having ordinary skill in the art. For example, it is not necessary that two belts be used with the regenerative systems of FIGS. 19A, 19B, 20, 21, 22, and 23. A single flow control means 40" which services both sets of plenums, 70A, 70B, 70C and 70A', 70B', 70C' respectively can be used as shown in FIG. 26A. For example, such a system, which uses a common endless belt (which is assumed to have 5 cycles) as flow control means 40C", could be described by the nomenclature "3/6-1/5/$1_A1_A1_C1_B1_B1_C$/$1'_A1'_A1_A'1_C1'_B1'_B1'_C$/WP*LP*WS/1"Dia." where the prime symbol indicates that the flow passage zone is located at the second end of the regenerative device. The operation of the regenerative system 1 of FIG. 26 follows the operational steps of the embodiment of regenerative system 1 of FIGS. 19A, 19B, 20, 21, 22, and 23.

Yet another embodiment of regenerative system 1 according to FIG. 19A which incorporates a single drive mechanism 50B" to move both endless belts 40C and 40C' of the two Multi-Port Valve Assemblies 5 and 5' is shown in FIG. 26B. Such a system would still be described as having two Multi-Port Valve Assemblies even though only one common drive mechanism is used. The flow control means 40C and 40C' are designed to be identical in length and geometry. As shown in FIG. 26B, flow control means 40C and 40C' are positioned so that they sandwich regenerative devices RD1 through RD6 so that a regenerative device which is contacting fluid A has a fluid passage zone 45A at its first end and a fluid passage zone 45A' at its second end. Similarly, a regenerative device which is contacting fluid B has a fluid passage zone 45B at its first end and a fluid passage zone 45B' at its second end. As described previously with respect to FIG. 19B, flow passage zones 45A and 45A' do not have to identically placed with respect to each other on flow control means 40C and 40C'. Thus if the flow passage zones 45A are located on the right side of flow control means 40C, then the flow passage zones 45A' can be located on the right side or the left side of flow control means 40C'. If the flow passage zones 45A' are located on the left side of flow control means 40C', the flow of fluid A will be between the bottom right corner of the regenerative device being contacted by fluid A and the upper left corner of the regenerative device. Similar arrangement of flow passage zones 45B and 45B' will cause fluid B to flow between the upper right corner of the regenerative device being contacted by fluid B and the bottom left corner of the regenerative device. Such an arrangement may be advantageous to ensure that there is no direct by-passing of the process fluid across the smallest flow-path within the regenerative device. It will be obvious that such a system will operate similar to the embodiment of regenerative system 1 as shown in FIG. 19A.

It will also be apparent to a person having ordinary skill in the art that flow control means 40 in any of the embodiments of Multi-Port Valve Assembly 5 described above can be externally cleaned during operation of regenerative system 1. Because flow control means 40 generally moves very slowly in most regenerative devices, cleaning can be manual or mechanical or thermal. Various embodiments of regenerative system 1 which use mechanical and thermal cleaning systems such as high pressure jets, stationary brushes, rotating brushes, bake-out chambers etc. to clean the endless belt embodiment 40C of the flow control means, are shown in FIGS. 27, 28A, 28B, and 28C.

FIG. 27 shows the regenerative system 1 of FIGS. 24A and 24B, wherein flow control means 40C passes through a clean-out chamber 180 wherein pyrolizable matter that may have deposited on flow control means 40C is pyrolized using a heating device 182. The pyrolized matter is captured and returned back to the combustion chamber 140 of regenerative system 1 using a recycle fan 184 and recycle duct loop 186. While heating device 181 is represented as electric heating elements in FIG. 27, any other heating device can be used to heat flow control means 40C above the pyrolization temperature of the deposited matter. For example, heating device 182 can be a fossil-fuel burner or a steam coil or a hot-oil coil or any of the other heating devices described earlier in this description. Such devices as well as the practice of pyrolizing, capturing, and oxidizing of deposited matter from surfaces to be cleaned are well known.

Another example of a cleaning system to remove dirt from flow control means 40C is shown in the detail representation of FIG. 28A wherein high pressure compressed air or water or chemical cleaning solution or some other suitable cleaning medium such as sand 188 is blasted against the upper surface 84 and the lower surface 86 of flow control means 40C to physically dislodge deposited matter from surfaces 84 and 86 of flow control means 40C.

A third example of a cleaning system is shown in the detail representation of FIG. 28B wherein stationary cleaning brushes 190 are shown contacted against the upper and lower surfaces of flow control means 40C to physically dislodge deposited matter from surfaces 84 and 86 of flow control means 40C.

A fourth example of a cleaning system is shown in the detail representation of FIG. 28C wherein rotating cleaning brushes 192 are shown contacted against the upper and lower surfaces of flow control means 40C to physically dislodge deposited matter from surfaces 84 and 86 of flow control means 40C.

The above cleaning methods may also be used in conjunction with each other. For example, pyrolysis or thermal bake-out and mechanical cleaning and high-pressure blast cleaning can all be used in a regenerative system to clean the flow control means. The above methods as well as other methods of cleaning such as scrapping the surface of flow control means 40 with doctor blades are well known to persons having ordinary skill in the art. All of the cleaning methods described are supposed to be merely representation of the various cleaning methods that can be used to clean the surfaces of flow control means 40. Other cleaning methods can equally well be used without departing from the spirit of the invention.

While the flow control means cleaning method is shown for cleaning the flow control means outside the fluid plenum and regenerative device, the cleaning method can also be used within the fluid plenum and regenerative device. For example, doctor blades or brushes can be provided within the fluid plenum for dislodging the deposited particulate matter into the fluid plenum. A movable scrapper or a screw conveyor can then be used to remove the accumulated dislodged particulate matter from the fluid plenum out of the regenerative system. Other variations should now be seen obvious to the artisan in view of the detailed descriptions and the appended drawings. For example, the ends of the regenerative devices need not be horizontally oriented as shown in the above descriptions. The ends could be inclined or vertical without exceeding the scope of the invention. The ends of the regenerative devices also need not be flat as shown in the above descriptions. They could be curved and still operate within the scope of the invention. Further drive means 50 as well as flow control means 40 could be totally located within the fluid plenums and still operate within the scope of the invention. The artisan will also recognize that the endless belt embodiment of the flow control means need not be looped around the fluid plenums only. For, example, they could also be looped around the regenerative heat-exchanger/combustion chamber section of the embodiment of regenerative system 1 shown in FIG. 24A and still operate within the scope of the invention.

Therefore, the embodiments of the invention described above should not be construed as limiting the scope of the invention but as merely providing illustrations of some of the presently preferred embodiments of this invention. Thus the scope of the invention should be determined by the claims of this invention and their legal equivalents, rather than by the examples given above.

I claim:

1. A regenerative apparatus for process fluids comprising:

a first chamber having an inlet port and an outlet port;

a second chamber having an inlet port and an outlet port;

a first regenerative compartment including a regenerative material, the first regenerative compartment having an inlet port in communication with the outlet port of the first chamber and an outlet port in communication with the inlet port of the second chamber;

a second regenerative compartment including a regenerative material, the second regenerative compartment having an inlet port in communication with the outlet port of the first chamber and an outlet port in communication with the inlet port of the second chamber; and a valve in the form of at least one flexible movable endless belt, the belt being looped around at least one of the chambers such that a portion of the belt is located between and external to both the chamber and the compartments, the belt comprising a solid zone and a plurality of flow through apertures positioned thereon such that movement of the belt successively opens fluid communication pathways in a predetermined configuration between selected ports of the first and second chambers and selected ports of the first and second regenerative compartments when a flow through aperture is located therebetween, and closes the fluid communication pathways when a solid zone is located therebetween.

2. The regenerative apparatus for processing fluids of claim 1, wherein at least one flow through aperture on the belt is sized to partially overlap the inlet or outlet ports of the first and second regenerative compartments when the flow through aperture is in an intermediate position between the opening and closing of the fluid communication pathways for uninterrupted flow to or from the regenerative compartment.

3. The regenerative apparatus for processing fluids of claim 1, wherein the belt comprises at least two flexible endless belts, and at least one flow through aperture is located on each of the flexible endless belts.

4. The regenerative apparatus for processing fluids of claim 1, wherein the belt is a metallic belt.

5. The regenerative apparatus for processing fluids of claim 1, comprising at least two fluid flow pathways, one in each of the first and second regenerative compartments respectively, and the direction of flow of the first fluid pathway in the first regenerative compartment is substantially counter-current to the direction of flow of the second fluid pathway in the second regenerative compartment.

6. The regenerative apparatus for processing fluids of claim 1, wherein the regenerative material is a heat-sink material.

7. The regenerative apparatus for processing fluids of claim 1, wherein the regenerative material is an adsorption material.

8. The regenerative apparatus for processing fluids of claim 1, wherein the regenerative material is a chemically reactive material which has a first chemical state when in contact with a first fluid, converts into a second chemical state when in contact with a second fluid and reverts back to the first chemical state when in contact again with the first fluid.

9. The regenerative apparatus for processing fluids of claim 1, further comprising a means to control the temperature of the regenerative material by adding external energy to the regenerative material or removing excess energy from the regenerative material.

10. The regenerative apparatus for processing fluids of claim 1, comprising at least one additional chamber having an inlet port and an outlet port, the belt having flow through apertures positioned for selectively opening a fluid communication pathway between the additional chamber and at least one of the first and second regenerative compartments, the fluid communication pathway being closed by a solid zone of the belt upon further movement of the belt.

11. The regenerative apparatus for processing fluids of claim 1, further comprising at least one additional regenerative compartment having an inlet port and an outlet port, and at least one additional flow through aperture in the belt which selectively opens a fluid communication pathway in a predetermined configuration between selected ports of the first and second chambers and the inlet and outlet port of the additional regenerative compartment when an additional flow through aperture is located therebetween, and closes the fluid communication pathway when a solid zone of the belt is located therebetween.

12. The regenerative apparatus for processing fluids of claim 11 wherein four additional regenerative compartments are provided.

13. The regenerative apparatus for processing fluids of claim 12 comprising three chambers each receiving a process fluid through the inlet port thereof and six regenerative compartments each having a selected regenerative material for treatment of the process fluid, the belt having a plurality of flow through apertures therein positioned for opening and closing fluid communication pathways between the chambers and the regenerative compartments sequentially and in relation to each other to effect efficient processing of the process fluid.

14. The regenerative apparatus for processing fluids of claim 1 wherein the outlet port of the first chamber comprises a plurality of holes.

15. The regenerative apparatus for processing fluids of claim 1 wherein the inlet port of the second chamber comprises a plurality of holes.

16. The regenerative apparatus for processing fluids of claim 1 wherein at least one regenerative compartment has two inlet ports, and the belt opens and closes a fluid communication pathway for the two inlet ports.

17. The regenerative apparatus for processing fluids of claim 16 wherein two belts are provided, one for each of the two inlet ports, the regenerative apparatus comprising regenerative heat exchanger.

18. The regenerative apparatus for processing fluids of claim 1 further comprising a combustion chamber in fluid communication with at least one of the regenerative compartments, the regenerative apparatus and combustion chamber forming a regenerative thermal oxidizer.

* * * * *